US009271620B2

(12) United States Patent
Meredith et al.

(10) Patent No.: US 9,271,620 B2
(45) Date of Patent: Mar. 1, 2016

(54) VACUUM

(76) Inventors: Daryl S. Meredith, York, PA (US); Jeffrey P. Grant, Forest Hlll, MD (US); Robert R. Morin, Hanover, MD (US); Dustin L. DeMarr, Nottingham, MD (US); Barry Plato, Bel Air, MD (US)

( * ) Notice: Subject to any disclaimer, the term of this patent is extended or adjusted under 35 U.S.C. 154(b) by 601 days.

(21) Appl. No.: 13/431,302

(22) Filed: Mar. 27, 2012

(65) Prior Publication Data

US 2013/0255030 A1 Oct. 3, 2013

(51) Int. Cl.

| | |
|---|---|
| ***A47L 5/36*** | (2006.01) |
| ***A47L 7/00*** | (2006.01) |
| ***A47L 9/00*** | (2006.01) |
| ***A47L 9/10*** | (2006.01) |

(52) U.S. Cl.

CPC ..... *A47L 5/365* (2013.01); *A47L 7/0004* (2013.01); *A47L 9/0072* (2013.01); *A47L 9/106* (2013.01)

(58) Field of Classification Search

CPC ..... A47L 9/20; A47L 9/1691; A47L 5/28; A47L 9/1666; A47L 9/1683; A47L 7/0038; A47L 7/0028; A47L 7/0042; A47L 5/365; A47L 7/0004; A47L 9/0072; A47L 9/106

USPC ..... 15/352, 353, 347, 337, 319, 327.1, 15/327.6; 55/372, 374

See application file for complete search history.

(56) References Cited

U.S. PATENT DOCUMENTS

| | | | | |
|---|---|---|---|---|
| 2,660,457 | A * | 11/1953 | Mallon | 285/7 |
| 3,221,888 | A | 12/1965 | Muller | |
| 3,277,633 | A | 10/1966 | Smoot | |
| 3,541,764 | A | 11/1970 | Astrom | |
| 3,645,400 | A | 2/1972 | Floyd | |
| 4,171,208 | A * | 10/1979 | Lowder | 96/406 |
| 4,618,352 | A | 10/1986 | Nelson | |
| 4,841,595 | A * | 6/1989 | Wiese | 15/352 |
| 5,943,732 | A * | 8/1999 | Bosyj et al. | 15/328 |
| 7,082,640 | B2 | 8/2006 | McCutchen | |
| 7,300,481 | B2 | 11/2007 | Scheuch | |
| 7,814,926 | B2 | 10/2010 | Hoffmeier | |
| 7,861,367 | B2 | 1/2011 | Eckstein | |
| 7,947,099 | B2 | 5/2011 | Valentini | |
| 7,976,614 | B2 | 7/2011 | Eckstein | |
| 8,015,242 | B2 | 9/2011 | Ohi | |
| 2007/0125049 | A1 | 6/2007 | Menrik | |
| 2007/0174993 | A1 * | 8/2007 | Dever et al. | 15/352 |
| 2008/0086835 | A1 | 4/2008 | Stewen | |

(Continued)

FOREIGN PATENT DOCUMENTS

| | | |
|---|---|---|
| DE | 556619 | 7/1932 |
| DE | 589733 | 12/1933 |

(Continued)

*Primary Examiner* — Robert Scruggs

(74) *Attorney, Agent, or Firm* — Kofi Schulterbrandt; Scott B. Markow; Adan Ayala

(57) ABSTRACT

The present invention is directed to a vacuum including a dust extraction system. The system includes a filter assembly, an airflow generation assembly, and valve assembly. The airflow generation assembly is configured to draw contaminated air toward the filter assembly and exhaust filtered air as a discharge stream. The filter assembly is configured to remove contaminants from the contaminated airflow by capturing particulate material suspended within the airflow. The valve assembly is configured to selectively direct filtered airflow into the filter assembly such that the filtered air stream cleans the filter.

17 Claims, 55 Drawing Sheets

(56) References Cited

U.S. PATENT DOCUMENTS

| | | | | |
|---|---|---|---|---|
| 2008/0092326 | A1 | 4/2008 | Morishita | |
| 2008/0302070 | A1 | 12/2008 | Castronovo | |
| 2008/0302424 | A1 | 12/2008 | Castronovo | |
| 2009/0205159 | A1 | 8/2009 | Stewen | |
| 2009/0205491 | A1 | 8/2009 | Eckstein | |
| 2009/0205499 | A1 | 8/2009 | Eckstein | |
| 2010/0293743 | A1 | 11/2010 | Beskow | |
| 2010/0306955 | A1 | 12/2010 | Menrik | |
| 2011/0094052 | A1* | 4/2011 | Witter | 15/347 |
| 2011/0284028 | A1* | 11/2011 | Castronovo | 134/10 |

FOREIGN PATENT DOCUMENTS

| | | |
|---|---|---|
| DE | 595686 | 4/1934 |
| DE | 10449 | 3/1949 |
| DE | 1757515 | 6/1971 |
| DE | 4138223 | 2/1993 |
| DE | 10101218 | 7/2002 |
| DE | 10101219 | 7/2002 |
| DE | 20280185 | 2/2004 |
| DE | 202010012821.8 | 12/2010 |
| DE | 202011002455.5 | 3/2011 |
| EP | 736535 | 3/1955 |
| EP | 962934 | 7/1964 |
| EP | 0453177 | 10/1991 |
| EP | 1118303 | 7/2001 |
| EP | 1404434 | 10/2004 |
| EP | 1230973 | 8/2005 |
| EP | 1997415 | 12/2008 |
| WO | 8502528 | 6/1985 |
| WO | 03008069 | 1/2003 |
| WO | 2008154274 | 12/2008 |

* cited by examiner

VACUUM

FIELD OF THE INVENTION

The present invention is directed toward a construction site or tool shop vacuum and, in particular, to a vacuum including a filter system and an airflow arrangement that periodically cleans the filter system during operation.

BACKGROUND OF THE INVENTION

Tool shop vacuum cleaners (e.g., wet-dry vacuums) are designed to collect debris from a work area or connected tool via suction. Such vacuums typically include a tank and motor that drives an impeller to generate an airstream within the tank. Since the airstream includes debris, care must be taken to prevent the debris from reaching the motor and causing damage. In light of this, conventional systems further include a filter positioned upstream from the motor to capture debris as the contaminated airflow passes through the tank. Over time, however, the debris accumulates on the filter, restricting airflow and hampering performance. For example, a filter initially enabling airflow of approximately 80 cfm may begin degrading within minutes of operation, diminishing airflow capacity to approximately 10 cfm. Consequently, conventional vacuum systems require regular cleaning or replacement of the filter. This process requires a user to stop vacuum operation, open the tank, and remove the filter for cleaning or replacement. This is a time-intensive process that interrupts workflow.

Thus, it would be desirable to provide an airflow arrangement configured to clean a filter during operation, thereby increasing filter life and extending time between manual cleaning of the filter, as well as filter replacement.

SUMMARY OF THE INVENTION

The present invention is directed toward a construction site shop vacuum including a tank and a lid coupled to the tank. A separator plate is disposed within the vacuum such that the lid generally defines a motor chamber and the tank generally defines a collection chamber. The motor chamber houses a motor assembly, which is supported by the separator plate. The collection chamber, oriented upstream from the motor assembly, houses a filter system suspended from the separator plate. The separator plate includes conduits that permit airflow between the collection and motor chambers. Airflow between the chambers is controlled utilizing a valve assembly that selectively opens and closes the conduits.

Specifically, the valve assembly operates in a first mode, in which contaminated airflow is drawn into the collection chamber, passing through the filter system in a first direction. The filter medium of the filter system captures debris present in the airflow, cleaning the air passing therethrough. The filtered airflow is then directed into the motor chamber, exiting the vacuum as exhaust.

The valve assembly further operates in a second mode, in which at least a portion of the filtered airflow is redirected from the motor chamber back into the collection chamber. Specifically, the airflow is directed through the filter system in a second direction to expel debris that has accumulated on the filter medium. With this configuration, the media of the filter system are periodically cleaned during operation of the vacuum.

BRIEF DESCRIPTION OF THE DRAWINGS

Like reference numerals have been used to identify like elements throughout this disclosure.

DETAILED DESCRIPTION OF THE INVENTION

Figure 1A:
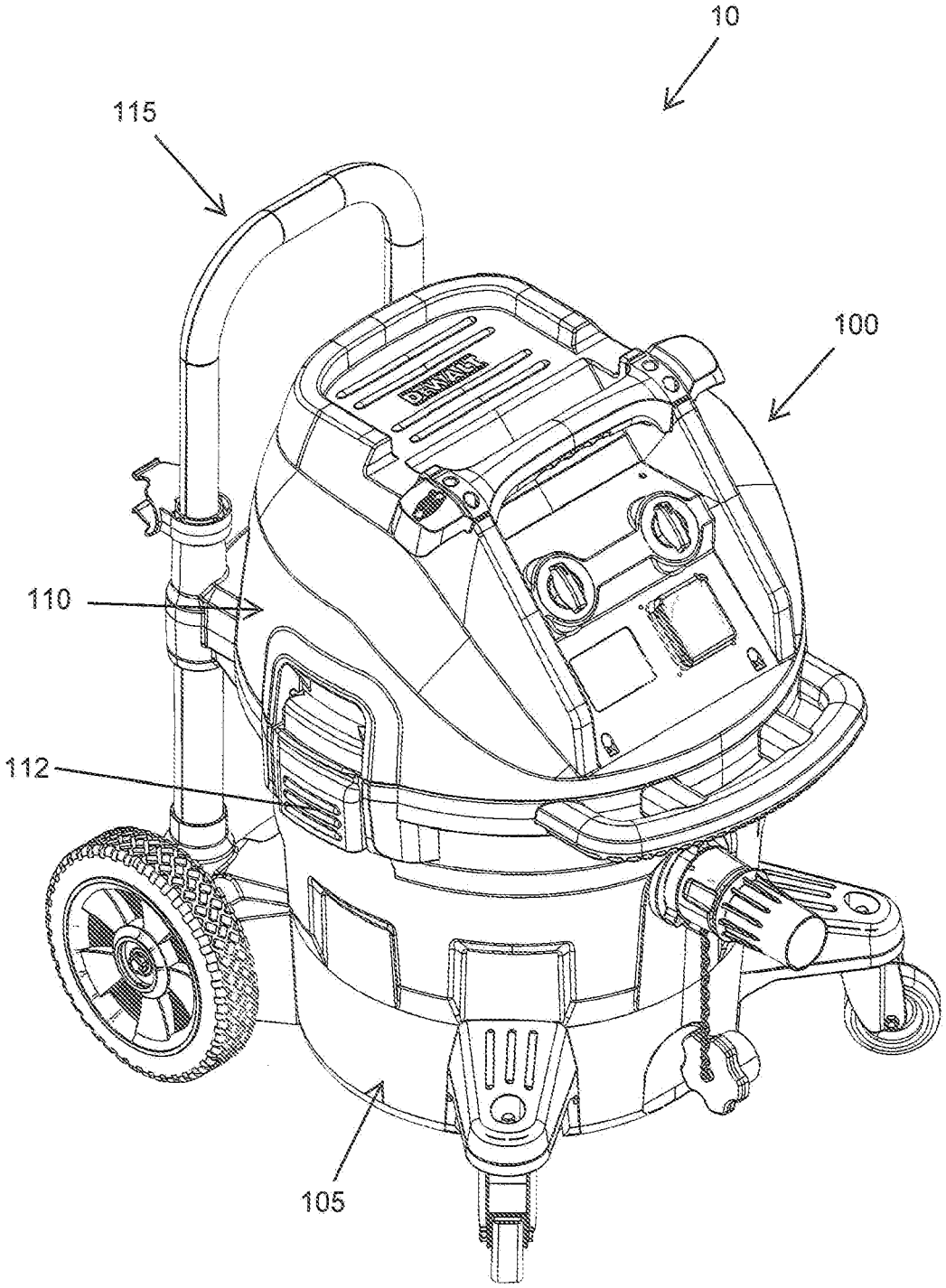
FIG. 1A illustrates a front perspective view of a vacuum in accordance with an embodiment of the invention.
Figure 1B:
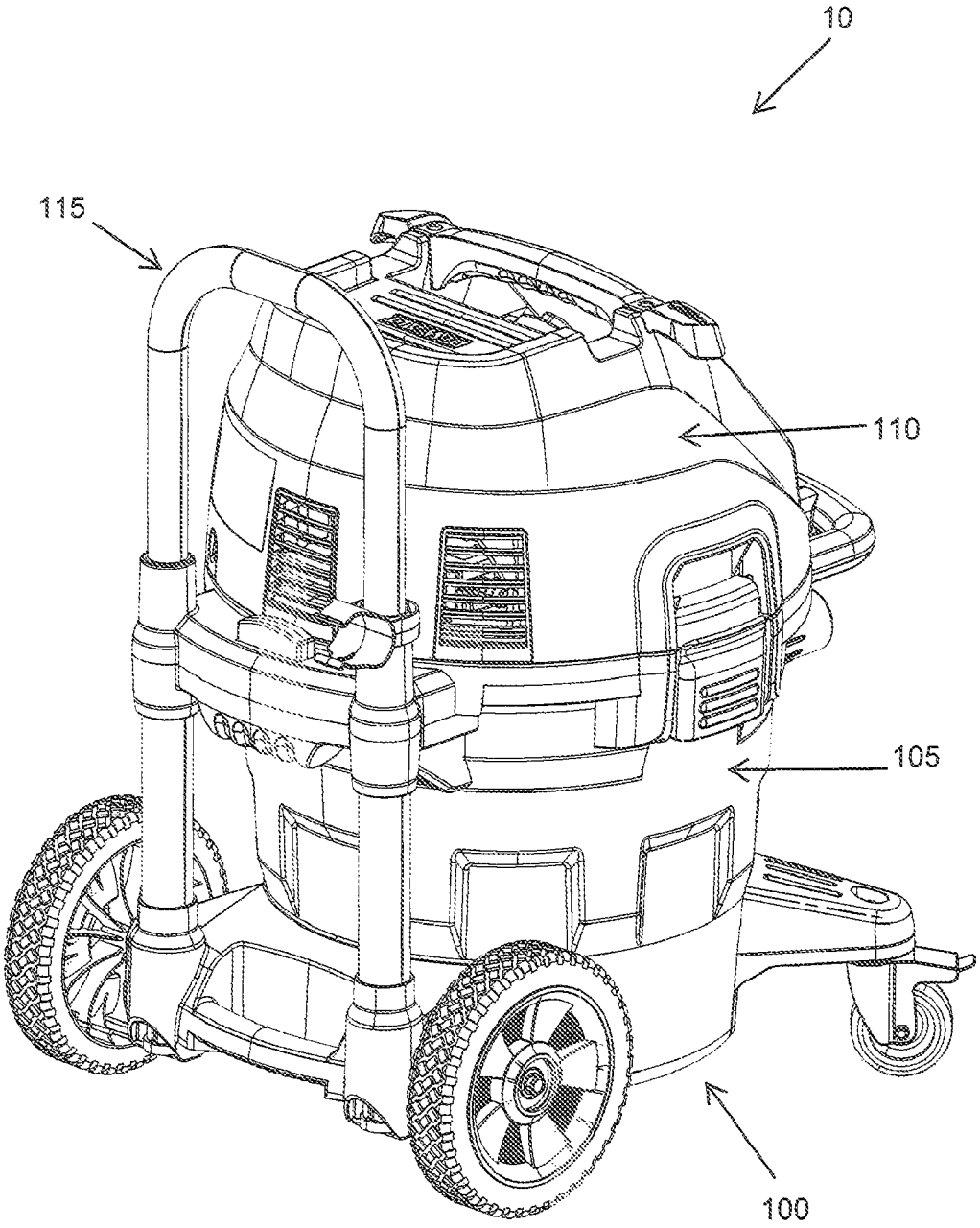
FIG. 1B illustrates a rear perspective view of the vacuum device shown in FIG. 1A.
Figure 2A:
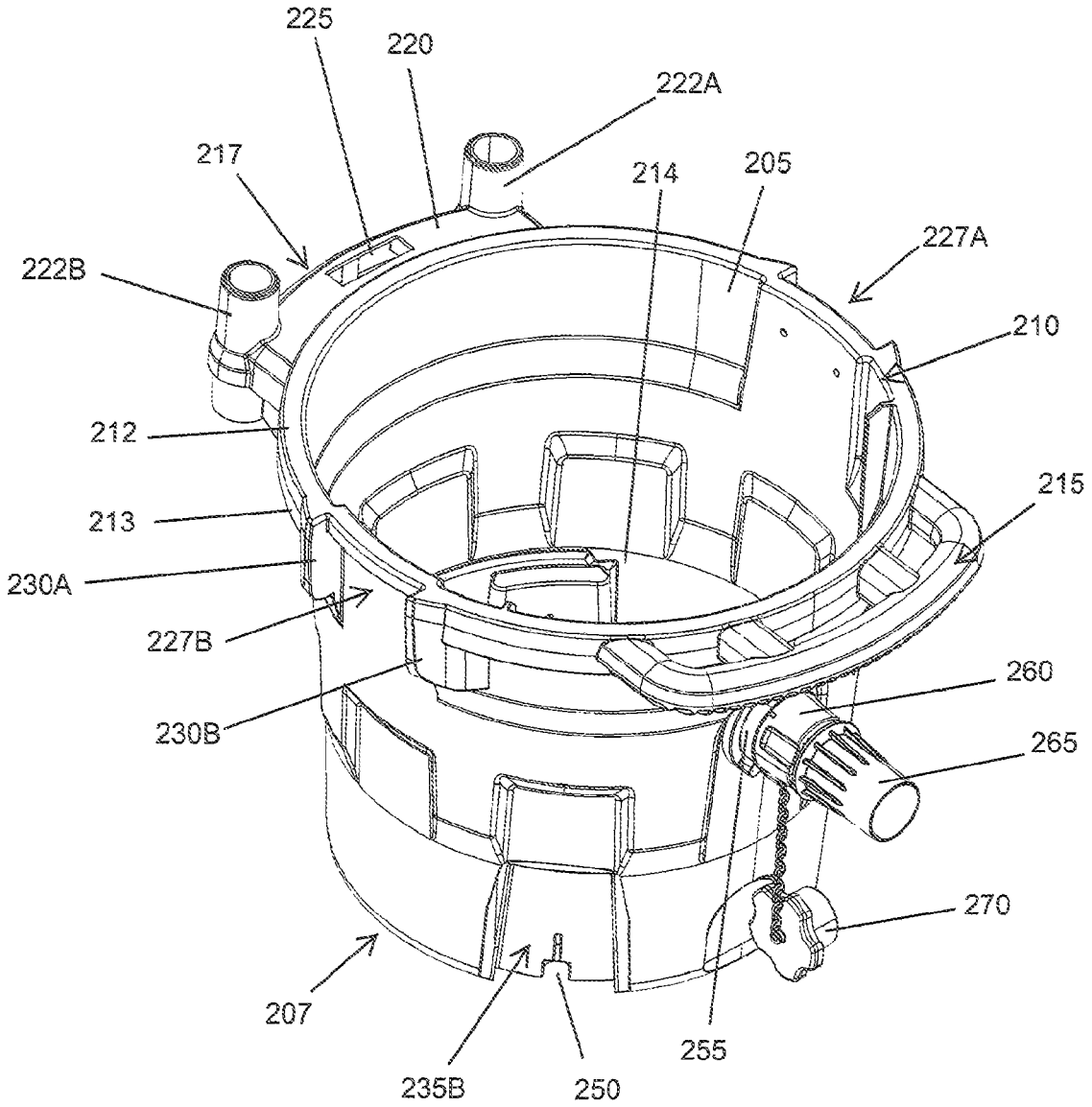
FIG. 2A illustrates a front perspective view of the tank of the vacuum device, shown in isolation.
Figure 2B:
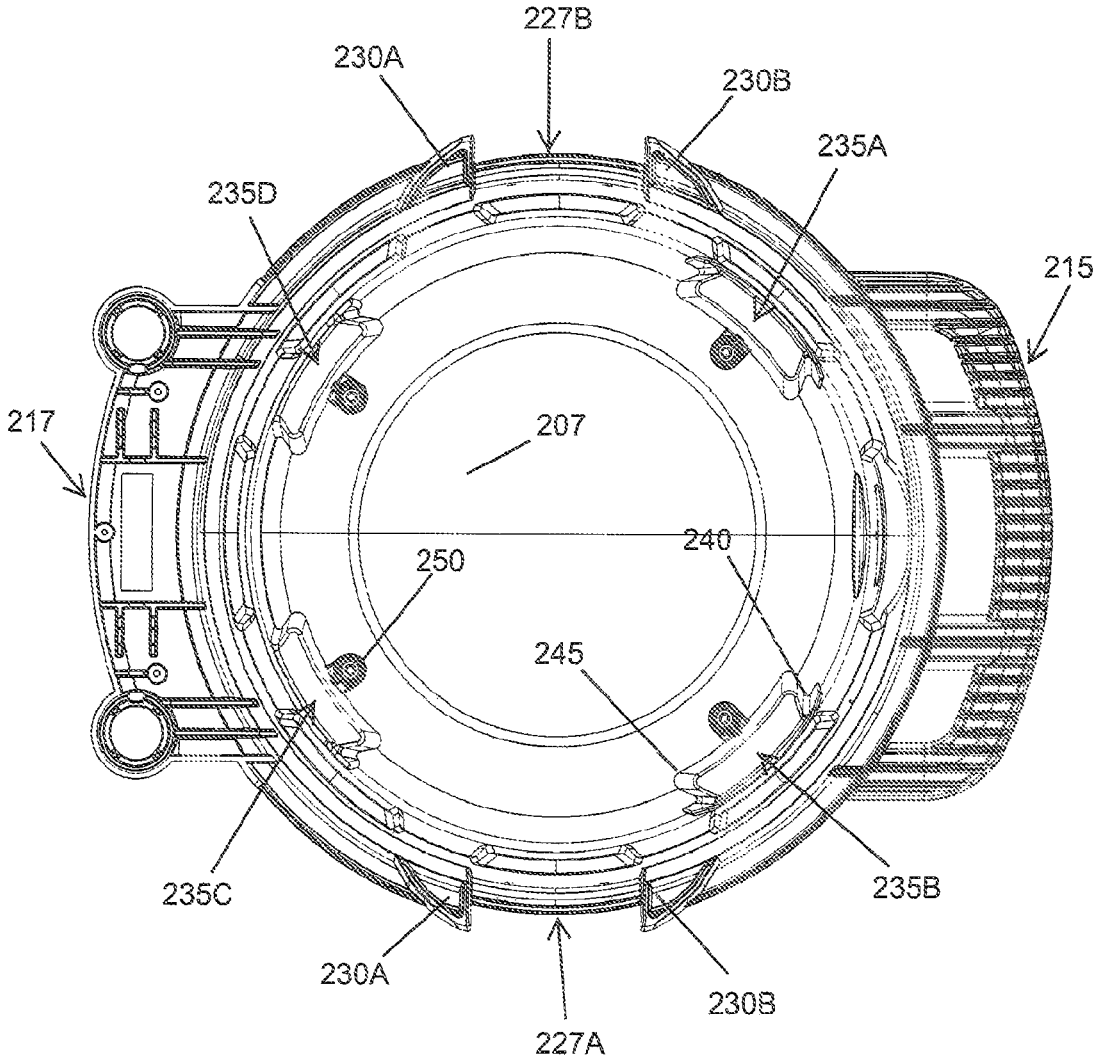
FIG. 2B illustrates a bottom plan view of the tank shown in FIG. 2A.

Referring to FIGS. 1A and 1B, a vacuum system 10 in accordance with an embodiment of the invention (e.g., a wet/dry vacuum cleaner) includes a body 100 having a tank portion 105 coupled to a head or lid portion 110 via one or more latch devices 112, as well as an optional handle assembly 115. The tank 105 may possess any dimensions and shapes suitable for its described purpose. In an embodiment, the tank 105 is generally cylindrical. In another embodiment, it may possesses a generally frustoconical shape. In the embodiment illustrated in FIGS. 2A and 2B, the tank 105 includes a curved side wall 205, a closed lower end or bottom 207 and an open upper end or mouth 210. The interior surface of the tank bottom 207 may be generally concave, possessing a slightly upward curve to, e.g., prevent the tank from sagging when filled with a predetermined amount of debris. The tank mouth 210 defines a rim 212 configured to engage a corresponding shoulder forming the separator plate 900 (FIG. 9A) inserted into the tank. The tank rim 212 is may protrude radially outward from the side wall 205, thereby forming a lip 213 about the mouth 210 of the tank 105. With this configuration, the tank 105 defines an open cavity or collection chamber 214 operable to collect and store debris drawn therein.

Figure 4A:
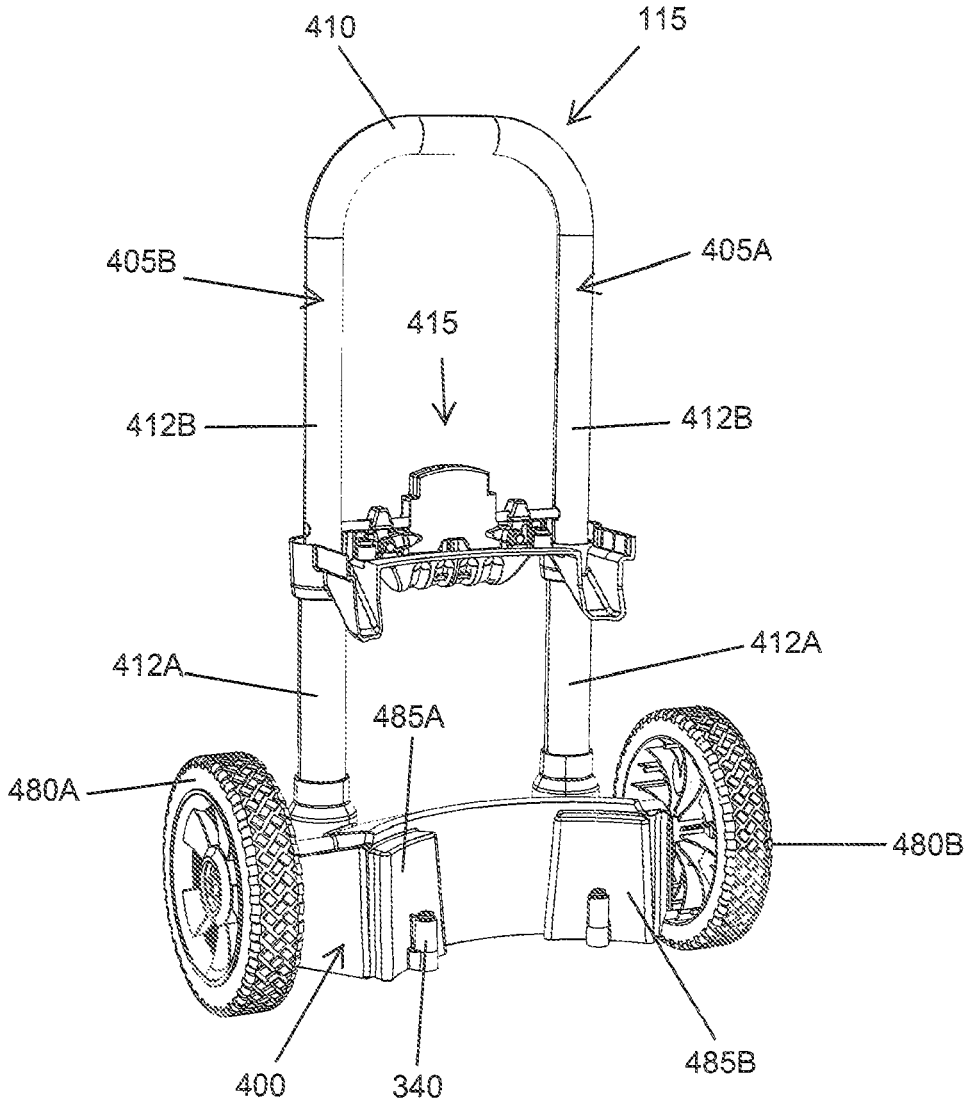
FIG. 4A illustrates a front perspective view of a handle assembly in accordance with an embodiment of the invention, shown in isolation.
Figure 4B:
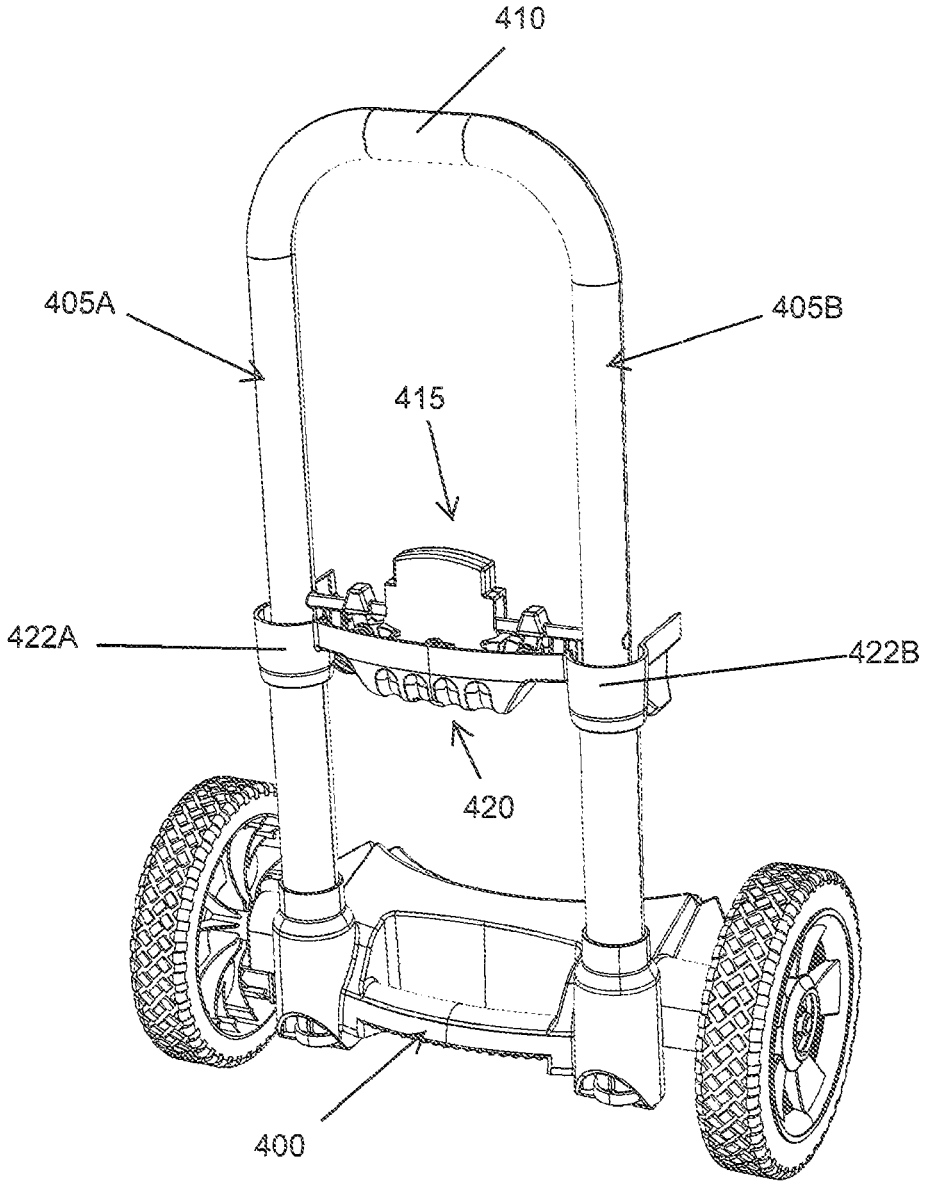
FIG. 4B illustrates a rear perspective view of the handle assembly shown in FIG. 4A.

The tank 105 further includes a forward handle 215 extending radially from the exterior surface of the side wall 205 (e.g., from the tank lip 213), and a rearward bracket 217 extending radially from the exterior surface of the side wall 205 at a location that is generally diametrically opposed from the forward handle position 215 (e.g., the bracket is oriented approximately 180° from the handle). The bracket 217, which couples the handle assembly 115 to the tank portion 105, includes an elongated housing section 220, a first sleeve 222A disposed along one side of the housing section, and a second sleeve 222B disposed along the opposite side of the housing section. Each sleeve 222A, 222B is configured to receive an arm 405A, 405B (FIG. 4A) of the handle assembly 115. The bracket housing section 220 cooperates with the housing section 420 of the handle assembly 115 to define a housing for a handle lock mechanism, with the bracket housing section 220 forming the upper portion of the lock mechanism housing, and the handle assembly housing section 420 forming the lower portion of the lock mechanism housing. The bracket housing section 220 includes an opening 225 through which the actuator 430 (FIG. 4D) of the lock mechanism protrudes (discussed in greater detail below).

The tank portion 105 further may further include one or more latch receptacles formed into the side wall 205. In an embodiment, the side wall 205 includes a first latch receptacle 227A spaced (e.g., diametrically opposed) from a second latch receptacle 227B, each being disposed proximate tank rim 212. Each latch receptacle 227A, 227B is defined by a pair of opposed, spaced projections 230A, 230B located along the circumference of the tank 105. Each projection 230A, 230B extends downward (axially) from the tank mouth 210, along the exterior surface of the side wall 205. Each latch receptacle 227A, 227B receives a corresponding latch device 112 operable to couple the tank 105 to the separator plate 900 (discussed in greater detail below).

The vacuum 10 further includes a transport assembly that enables movement of the vacuum over a surface. By way of example, the vacuum 10 may include on or more wheel assemblies that couple to the tank 105. Referring to the embodiment shown in FIG. 2B, the tank 105 includes a plurality of notches or slots 235A, 235B, 235C, 235D angularly spaced about the tank bottom 207. Each notch 235A-235D is recessed into the side wall 205, being contoured to receive a corresponding connector on a wheel assembly. Specifically, the notch 235A-235D defines a dove tail, having a narrow neck portion 240 and a widened base portion 245 contoured to mate with a similarly shaped pin on the wheel assembly (discussed in greater detail below). Each notch 235A-235D further includes a female coupling member or socket 250 (e.g., a generally cylindrical socket) adapted to receive a corresponding male coupling member disposed on the wheel assembly connector.

Figure 3A:
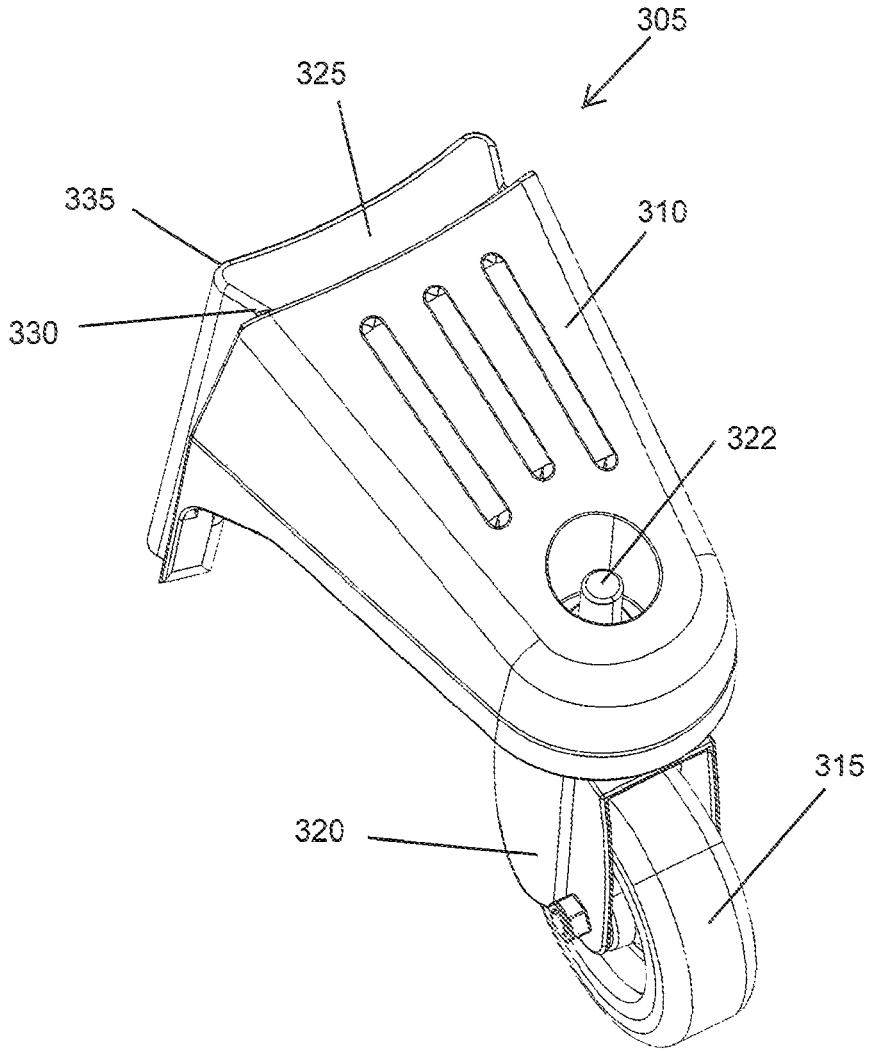
FIG. 3A illustrates a front perspective view of a wheel assembly in accordance with an embodiment of the invention, shown in isolation.
Figure 3B:
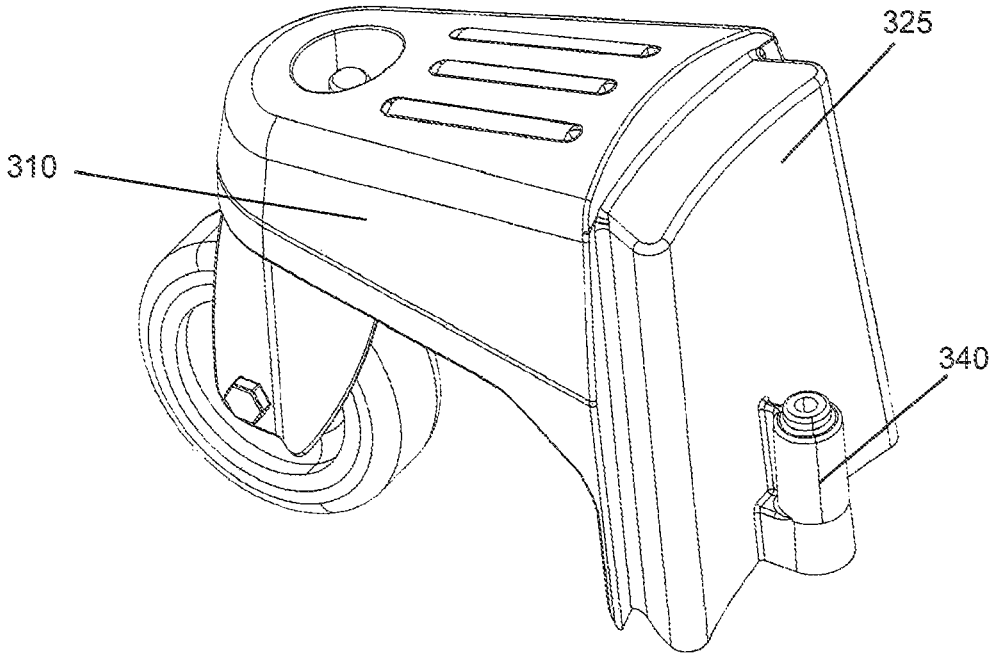
FIG. 3B illustrates a rear perspective view of the wheel assembly shown in FIG. 3A.
Figure 5:
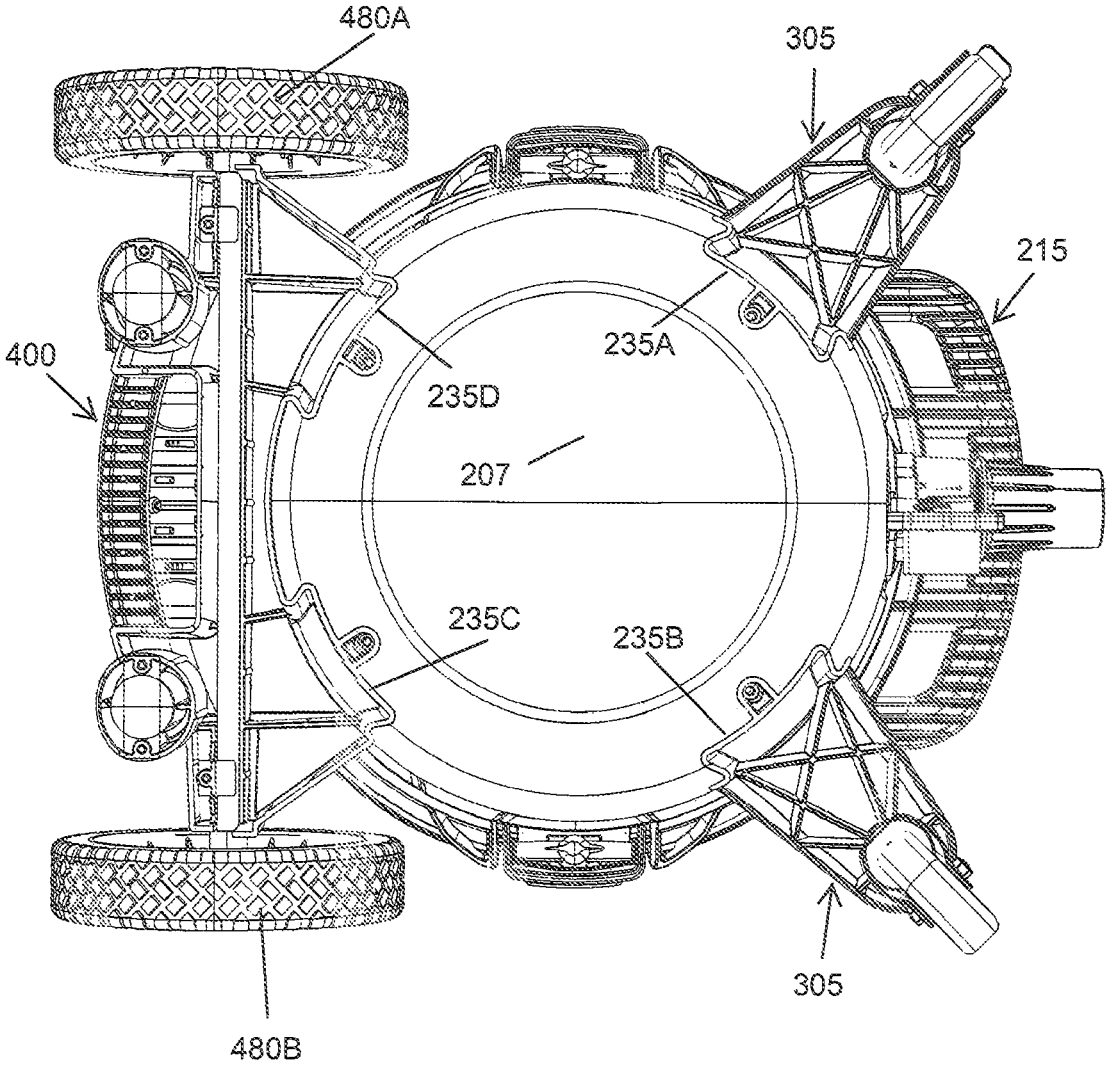
FIG. 5 illustrates a bottom plan view of the vacuum device of FIG. 1A.

Referring to FIGS. 3A-3C, the wheel assembly may be in the form of a caster 305 including a top plate or support 310 and a wheel 315 disposed along distal section of the support. The wheel 315 is rotatably mounted to a fork 320 that, in turn, is pivotally coupled to the support 310 via a central pin 322. The proximal section of the support 310 includes a connector 325 adapted to mate with one of the notches 235A-235D formed into the tank 105. In the illustrated embodiment, the connector 325 is a pin extending axially from the proximal end of the support 310. The pin is contoured, including a narrow neck portion 330 (corresponding with the neck portion 240 of the notch 235A-235D) and a widened base or end portion 335 (corresponding with the base portion 245 of the notch). A male coupling member or post 340 (e.g., a cylindrical post), extending from the end portion 335 of the connector 325, is received by the tank socket 250. The tank socket 250 may further include threaded channel operable to engage a threaded fastener that passes through the post 340, securing the caster 305 within the notch 235A-235D. Connection of the caster 305 to the tank 105 is best seen in FIG. 5.

Referring back to FIG. 2A, the tank 105 further includes an intake port 255 formed into the side wall 205 (along the forward portion of the side wall). A vacuum connector 260, secured to the exterior side of the intake port 255, couples to a hose connector 265, which, in turn, couples to a flexible tube (e.g., a hose) utilized to capture debris. An exterior cap 270, tethered to the vacuum connector 260, may be utilized to seal the port. The intake port, vacuum connector, hose connector, flexible tube, and cap may possess any shape and dimensions suitable for its intended purpose. By way of example, any of the intake port, vacuum connector, hose connector, flexible tube, and cap may be generally circular and/or cylindrical. An inlet device 600 (FIG. 6A) may be secured to the interior side of the intake port 255 (discussed in greater detail below).

Referring to FIGS. 4A-4G, the handle assembly 115 includes a base member 400, a first upright arm 405A extending upward from the base, a second upright arm 405B laterally spaced from the first upright arm 405B, and a gripping member 410 connecting the first arm to the second arm. The first 405A and second 405B arms, as well as the handle 410, may possess any shape and dimensions, and may be formed of any materials suitable for their described purpose. By way of example, the handle arms 405A, 405B and the gripping member 410 may be generally tubular and/or cylindrical. By way of further example, the handle arms 405A, 405B and gripping member 410 may be formed of steel tubing. In other embodiments, plastic may completely form, or may form portions of, the handle assembly.

Each handle arm 405A, 405B includes a lower or proximal portion 412A secured to the base member 400 and an upper or distal portion 412B telescopically coupled to the proximal arm portion such that the distal arm portion nests within the proximal arm portion. With this configuration, the height of the gripping member 410 may be adjusted with respect to the base member 400. Specifically, the handle assembly 115 may reconfigured from a first, collapsed position (as shown in the figures) to a second, extended position (not illustrated). The gripping member 410 is secured at a desired vertical or telescopic position via an arm lock mechanism 415 that cooperates with a plurality of apertures longitudinally (vertically) spaced along the arms 405A, 405B. By way of example, the distal portions 412B of the arms 405A, 405B may include a first set of arm apertures 417A disposed proximate the longitudinal center of the arm proximal portion 412B, as well as a second set of arm apertures 417B disposed proximate the lower end of the arm proximal portion 412B (seen best in FIG. 4B).

Figure 4C:
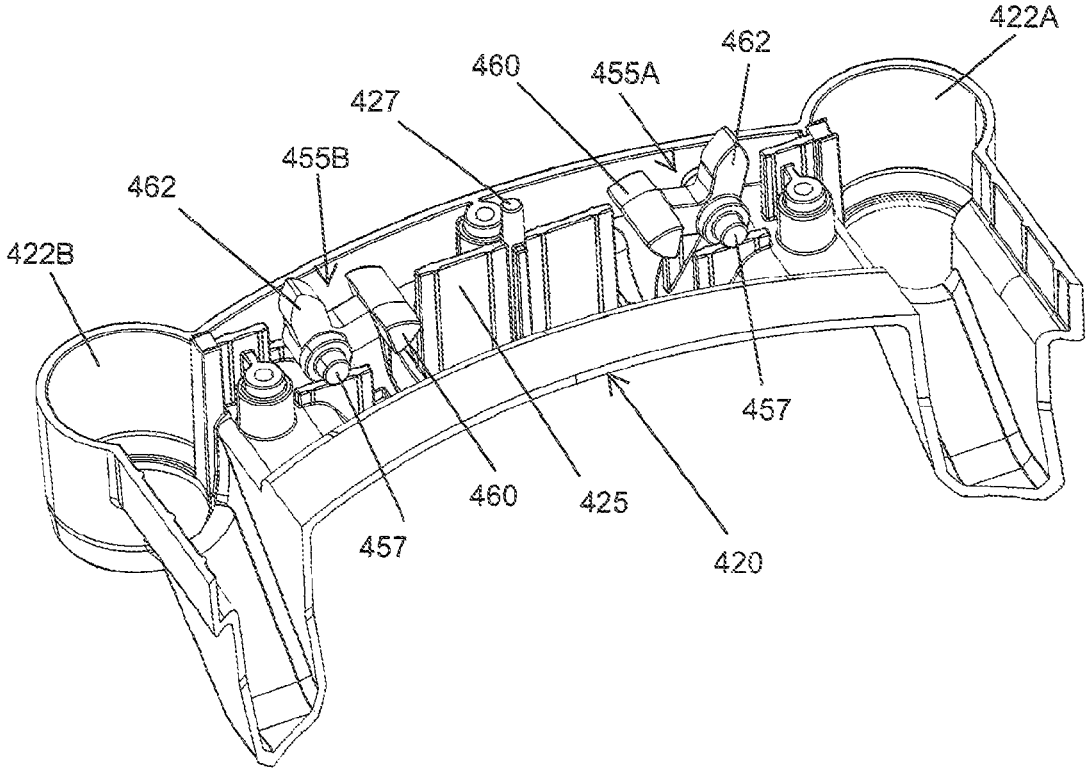
FIG. 4C illustrates a handle lock mechanism of the handle assembly, showing selected components disposed within a housing. A portion of which is remove for clarity.

As explained above, the handle assembly housing section 420 cooperates with the bracket housing section 220 to form a lock mechanism housing that houses the lock mechanism 415. Referring to FIG. 4C, the handle assembly housing section 420 includes a first sleeve 422A and a second sleeve 422B laterally spaced from the first sleeve. The first sleeve 422A of the handle assembly housing section 420 is configured to align with the first sleeve 222A of the bracket housing section 220. Similarly, the second sleeve 422B of the handle assembly housing section 420 aligns with the second sleeve 222B of the bracket housing section 220.

The handle assembly housing section 420 further includes a guide block 425 centrally disposed within the housing section. The guide block 425 is a generally planar element extending distally from the lower surface of the housing section interior. A post 427 extends distally (upward) from the distal end of the guide block 425. The post 427 couples to a biasing member 475 such as a spring that biases the actuator 430 in its normal position (discussed in greater detail below). The outer surface of the handle assembly housing section 420 may be contoured with features such as finger indentations to aid in the gripping of the housing during operation of the lock mechanism.

Figure 4D:
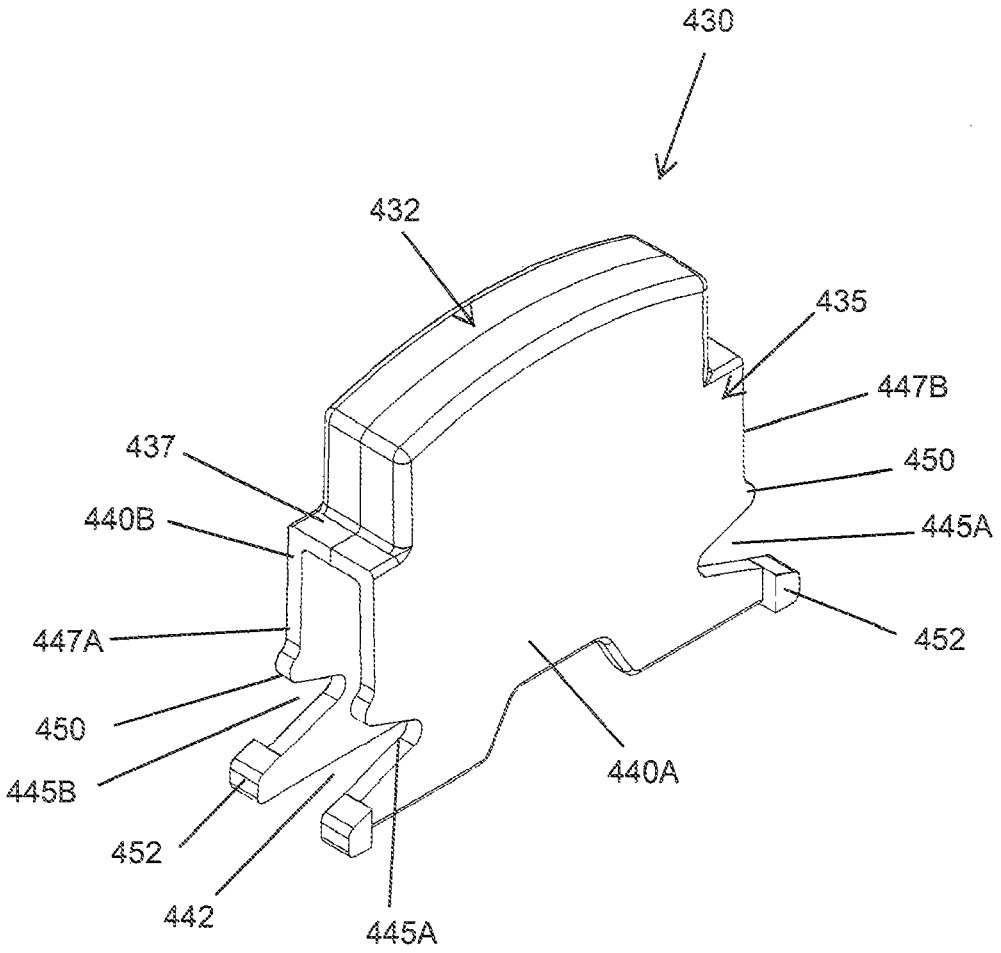
FIG. 4D illustrates an isolated view of the actuator of the handle assembly lock mechanism in accordance with an embodiment of the invention.
Figure 4E:
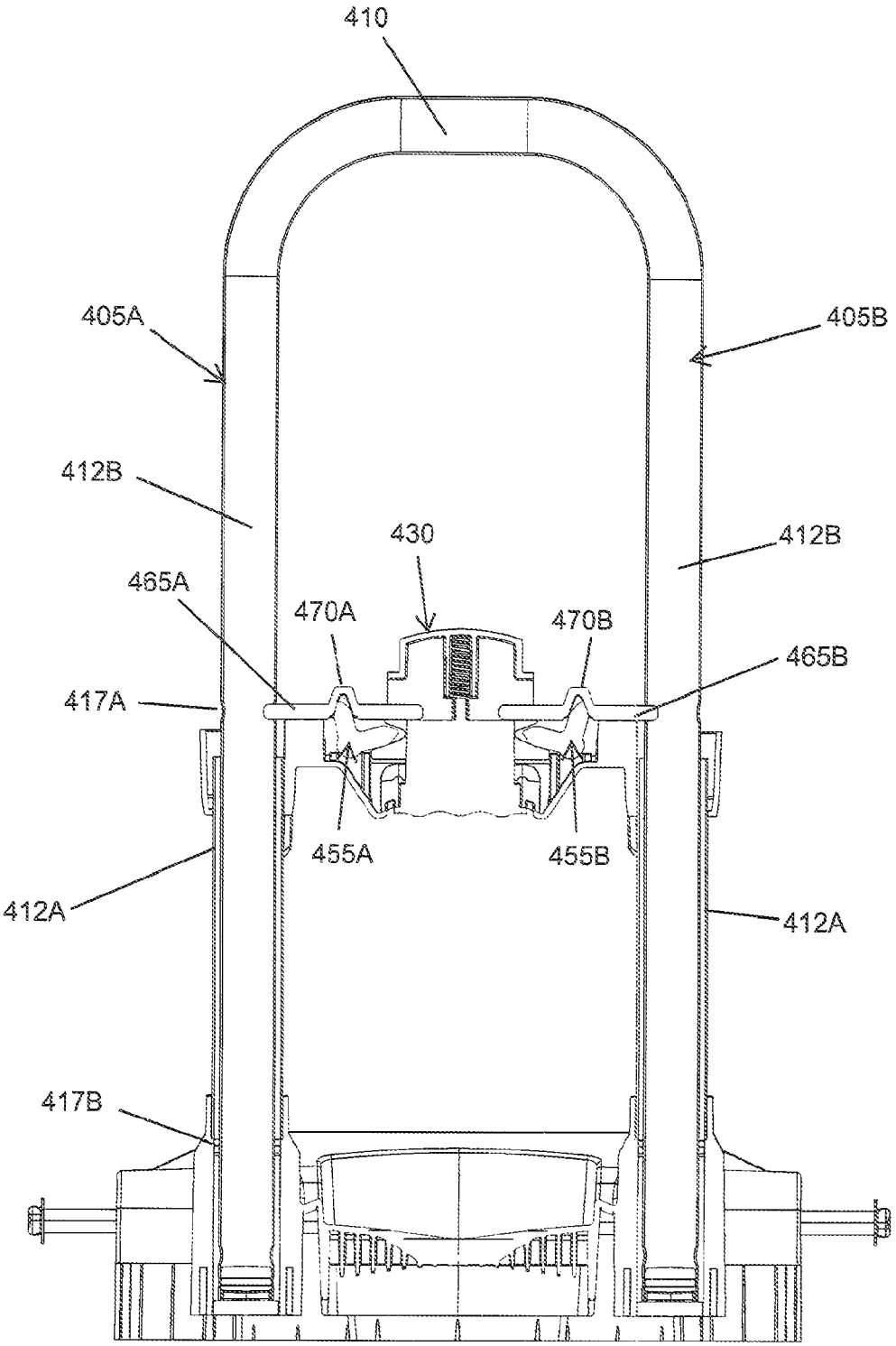
FIG. 4E illustrates a rear, cross-sectional view of the handle assembly, with the wheels removed for clarity.

Referring to the embodiment illustrated in FIG. 4D, the actuator 430 possesses a generally U-shaped configuration defined by an engagement portion 432 and a carriage portion 435. The transverse dimension of the engagement portion 432 may be less than the transverse dimension of the carriage portion 435. That is, the carriage portion 435 may be wider than the engagement portion 432 to form a shoulder or stop 437. With this configuration, the actuator 430 is trapped within the bracket housing section 220, and the extension of the actuator through the opening 225 is limited by contact between the shoulder 437 and the housing section 420. That is, only the engagement portion 432 extends through the opening 225 since the shoulder 437 serves as a stop, preventing the extension of the actuator from the opening 225 beyond the shoulder.

The carriage portion 435 includes a first or forward wall 440A and a second or rearward wall 440B that cooperate to define a cavity 442 therebetween. The cavity 442 receives the guide block 425 to permit the axial repositioning of the actuator 430 along the guide block 425. The walls 440A, 440B of the carriage portion 435 each includes aligned, tapered (e.g., V-shaped) slots 445A, 445B disposed along each lateral side 447A, 447B of the carriage portion 435. The slots 445 are defined by an upper projection 450 protruding slightly from the lateral side 447A, 447B of the engagement portion 432, and a lower finger 452 extending angularly from the lateral side at a distance greater than that of the projection 450.

Referring to FIG. 4C, the lock mechanism 415 further includes a first lever 455A and a second lever 455B operable to rotate within the lock mechanism housing. The levers 455A, 455B are generally L-shaped, including a hub 457, a first or horizontal arm 460, and a second or vertical arm 462 oriented generally orthogonal to the first arm. The hub 457 defines a central pivot point P about which each lever 455A, 455B pivots. The first arm 460 of each lever 455A, 455B is contoured to mate with the slots 445 of the actuator 430. By way of example, the distal end of the first arm 460 may be enlarged such that spans the opening between forward 440A and rearward walls 440B, extending from the slot 445A formed into the forward wall 440A to the slot 445B formed into the rearward wall 440B. With this configuration, the movement of the actuator 430 (i.e., the axial/vertical movement of the carriage portion 435 along the guide block 425) causes a corresponding rotation of each lever 455A, 455B about its pivot point P.

The second arm 462 of the first 455A and second 455B levers are configured to drive locking pins that engage the arms of the handle assembly 115. Specifically, the first lever 455A is in communication with a first locking pin 465A and the second lever 455B is in communication with a second locking pin 465B. The first locking pin 465A extends from the first lateral side 447A of the actuator carriage portion 435 to the first arm 405A. Similarly, the second locking pin 465B extends from the second lateral side 447B of the actuator carriage portion 435 to the second arm 405B. The distal (arm facing) portion of each pin 465A, 465B engages the arm apertures 417A, 417B formed into the arm 405A, 405B as discussed above.

Each locking pin 465A, 465B is retractable, being configured to translate (move without rotation) along its longitudinal axis. Specifically, each locking pin 465A, 465B moves from a first, retracted position, in which it is drawn toward the actuator 430, to a second, extended position, in which the locking pin is driven outward from the actuator and the distal portion of the pin engages the aperture of 417A, 417B its associated arm 405A, 405B. As noted above, the second arm 460 of each lever 455A, 455B is in communication with the locking pins 465A, 465B. Specifically, each locking pin 465A, 465B includes a socket 470A, 470B disposed at an intermediate pin location. The distal portion of each second lever arm 462 is received within a socket 470A, 470B, linking the lever 455A, 455B to the locking pin 465A, 465B. Consequently, rotation of the lever 455A, 455B drives the movement of its associated locking 465A, 465B from the first pin position to the second pin position, and vice versa.

Figure 4F:
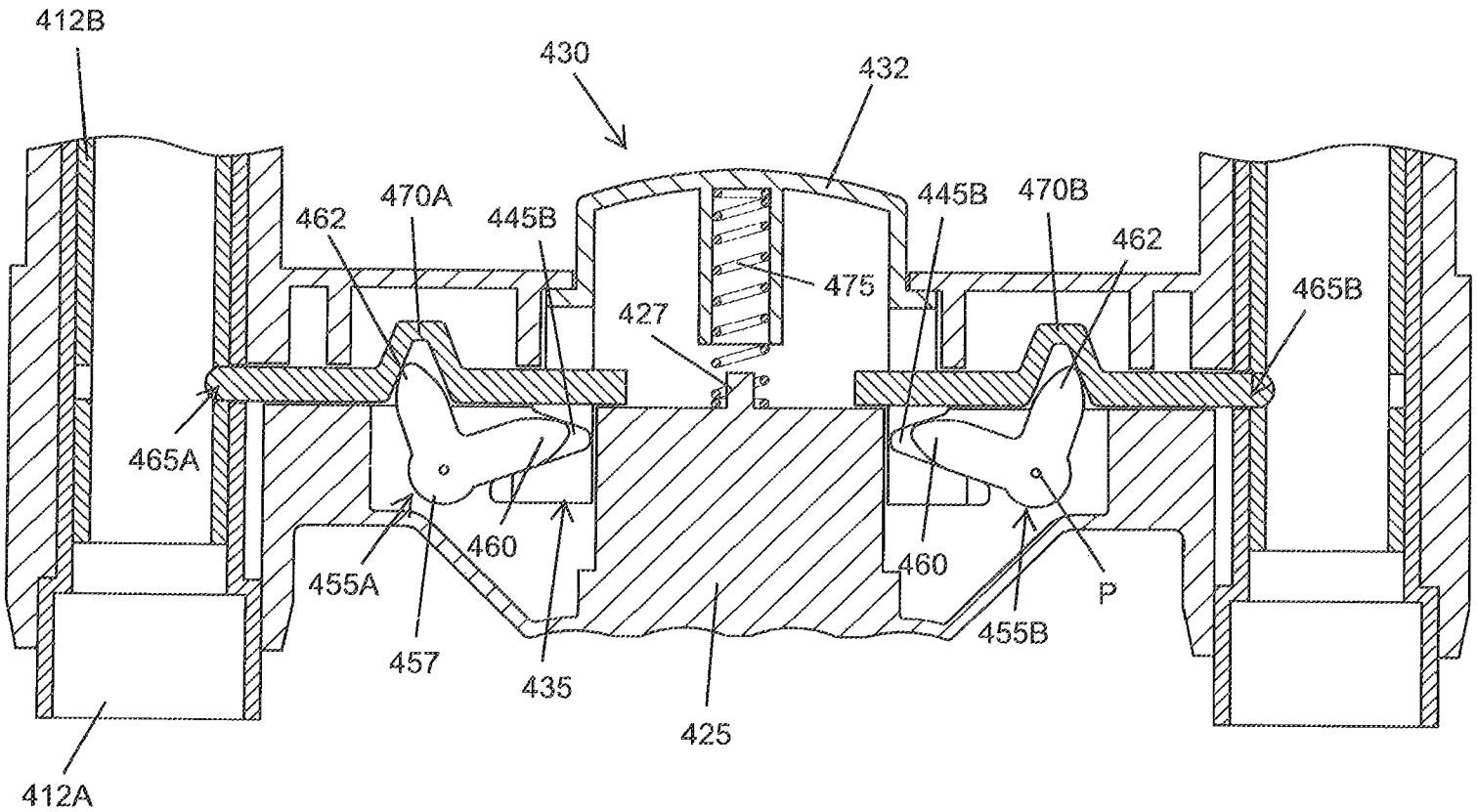
FIGS. 4F and 4G illustrate cross sectional views of the handle assembly lock mechanism, showing operation of the lock mechanism.
Figure 4G:
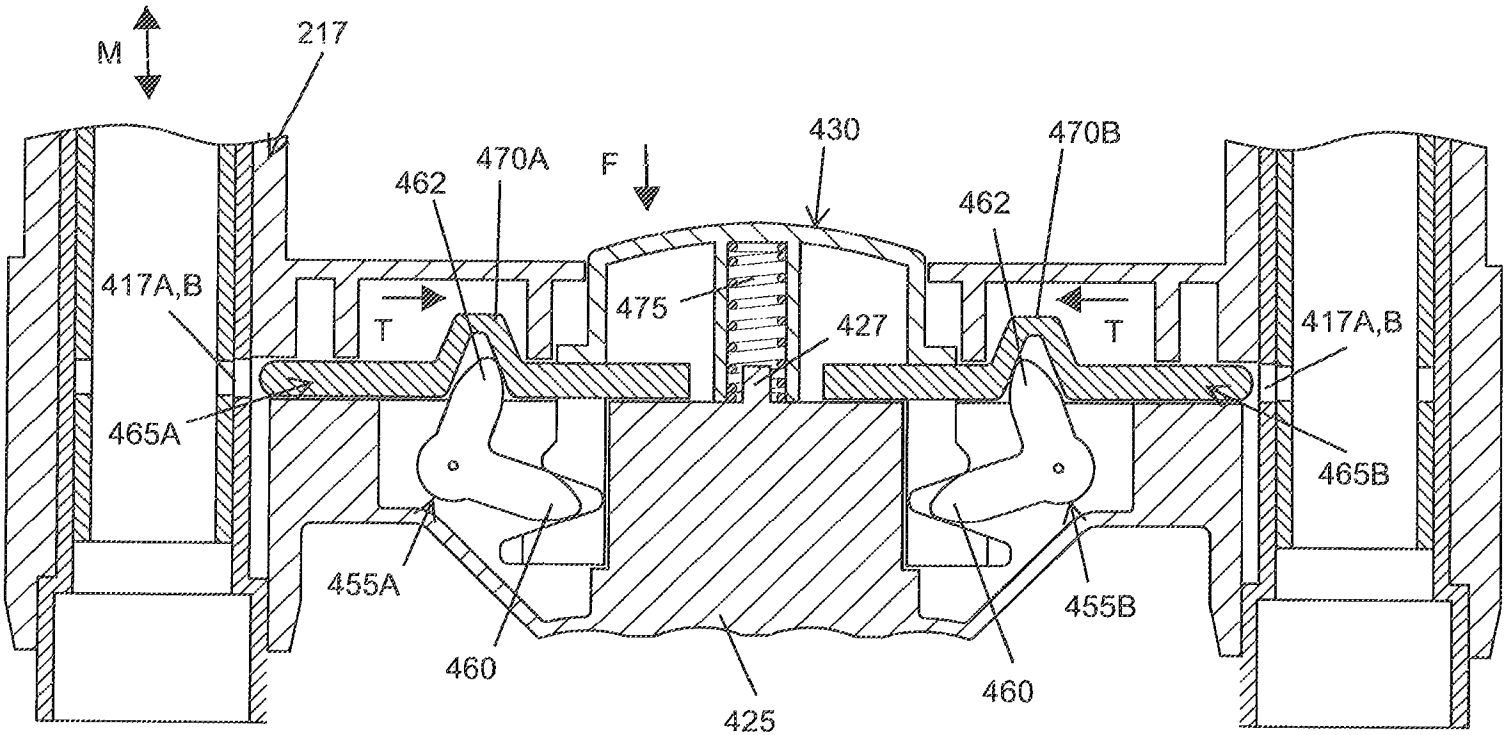

The operation of the lock mechanism 415 is explained with reference to FIGS. 4F and 4G. The actuator 430 is spring biased in its normal (e.g. upward) position by a biasing member 475 (e.g., a spring). In this normal position, the locking pins 465A, 465B are oriented in their extended position, in which the distal end of each pin extends through the aperture 417A, 417B formed into the arm distal portion 412B. In this configuration, movement of the distal arm portion 412B with respect to the proximal arm portion 412A is prevented, locking the handle 410 at a first vertical height. The actuator 430 is engaged by pressing the engagement portion 432 downward (indicated by arrow F) to overcome the biasing force of the biasing member 475. As a result, the carriage portion 435 is driven axially downward, sliding along the guide member 425. In turn, the first arms 460, captured within the carriage slots 445A, 445B, are driven downward, rotating the levers 455A, 455B about their pivot points P. From the viewpoint of FIGS. 4F and 4G, when the actuator 430 is urged downward, the first lever 455A rotates clockwise, while the second lever 455B rotates counterclockwise.

This rotation further causes second arms 462 to rotate inward (toward the actuator 430), thereby driving the locking pins 465A, 465B inward, from the extended pin position to the retracted pin position (indicated by arrow T). That is, the distal portion of each locking pin 465A, 465B disengages the aperture 417A, 417B of its corresponding arm 405A, 405B. In the disengaged position, the distal arm portion 412B is free to telescope into and out of the proximal arm portion 412A, and the height of the handle 410 with respect to the base 400 (indicated by arrow M) may be adjusted. By way of example, the distal arm portion 412B may telescope outward from a first arm position, in which the locking pins 465A, 465B are aligned with the first arm apertures 417A, to a second arm position, in which the locking pins are aligned with the second arm apertures 417B. Releasing the engagement portion 432 permits the biasing member 475 to return the actuator 430 to its normal position, driving the carriage portion 435 upward and rotating the levers 455A, 455B in an opposite direction. This rotation of the levers 455A, 455B moves the locking pins 465A, 465B from the retracted pin position to the extended pin position, driving the locking pins outward locking the handle 410 at a second vertical height.

Referring back to FIG. 4A, the base member 400 may further include wheels 480A, 480B (e.g., dolly wheels mounted on a common axle) and connectors 485A, 485B adapted to mate with notches 235C, 235D formed into the tank 105, as shown in FIG. 5.

Figure 6A:
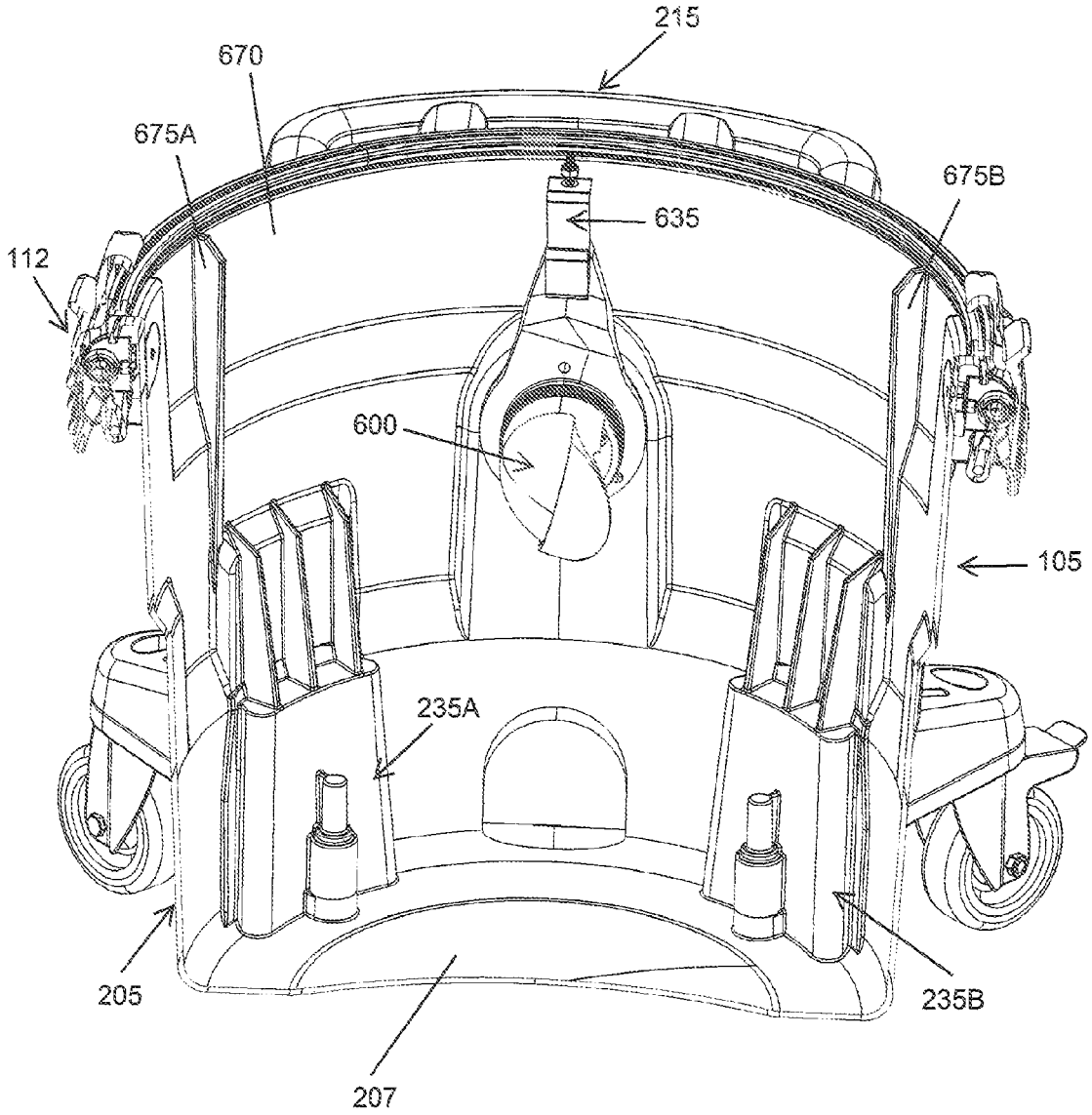
FIG. 6A illustrates an interior view of the tank, showing an inlet device in accordance with an embodiment of the present invention.
Figure 6B:
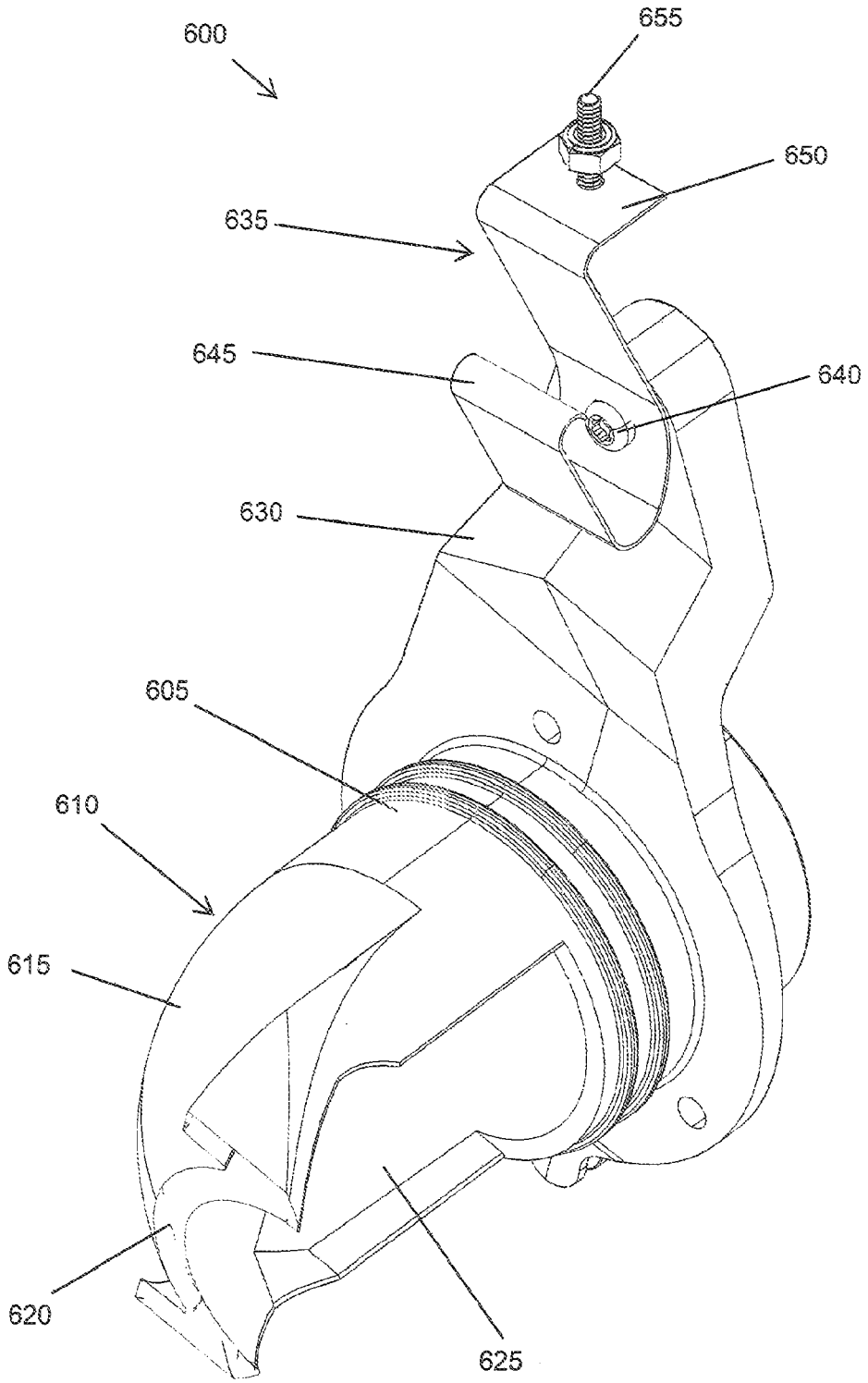
FIG. 6B illustrates an isolated view of the inlet device shown in FIG. 6A.

As mentioned above, the tank 105 further includes an inlet device adapted to direct the flow of air and debris entering the collection chamber. Referring to FIGS. 6A-6C, the inlet device 600 includes a stem portion 605 coupled to the intake port 255 and a baffle portion 610 including a closed distal end 615 with a curved fin 620 and a window 625 formed into the side wall of the baffle. The stem portion 605 may be generally cylindrical, extending radially inward from the side wall 205 inner surface. The baffle portion 610 is configured to deflect incoming air and debris as it travels through the conduit. By way of example, the baffle 610, via the fin 620, alters the travel path of contaminated fluid (air/water with debris) approximately 90° such that the fluid is directed radially outward, toward the side wall 205 of the tank 105.

The inlet device 600 further includes an electrostatic charge system operable to connect the inlet device to the ground of the main power supply. Contaminated fluid (e.g., debris-laden air) moving through the hose, the hose connector, the vacuum connector, and/or the inlet device often produces a build-up of electrostatic discharge in the vacuum system 10. This poses of risk of electrical shock to the user. Consequently, the vacuum system 10 may further include an electrostatic discharge device that connects the electrical ground of the vacuum to the hose system. The electrostatic discharge device includes a support or extension 630 coupled to a conductive member 635 (e.g., a flat copper spring) having a proximal portion 645 and a distal portion 650. A first metal fastener 640 connects the conductive member 635 to the support 630.

Figure 9A:
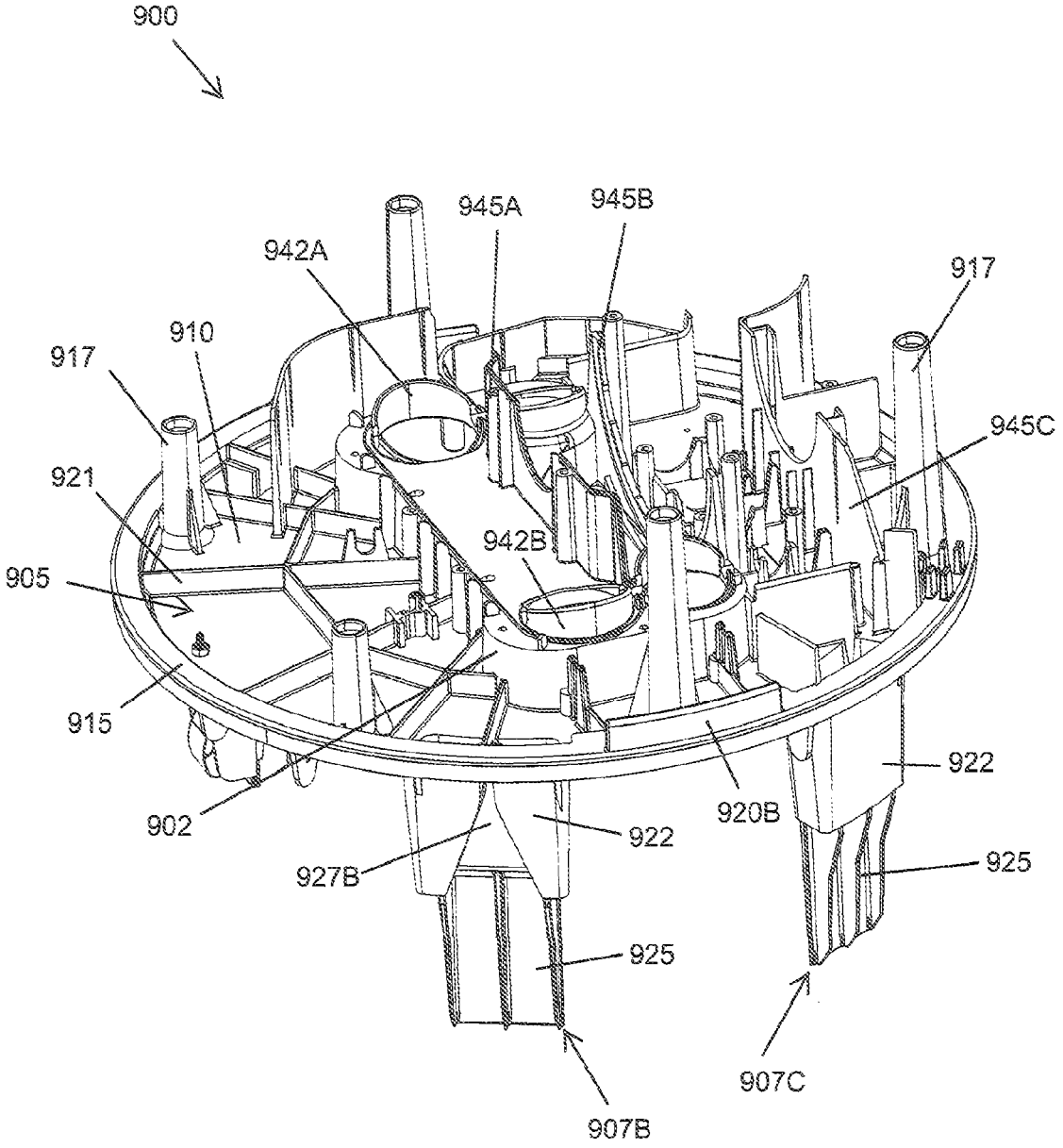
FIG. 9A illustrates an isolated view of a separator plate in accordance with an embodiment of the invention.
Figure 9B:
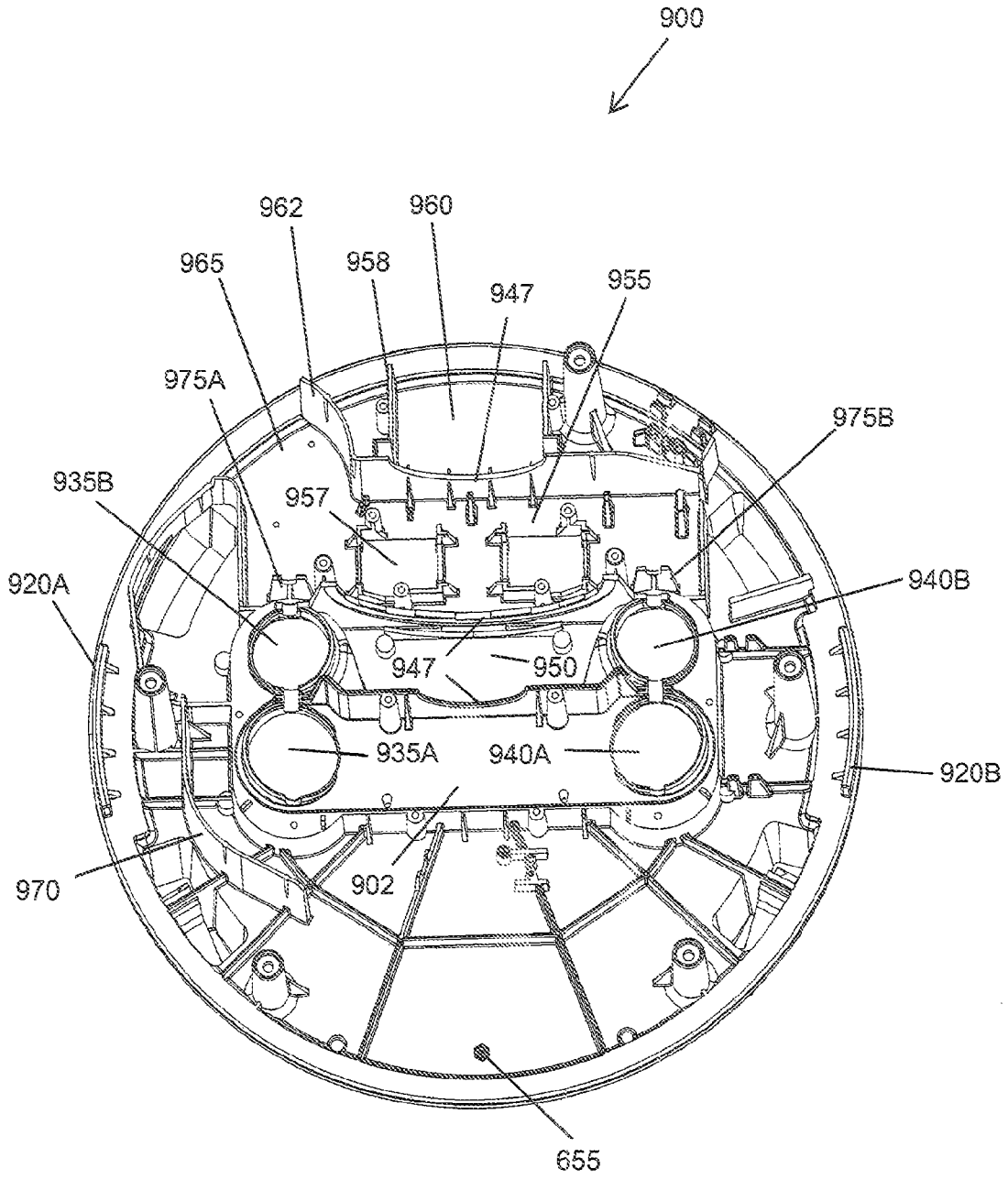
FIG. 9B illustrates a top perspective view of the separator plate shown in FIG. 9A.
Figure 9C:
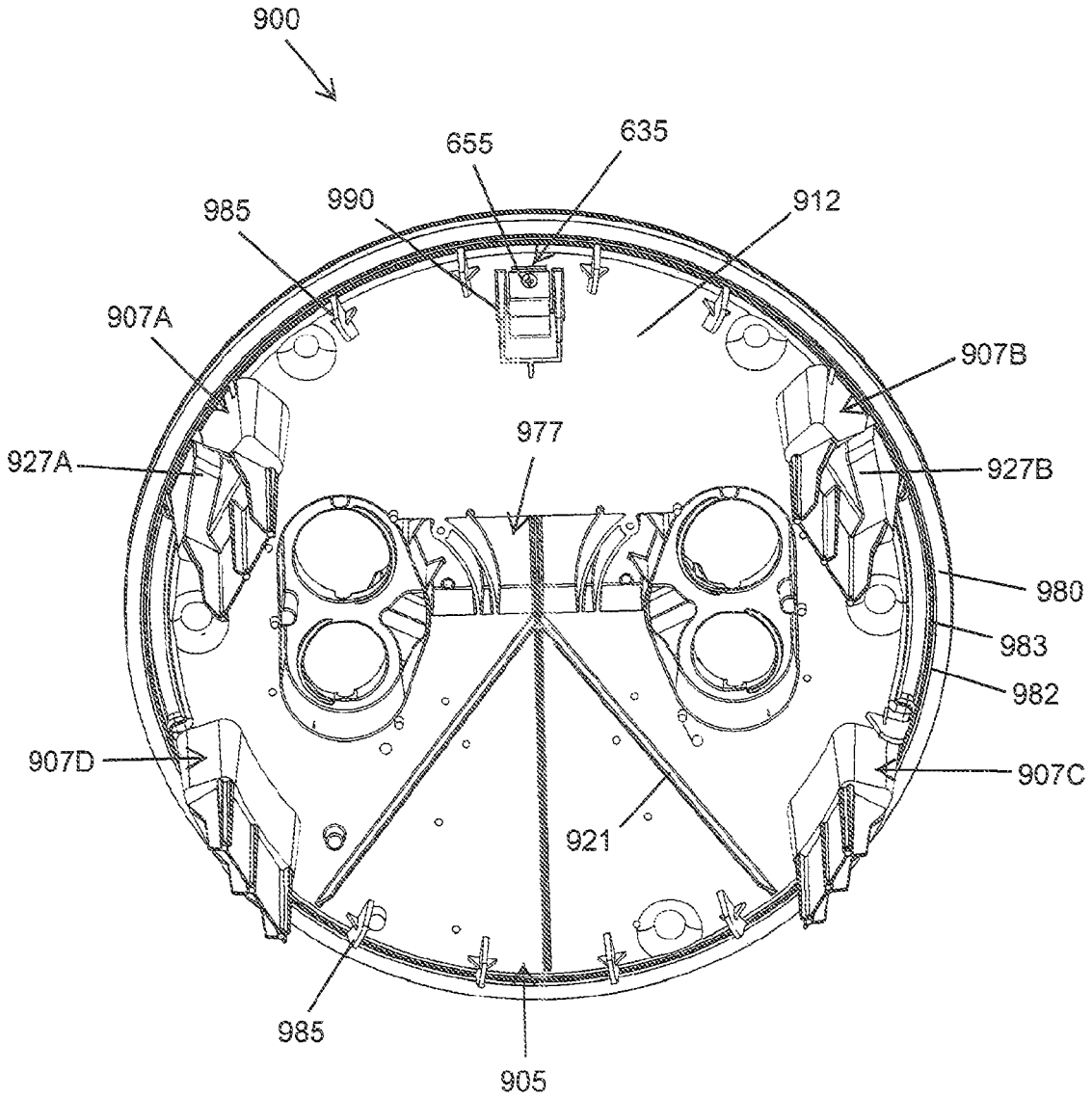
FIG. 9C illustrates a bottom perspective view of the separator plate shown in FIG. 9A.

A second metal fastener 655, moreover, connects the distal portion 650 of the conductive member 635 to the separator plate 900, with the conductive member being disposed within a protrusion 990 extending downward from the separator plate (FIG. 9C). The inlet device 600, moreover, may be formed of an electrically conductive material (e.g., electrically conductive plastic). With this configuration, the static discharge system creates an electrically conductive path that allows static charge from the hose, the hose connector, etc., to travel through the intake device, along the extension, up through the conductive member and to the main electrical ground.

The interior of the tank 105 may further be keyed such that the separator plate 900 (discussed below) couples to the tank in a single rotational orientation. Referring specifically to FIG. 6A, the interior surface 670 of the tank side wall 205 includes a first guide rib or element 675A and a second guide rib or element 675B. The guide elements 675A, 675B, which extend radially inward from the side wall interior surface 670, are disposed at predetermined angular positions along the side wall 205 such that the guide elements align with slots formed into the forward legs 907A, 970B of the separator plate 900 (FIG. 9C). As such, the separator plate 900 may be inserted into the tank cavity in a predetermined orientation, with platform of the being disposed in a particular rotational position with respect to the collection chamber (i.e., one in which the slot formed into each of the two forward legs of the separator plate align with a corresponding guide element 675A, 675B, discussed in greater detail below).

Figure 7A:
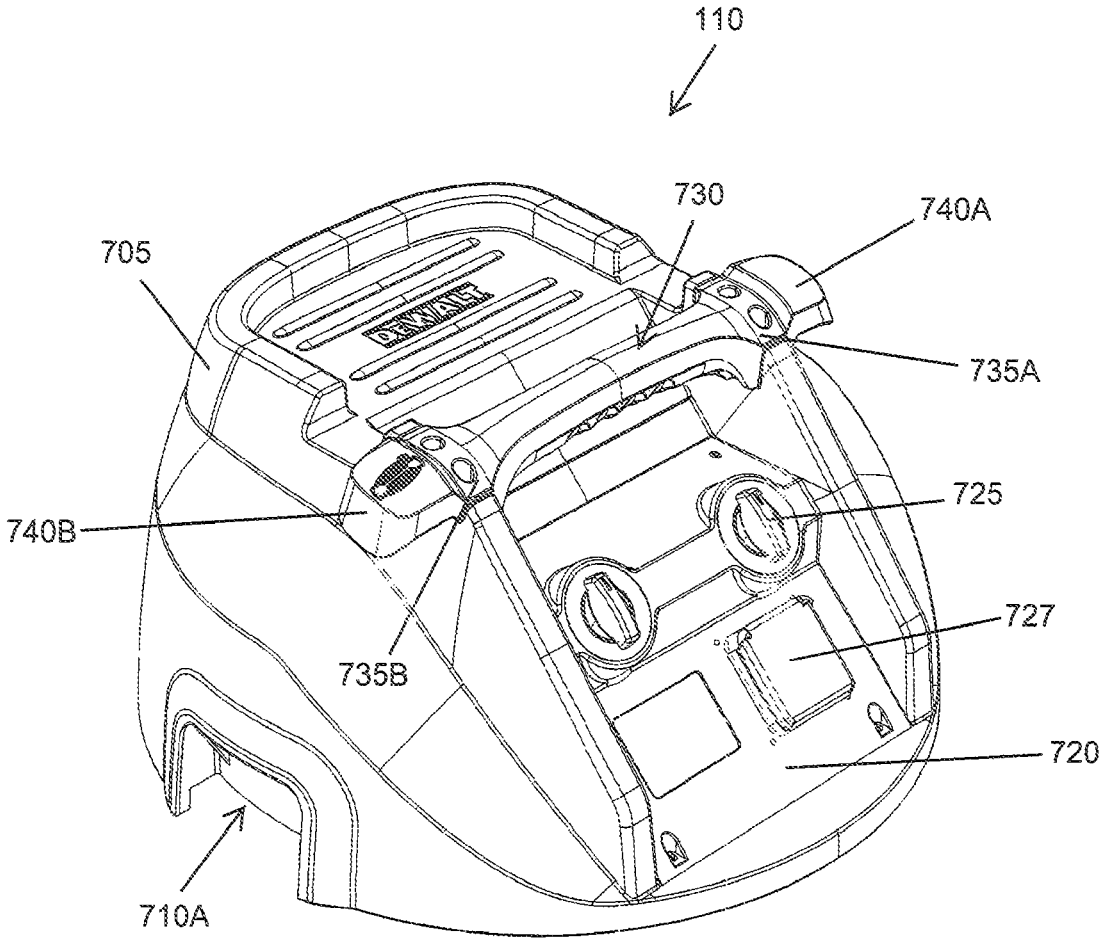
FIG. 7A illustrates a front perspective view of the vacuum head in accordance with an embodiment of the invention.
Figure 7B:
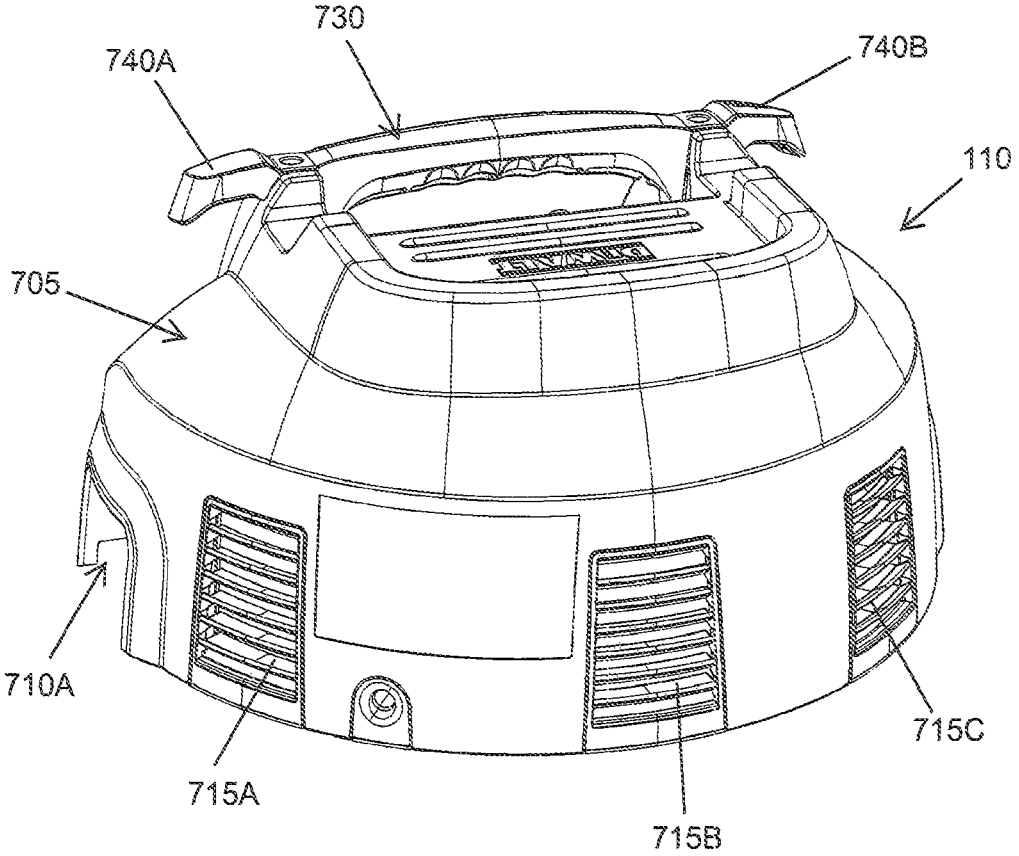
FIG. 7B illustrates a rear perspective view of the vacuum head shown in FIG. 7A.
Figure 7C:
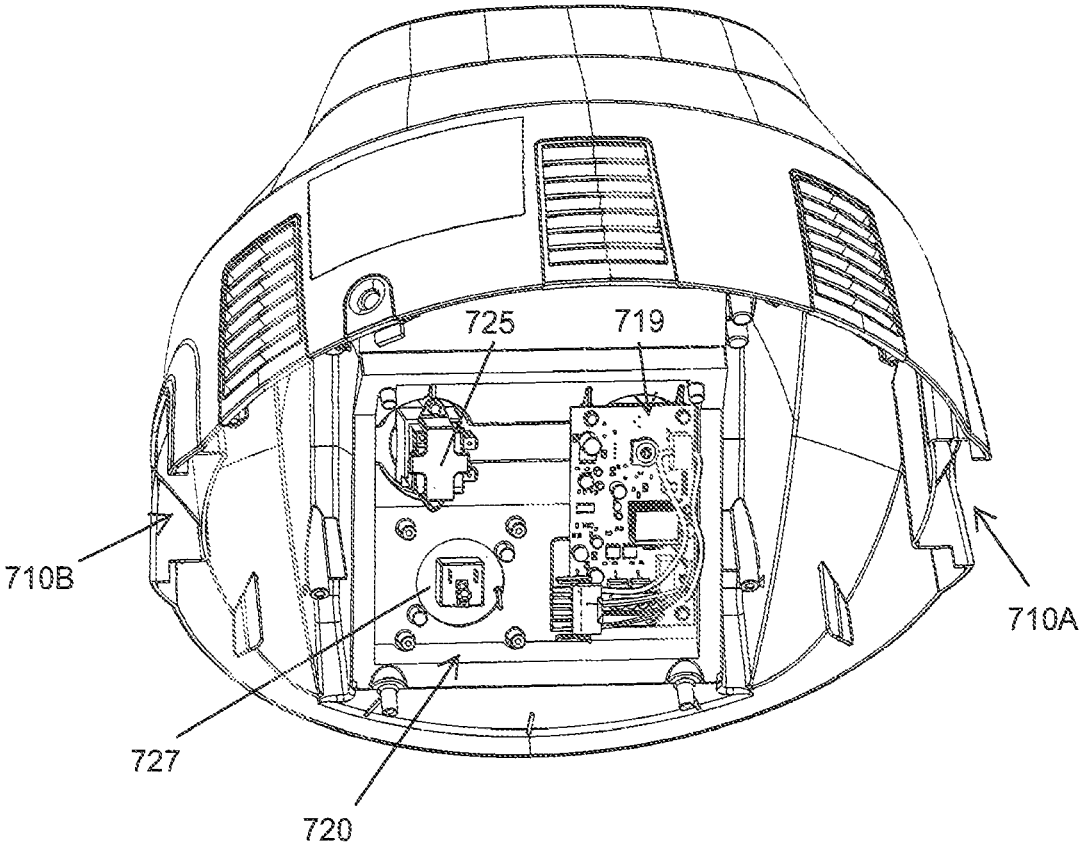
FIGS. 7C and 7D illustrate bottom perspective views of the vacuum head shown in FIG. 7A.
Figure 7D:
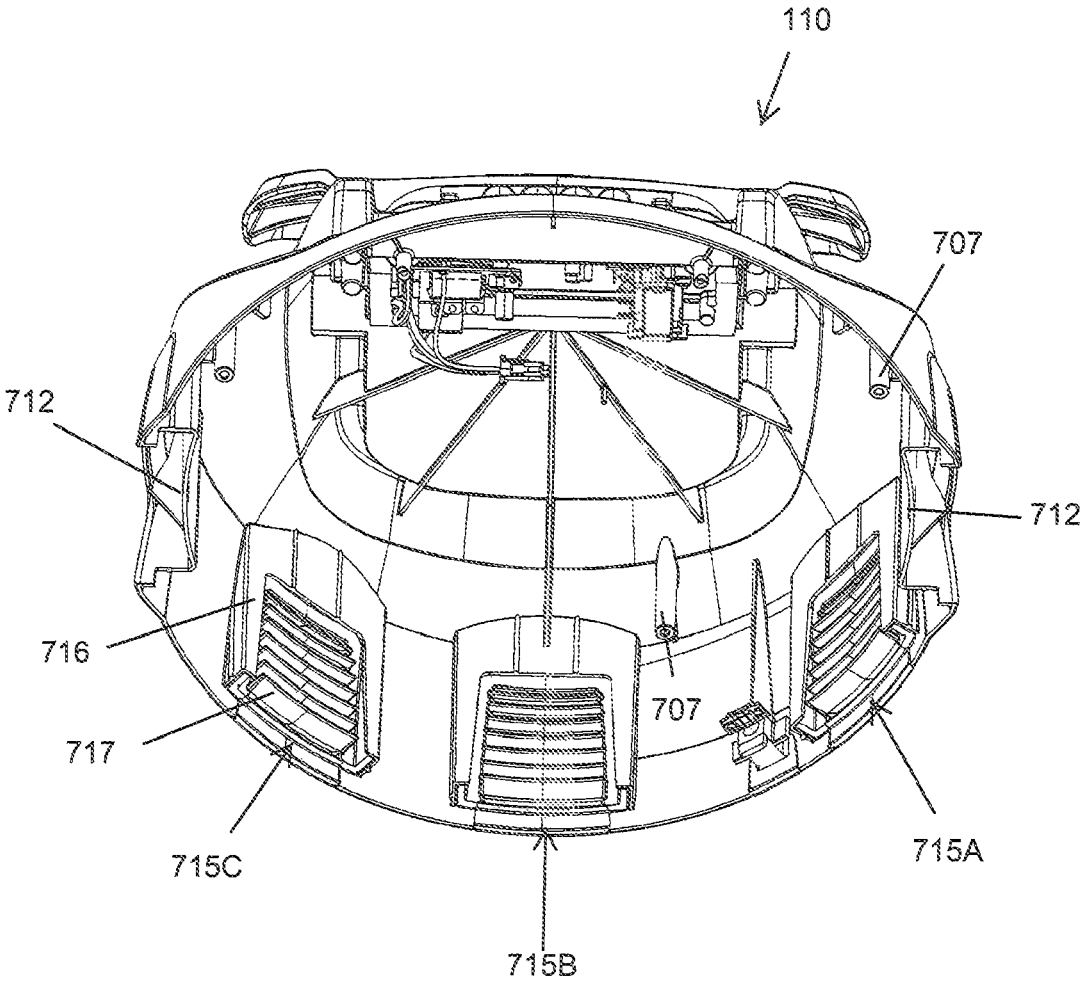

Referring to FIGS. 7A and 7B, the vacuum head 110 includes a shell 705 including axial connection posts 707 disposed at predetermined locations along head interior surface. Each head post 707 aligns with a corresponding post 917 disposed on the separator plate 900 (FIG. 9A). The distal end of plate post 917 may include a receptacle that receives the distal end of the head post 707. A fastener may pass through the posts 707, 917 to secure the vacuum head 110 to the separator plate 900. The vacuum head 110 further includes a pair of opposed handle openings or cut-outs 710A, 710B formed into the shell 705. Each handle cut-out 710A, 710B, defined by a downward-extending wall 712, defines a cavity within the vacuum head 110 that receives the hook portion of the latch device 112, as well as exposes a portion of the separator plate such that it may be engaged by the hook portion (explained in greater detail below). When coupled to the tank, each cut-out 710A, 710B generally aligns with an associated latch receptacle 227A, 227B.

The vacuum head 110 may further include one or more vents disposed at predetermined locations along the shell. In the illustrated embodiment, the vacuum head 110 includes a first or vacuum discharge vent 715A (aligned with the vacuum exhaust), a second or motor intake vent 715B (aligned with the motor air intake), and a third or motor discharge vent 715C (aligned with the motor exhaust). Each vent 715A, 715B, 715C is in fluid communication with a corresponding system to permit the flow of air into and/or out of the vacuum head 110. Each vent 710A-710C includes an open chute 716 formed into the shell 705 that receives a corresponding louver assembly 717. By way of example, each louver assembly 717 may slide axially into and out of the open chute 716. The louvers 717 may be configured to direct air any desired direction.

The head 110 further houses the electrical and electronic components of the vacuum system 10; consequently, it includes a control panel or dashboard 720 and one or more actuators 725 (e.g., a control knob) operable to control the operational parameters of the device, including, but not limited to, power (ON/OFF) and the fan speed of the motor. The dashboard may further include an outlet 727 to which a power cord may be connected. The electrical components may be controlled via a circuit board 729 mounted to the interior surface of the dashboard 720.

The head 110 further includes a handle or gripping member 730 to aid in separation of the head 110 from the tank portion 105. The first lateral side 735A of the handle 730 includes a first lateral extension 740A. Similarly, the second lateral side 735B of the handle 730 includes a second lateral extension 740B. Each lateral extension 740A, 740B may be generally arcuate, curving downward along its outer end. With this configuration, the handle 730 provides a coupling area that enables the wrapping of a cord around the handle (e.g., the electrical cord of the vacuum system 10).

Figure 8A:
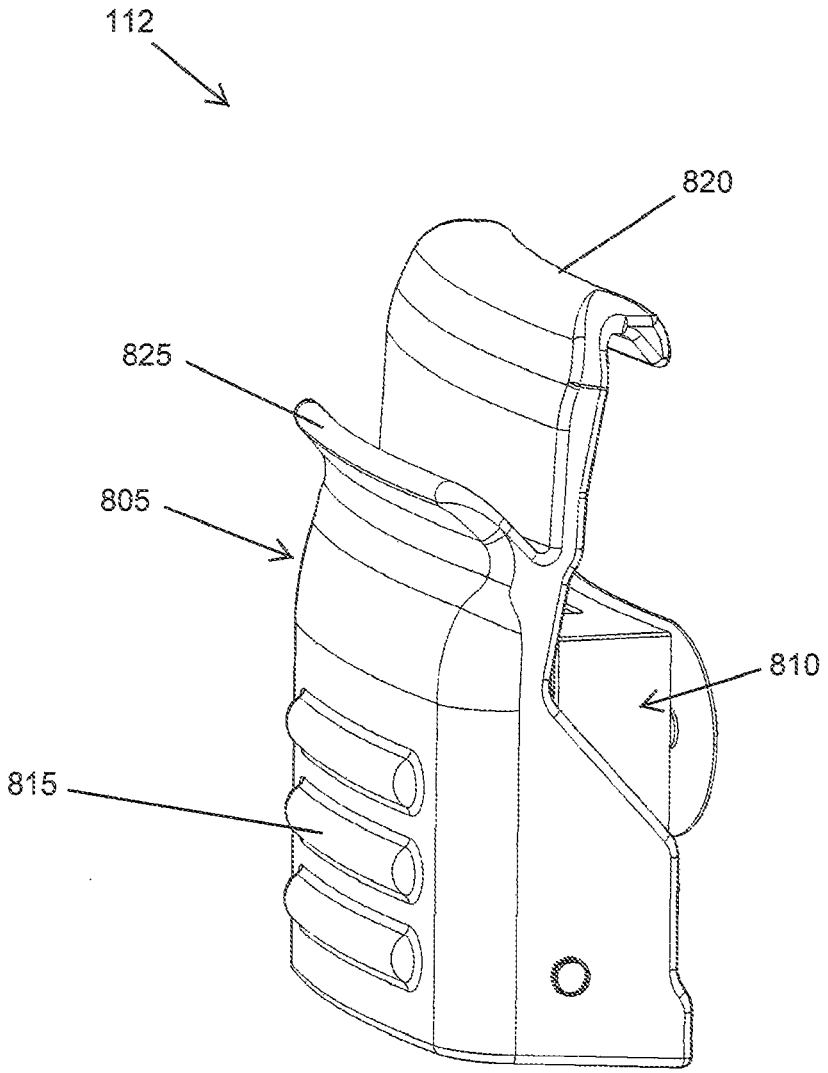
FIG. 8A illustrates a front perspective view of a latch device in accordance with an embodiment of the invention.
Figure 8B:
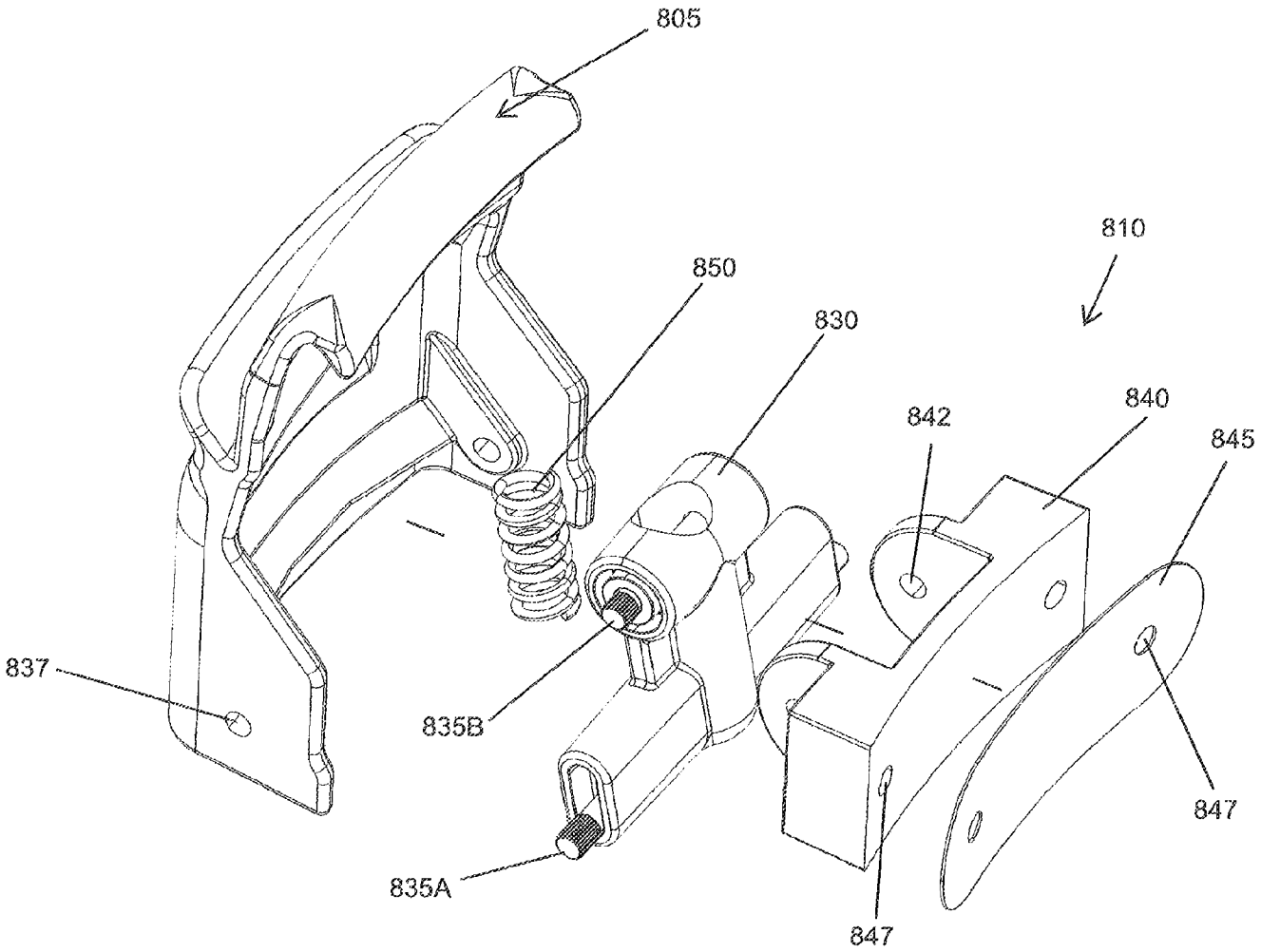
FIG. 8B illustrates an exploded view of the latch device shown in FIG. 8A
Figure 8C:
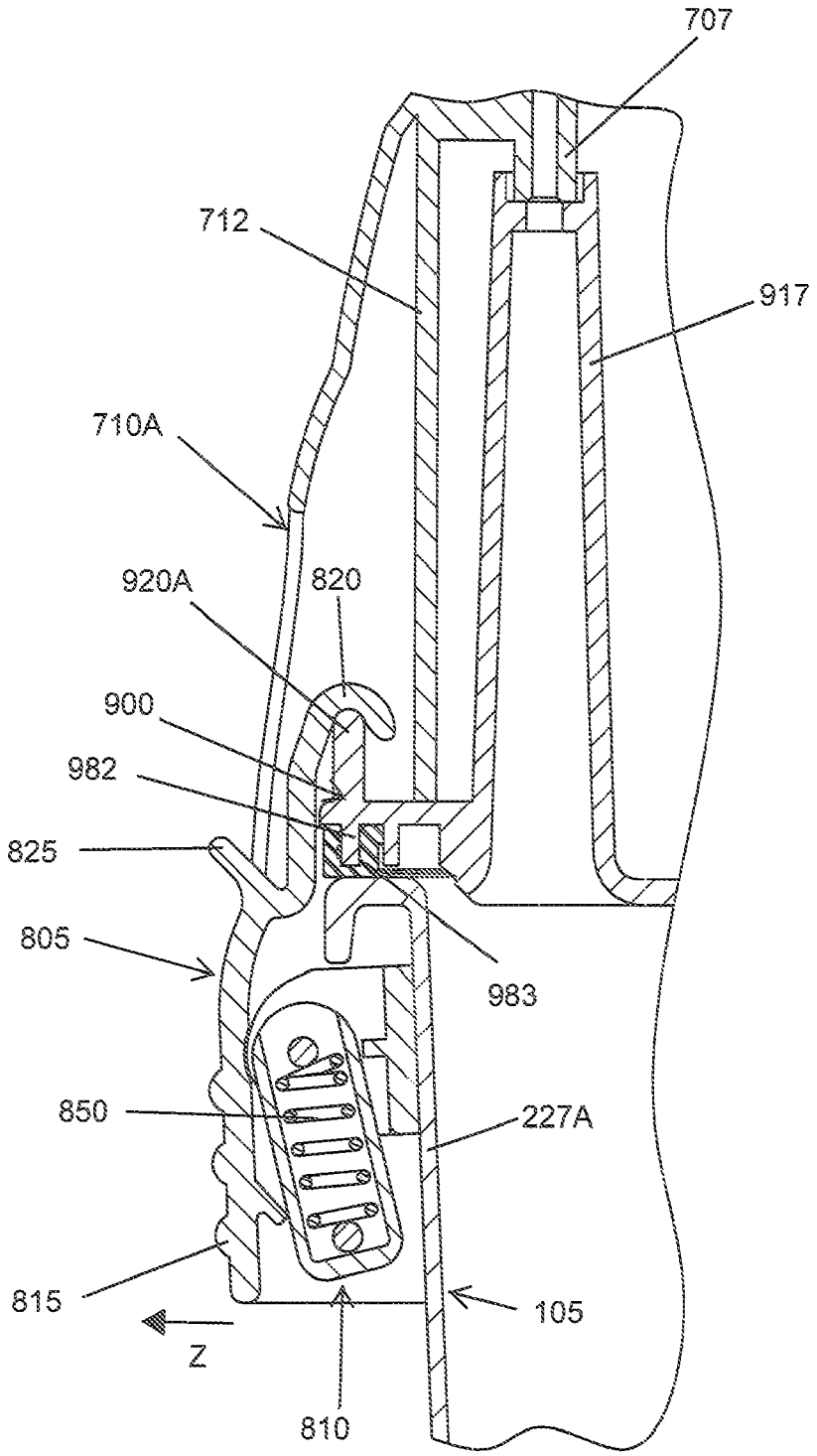
FIG. 8C illustrates a partial cross-sectional view of the vacuum system, showing the operation of the latch device shown in FIG. 8A.

As noted above, one or more latch devices 112 couples the separator plate 900 to the tank 105. Referring to FIGS. 8A-8C, a latch device 112 includes a gripping member or body 805 and a locking mechanism 810 coupled to the inner (tank facing) side of the gripping member. The latch body 805 includes a lower handle portion 815 and an upper hook portion 820 configured to engage a lip disposed on the separator plate 900. The exterior side of the gripping member 805 further includes an extension 825 extending angularly outward from the upper end of the handle portion 815.

The locking mechanism 810 may be any conventional lock mechanism suitable for its described purpose. By way of example, the locking mechanism 810 may include a pivot member 830 pivotally coupled via a lower pin 835A to the handle portion 815 (by way of handle apertures 837) and pivotally coupled to a bracket 840 via an upper pin 835B (by way of bracket apertures 842). The bracket 840, in turn, is coupled to the tank 105 via plate member 845. The bracket 840 and the plate member 845 include connection holes 847 that receive fasteners such as bolts. The pivot member 830 is biased via a biasing member 850 (e.g., a spring) configured to draw the hook portion 820 downward when the gripping member 805 is positioned in its normal, locked position.

In operation, the latch device 112 begins in its normal, locked position, in which hook portion 820 is positioned within a handle cut out 710A, 710B such that the hook portion 820 engages the lip 920A, 920B of the separator plate 900 (FIG. 9A). The handle portion 215, moreover, is positioned within a latch receptacle 227A, 227B. In the normal position, the separator plate is drawn downward by the hook portion 820, being held into engagement with the tank rim 212. To release the latch device 112, the lower end of the handle portion 815 is pivoted outward (away from the tank 105, indicated by arrow Z) to overcome the biasing force of spring 850 in the locking mechanism 810. In this manner, the gripping member 805 is moved from its normal, locked position to its unlocked position (not illustrated). In the unlocked position, the hook portion 820 is no longer held taut against lip 920A, 920B on the separator plate 900. The hook portion 820 may be manipulated further by grasping the extension 825 maneuvering it to completely disengage the hook portion 820 from the lip 920A, 920B and/or repositioning the gripping member 805 such that it clears the handle cut-outs 710A, 710B formed into the lid 100.

To secure the latch device 112, the reverse process is followed, with the hook portion 820 being positioned on the lip, e.g., via manipulation of the extension 825, and the handle portion 815 being rotated inward (toward the tank) to draw the hook portion 820 downward into tight contact with the lip 920A, 920B.

Referring to FIGS. 9A-9C, a separator plate 900 engages the tank rim 212, separating the tank cavity 214 (the collection chamber) from the cavity of the vacuum head 110 (also called a motor chamber). The separator plate 900 includes a platform 905 (e.g., a generally circulate plate) and one or more leg members 907A-907D. The platform 905 includes an upper (head facing) surface 910 and a lower (tank facing) surface 912. The shaped and dimensions of the platform 905 may be any suitable for its described purpose. By way of example, the platform 905 may be substantially planar and possess a generally circular shape. A perimetral wall 915, protruding upward from the platform upper surface 910, extends about the circumference of the platform 905. As noted above, the upper surface 910 of the platform 905 may further include one or more connection posts 917 that engage (e.g., mate, receive, etc.) corresponding connection posts 707 extending from the vacuum head 110. Fasteners may extend through the connection posts 707, 917 to secure the lid 110 to the separator plate 900. A pair of diametrically opposed lips 920A, 920B extends axially (upward) from the perimetral wall 915 to provide an engagement member for each of the latch devices 112, as described above. The platform 905 may further include one or more reinforcing ribs 921 spanning the platform upper surface 910 to enhance the strength of the platform.

Figure 7E:
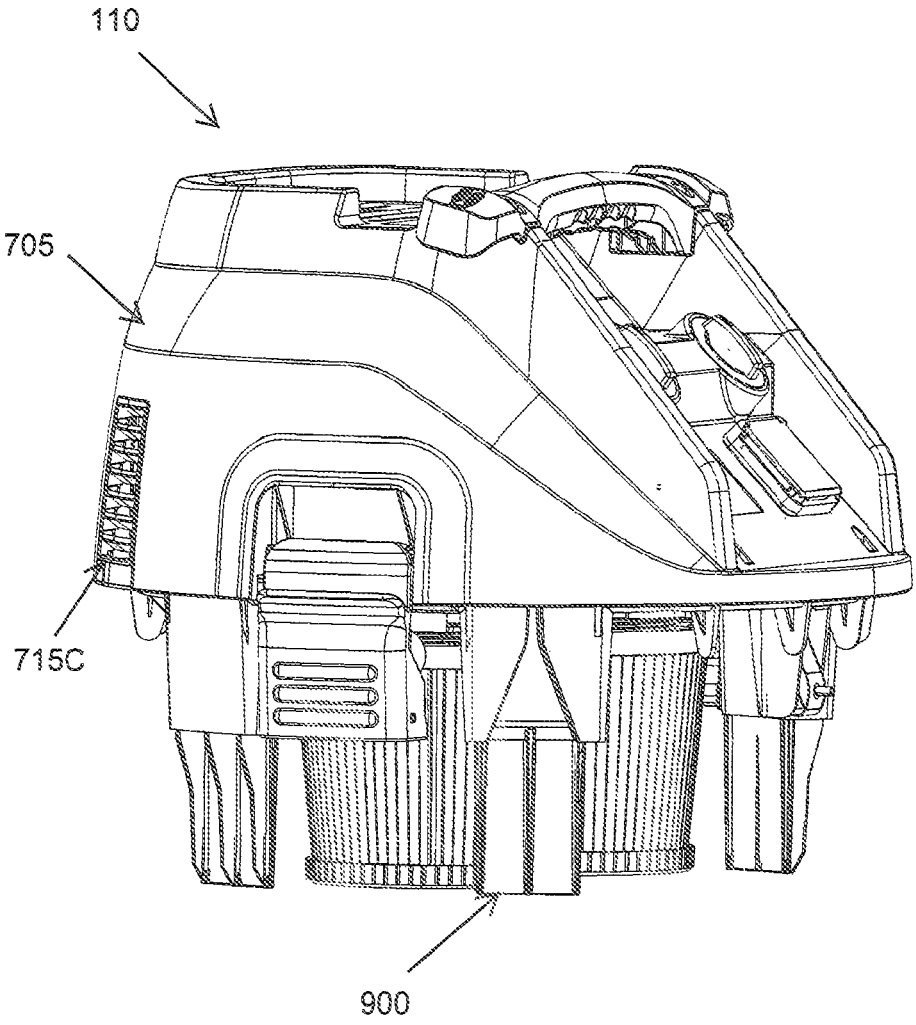
FIGS. 7E and 7F illustrate the vacuum head shown in FIG. 7A, further attached to the separator plate.
Figure 7F:
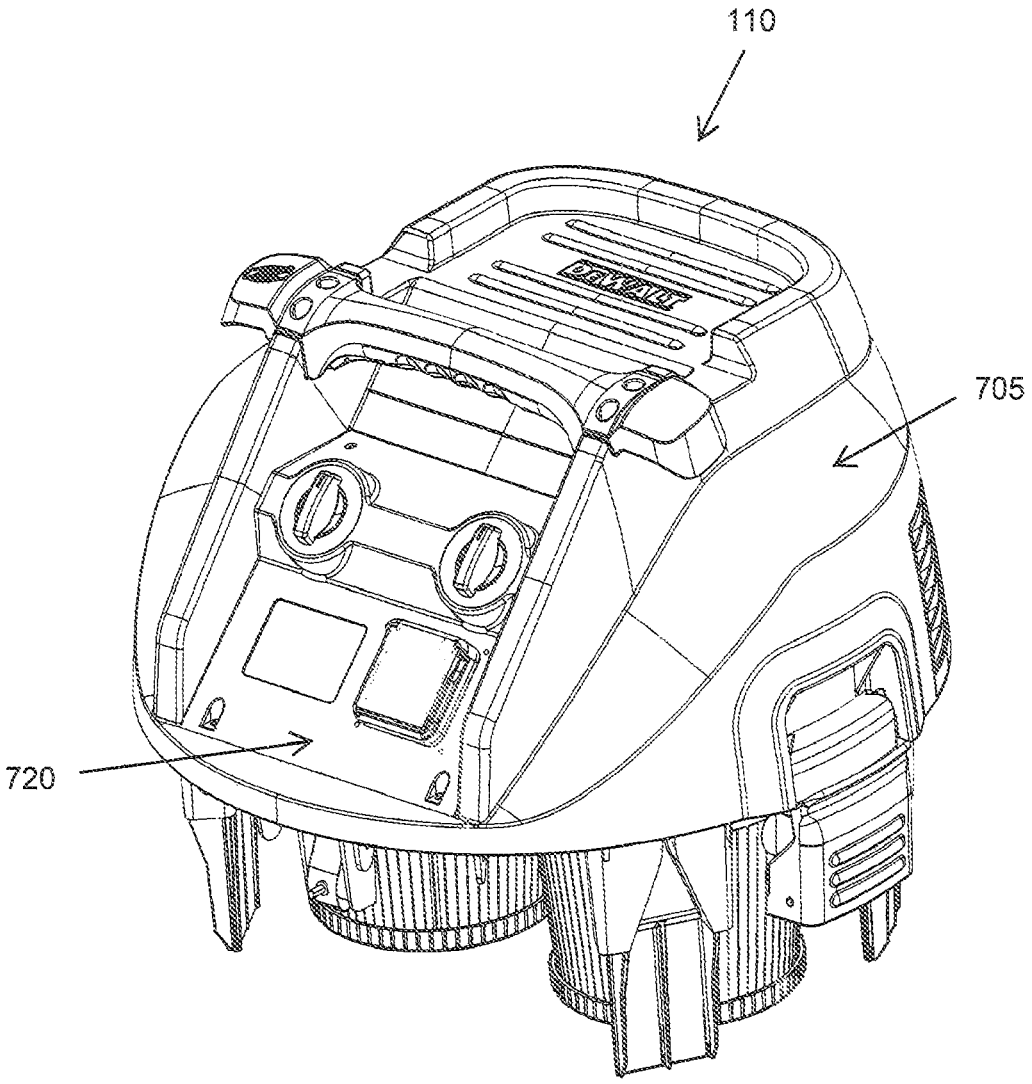
Figure 15A:
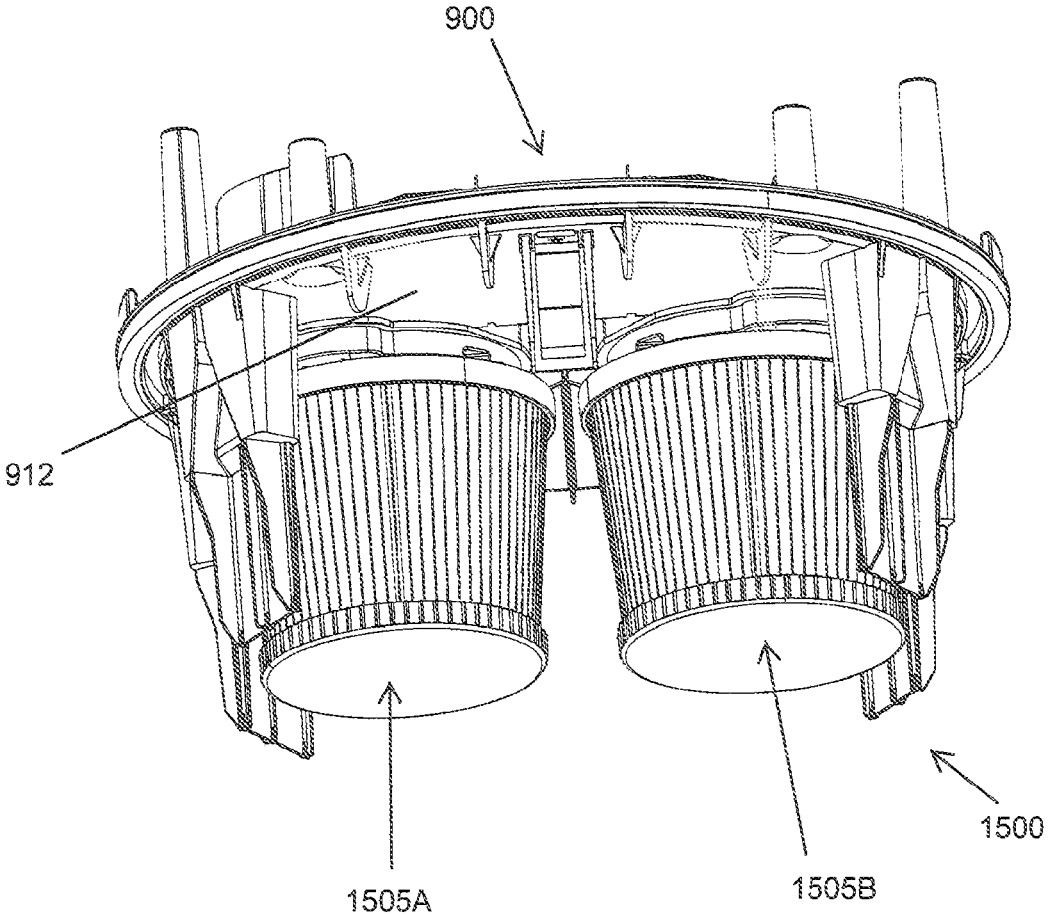
FIG. 15A illustrates a perspective view of a filter assembly in accordance with an embodiment of the invention, shown mounted on the separator plate of FIG. 9A.

The leg members 907A-907D, extending distally from the platform lower surface 912, are configured to elevate the platform 905 and, in particular, to suspend the filter system above a supporting surface when the separator is placed directly upon the supporting surface. That is the length of the legs is selected to prevent the filters from contacting the ground when the separator plate 900 and/or head 110 is removed from the tank and set on a surface (seen in FIGS. 7E and 15A). The leg members 907A-907D are located proximate the outer edge of the separator plate, being disposed a predetermined angular positions thereon.

The leg members 907A-907D, moreover, are configured to key the separator plate 900 to the tank 105 such that the separator plate is oriented in a specific rotational position when inserted into the tank 105. As shown in the figures, the platform 905 includes a first forward leg 907A, a second forward leg 907B, a first rearward leg 907C, and a second rearward leg 907D. Each leg 907A-907D includes a proximal leg portion 922 and a distal leg portion 925. The proximal leg portion 922 of the forward legs 907A, 907B includes a notch 927 (e.g., a tapered (V-shaped) notch) configured to receive the guide element 675A, 675B protruding from the interior surface 670 of the tank 105. As explained above, the guide element 675A, 675B is positioned at predetermined positions along the tank. The notch 927 aligns with each of the tank guide elements 675A. 675B such that the first guide element 675A is received within the notch of the first forward leg 907A and the second guide element 675B is received within the notch of the second forward leg 907B. Consequently, in order for the separator plate 900 to be inserted into the tank cavity, the notch 927A of first leg member 907A must be aligned with the first guide element 675A and the notch 927B of the second leg member 907B must be aligned with the second guide element 675B. Should the forward (notched) leg members 907A, 907B not be aligned with their corresponding guide elements 675A, 675B (i.e., should the rotational position of the separator plate 900 differ from the normal/predetermined position such that no leg or an unnotched leg is aligned with the guide elements), insertion of the separator plate 900 into the tank cavity 214 will be prohibited.

The separator plate 900 further includes a conduit system to enable the flow of air between the tank 105 (the collection chamber 214) and the head 110 (the motor chamber). In the embodiment illustrated, the platform 905 of the separator plate 900 includes a central, raised platform or deck 902 with a first conduit pair 935 and a second conduit pair 940. The first conduit pair 935 includes a first (forward) suction conduit or port 935A and a first (rearward) cleaning conduit or port 935B. Similarly, the second conduit pair 940 includes a second (forward) suction conduit or port 940A and a second (rearward) cleaning conduit or port 940B. The conduits 935A, 935B of the first conduit pair 935 are positioned such that the conduits are disposed over the first filter 1505A (FIG. 15) of the filter system, while the conduits 940A, 940B of the second conduit pair 940 are positioned such that they are disposed over the second filter 1505B of the filter system (i.e., each filter is in fluid communication with a conduit pair).

The conduits 935A, 935B, 940A, 940B may possess any shape and dimensions suitable for their described purpose. By way of example, each conduit 935A, 935B, 940A, 940B may be generally cylindrical. Each conduit, moreover, may include a conduit baffle operable to direct the airflow in a predetermined direction. As seen best in FIG. 9A, the suction conduit 935A, 940A may include an inboard conduit baffle 942A that curves radially inward with respect to the platform 905 to direct the air inboard, while the cleaning conduits 935B, 940B may include an outboard conduit baffle 942B that curves radially outward to direct air outboard (toward the perimeter of the platform).

The upper surface 910 of the platform 905 further includes first 945A, second 945B, and third 945C support walls that cooperate to support the airflow assembly. As shown, the first support wall 945A extends upward from the upper surface 910 of the platform 905, being oriented between the suction 935A, 940A and the cleaning 935B, 940B conduits. The second support wall 945B is disposed proximate the cleaning conduits 940A, 940B (i.e., is disposed outboard with respect to the first support wall). The third support wall 945C, moreover, is positioned outboard from the second support wall 945B. Each support walls 945A-945C is spaced from its adjacent support wall to define a cavity therebetween. Specifically, the first 945A and second 945B support walls define a fan cavity 950 that receives the fan of the airflow assembly. Similarly, the second 945B and third 945C support walls cooperate to define a motor cavity 955 that receives the motor of the airflow assembly. Each support wall 945A, 945B, 945C includes a cut-out section 947 that receives and supports various components of the airflow assembly. By way of example, the second and third support walls cooperate to support the motor of the airflow assembly, with the motor resting within the cut-out section. The motor cavity 955 further includes areas 957 for supporting valve solenoid switches (discussed in greater detail below).

The separator plate 900 further includes a pair of opposed motor intake walls 958 extending from the third support wall 945C to the perimetral wall 915. The motor intake walls 958 cooperate with a motor shroud 1205 (FIG. 12A) to define a motor air intake area 960 that aligns with second head vent 715B. Similarly, opposed walls 962 cooperate with the motor shroud 1205 to define a motor exhaust area 965 that aligns with third head vent 715C.

A deflection wall or baffle 970 extends upward from platform upper surface 910 (e.g., the height of the wall may be substantially equal to or greater than the height of the deck 902). The platform baffle 970 is positioned between the deck 902 and the perimetral wall 915. The platform baffle 970 gradually curves such that it extends from a position along a lateral side of the deck 902 to a position along the forward side of the deck. The platform baffle 970 is operable to direct cooling air exhausted by the manifold 1305 (FIG. 13A) toward electronics housed within the head 110, thereby cooling the electronics (discussed in greater detail below).

The platform 905 further includes a first yoke 975A located proximate the first cleaning conduit 935B and a second yoke 975B located proximate the second cleaning conduit 940B. Each yoke 975A, 975B supports an associated butterfly valve 1005A, 1005B (FIG. 10A) of the valve assembly to enable rotation of the valve on the yoke (discussed in greater detail below).

The platform lower surface 912 is best seen in FIG. 9C. As shown, platform lower surface 912 includes a recessed area 977 generally corresponding with the raised deck 902 of the platform upper surface 910. The perimetral wall 915 of the platform upper surface 910, moreover, defines a shoulder 980 on the platform lower surface 912. An axial wall 982 extends downward from the lower surface shoulder 980, being disposed slightly inboard from the circumference of the separator plate 900. The axial wall 982 (FIG. 8C) is wrapped with a generally U-shaped sealing member or gasket 983 configured to contact the rim 212 of the tank 105 and thereby fluidly seal the joint between the tank rim 212 and the shoulder 980.

A series of downward-extending, angled fins 985 may be angularly spaced about the platform 905, being located near the outer edge of the platform, proximate the shoulder 980. The fins 985 serve as guides during the insertion of the separator plate 900 into the tank cavity 214. A bracket 990 is also disposed on the platform lower surface 912 that receives the conductive member 635 of the electrostatic discharge device. As shown, the conductive member 635 is coupled to the platform 905 via the conductive fastener 655.

Figure 10A:
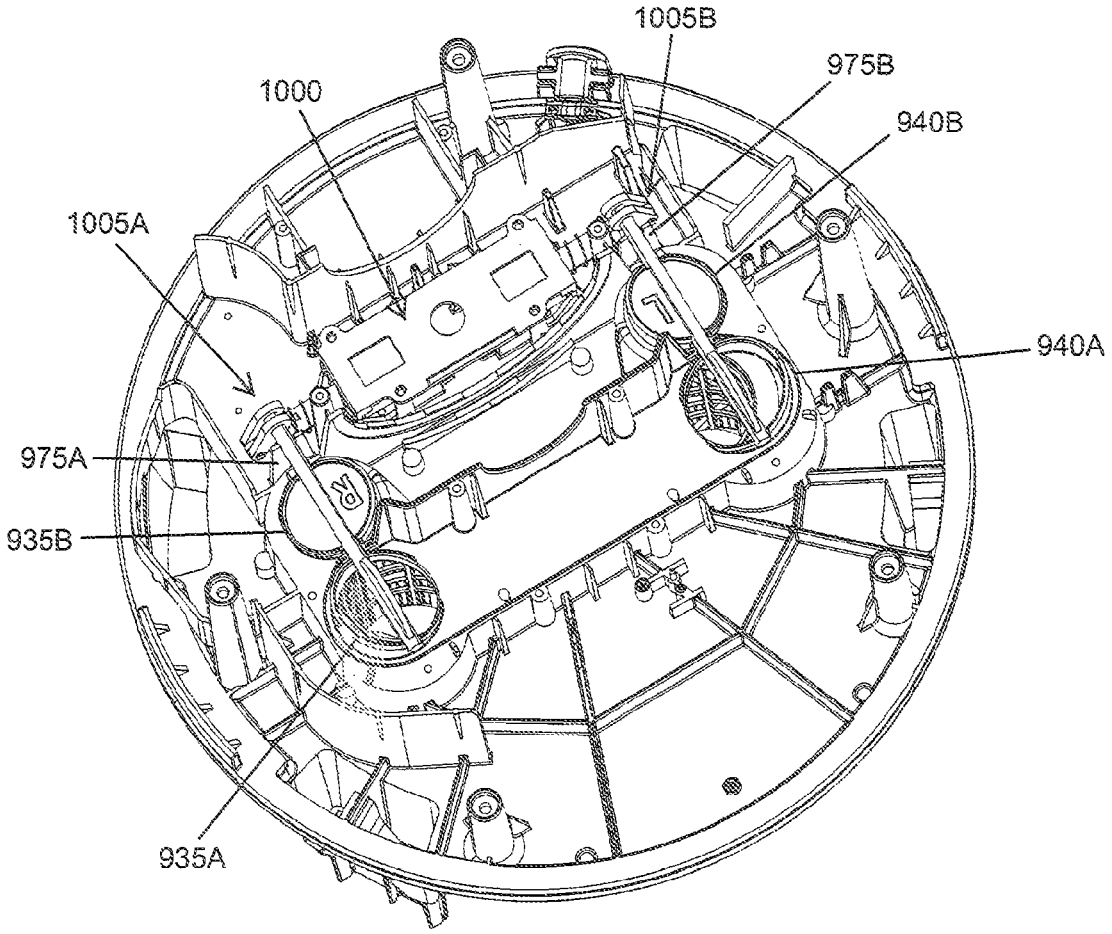
FIG. 10A illustrates a top perspective view of a valve assembly in accordance to an embodiment of the invention, the valve assembly being mounted on the separator plate of FIG. 9A.
Figure 10B:
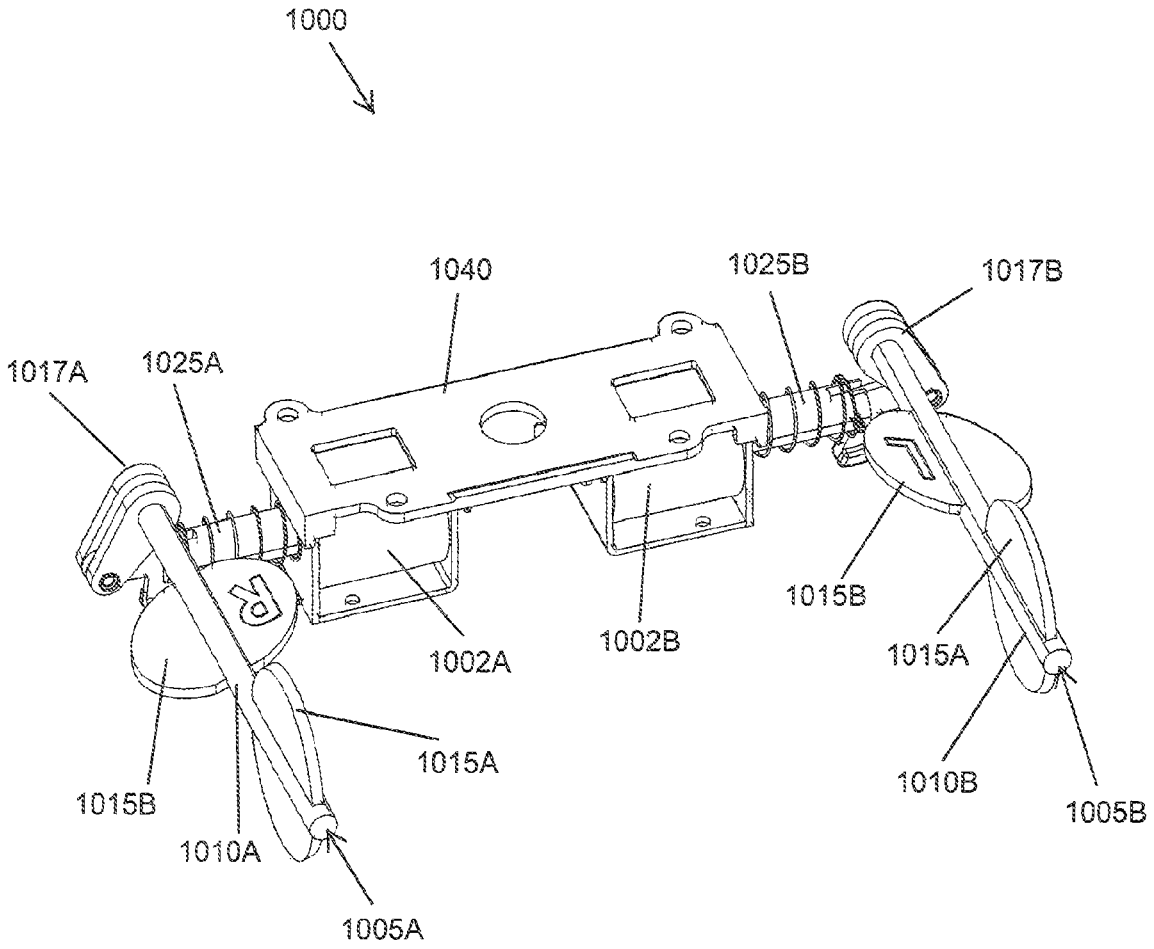
FIG. 10B illustrates an isolated, front perspective view of the valve assembly shown in FIG. 10A.
Figure 10C:
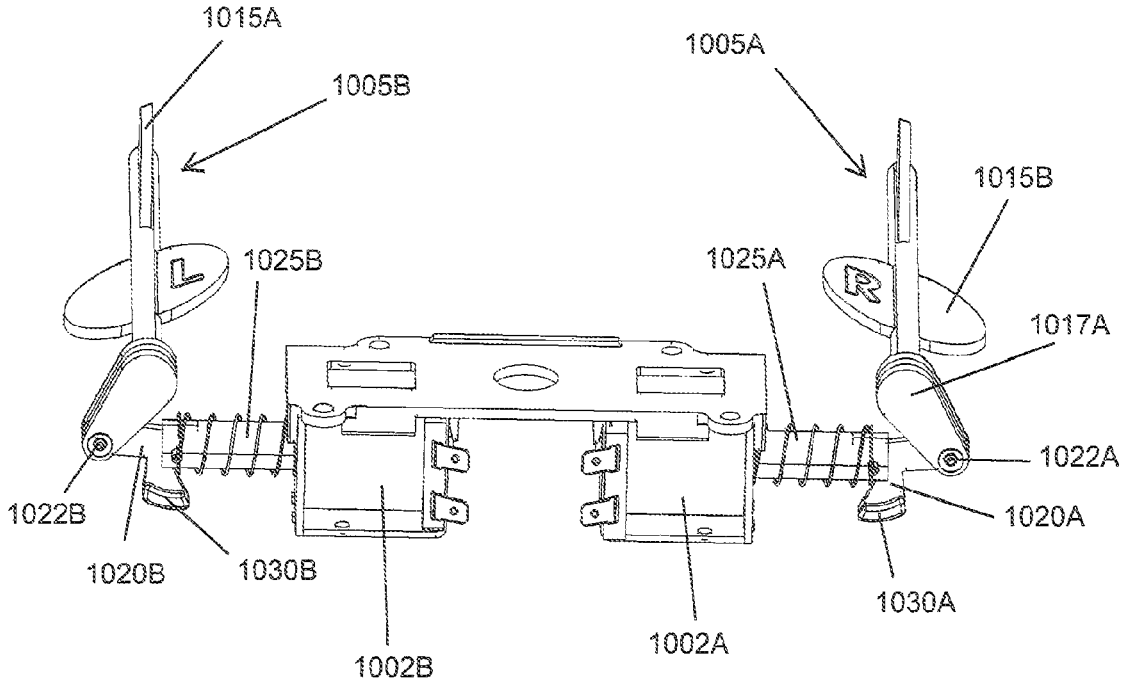
FIG. 10C illustrates an isolated, rear perspective view of the valve assembly shown in FIG. 10A.

A valve assembly, disposed on platform upper surface 910, opens and closes one or more of the separator conduits 935A, 935B, 940A, 940B to selectively permit fluid (air) therethrough. In the embodiment illustrated in FIGS. 10A-10C, the valve assembly 1000 includes a first solenoid 1002A in communication with to a first butterfly valve 1005A and a second solenoid 1002B in communication with to a second butterfly valve 1005B. The first butterfly valve 1005A is supported by the first platform yoke 975A, while the second butterfly valve is supported by the second platform yoke 975B. As seen in FIG. 10A, the valve assembly 1000 is positioned on the separator plate 900, with each solenoid 1002A, 1002B being positioned within areas 957 as described above. The solenoids 1002A, 1002B may be secured to the platform 905 by a cover or bridge 1040 coupled thereto.

The first butterfly valve 1005A selectively permits airflow through the first conduit pair 935A, 935B. Similarly, the second butterfly valve 1005B selectively permits airflow through the second conduit pair 940A, 940B. Each butterfly valve 1005A, 1005B includes an elongated shaft 1010A, 1010B supporting a first or distal disc 1015A and a second or proximal disc 1015B longitudinally spaced along the shaft and rotationally offset from the distal disc by, e.g., approximately 45°.

The proximal end of the shaft 1010A, 1010B is connected to a crank arm 1017A, 1017B, which, in turn, is pivotally coupled to a linking member 1020A, 1020B via a pivot pin 1022A, 1022B. The linking member 1020A, 1020B is repositioned via a plunger 1025A, 1025B that is driven by the solenoid 1002A, 1002B. Specifically, the plunger 1025A, 1025B reciprocates axially to rotate the discs. The linking member 1020A, 1020B may further include a downward-extending, curved support or ski 1030A, 1030B configured to slide along the platform upper surface 910 as the plunger 1025A, 1025B reciprocates. The ski 1030A, 1030B maintains the positioning of the plunger 1025A, 1025B with respect to the solenoid during the plunger's reciprocal motion, keeping the plunger aligned with the drum of the solenoid 1002A, 1002B and preventing the plunger from becoming jammed in the solenoid drum at full extension. With this configuration, each solenoid 1002A, 1002B may be selectively engaged to rotate the shaft 1010A, 1010B about its longitudinal axis in a clockwise or counter clockwise direction. The degree of rotation includes, but is not limited to, approximately 45°.

As a result, the valve assembly 1000 may selectively position each disc 1015A, 1015B with respect to its associated conduit 935A, 935B, 940A, 940B to enable the passage of fluid (e.g., air) therethrough. In operation, the valve assembly 1000 rotationally positions the discs 1015A, 1015B in a first position, in which the suction conduits 935A, 940A are opened and the cleaning conduits 935B, 940B are closed. That is, the butterfly valve 1005A, 1005B positions the shaft 1010A, 1010B such that the first disc 1015A is oriented generally transverse to the opening defined by the suction conduit 935A, 940A (as illustrated in FIG. 10A), thereby permitting airflow between the tank 105 (the collection chamber 214) and the head 110 (the motor chamber). The second disc 1015B, meanwhile, is positioned such that the disc completely covers the opening of the cleaning conduit 935B, 940B preventing the flow of air between the head 110 to the tank 105. Alternatively, the valves 1005A, 1005B may rotationally position the discs 1015A, 1015B in a second (reversed) position, in which the suction conduits 935A, 940A are closed and the cleaning conduits 935B, 940B are opened.

Figure 10D:
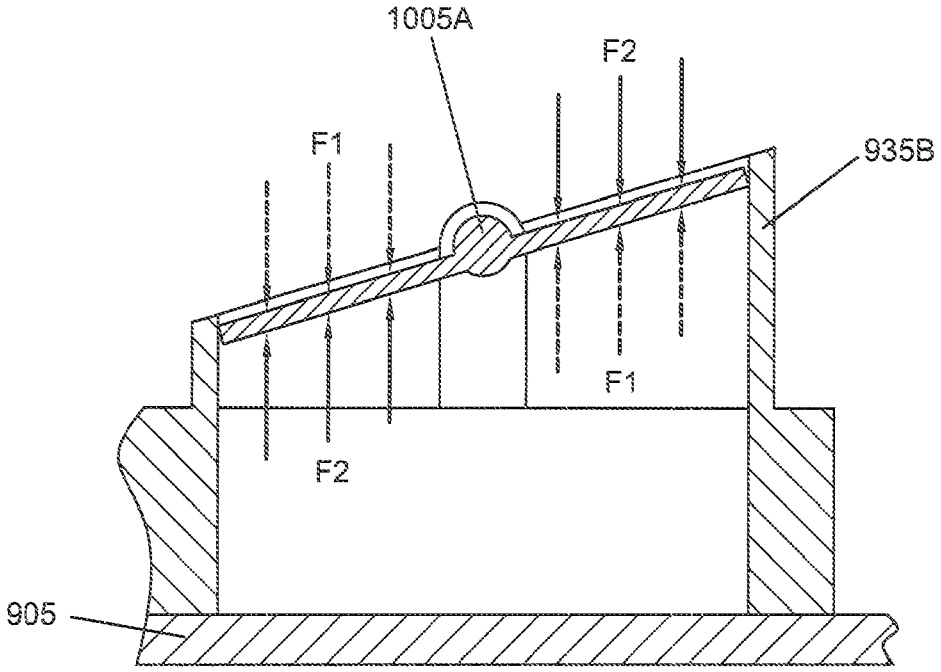
FIG. 10D illustrates a cross sectional view of a conduit and a valve of the valve assembly, showing the forces acting upon a disc.

As shown in FIG. 10D, the conduits 935A, 935B, 940A, 940B and discs 1015A, 1015B are configured such that air flowing through the conduit creates a balanced system in which the forces on the butterfly valve 1005A, 1005B are equally applied across both surfaces of the disc 1015A, 1015B (indicated by arrows F1 and F2). Specifically, when an air pressure (positive or negative) is experienced on the upper side of the disk, the downward force (F1 upper) on one side of the rotating axis is generally equal to the downward force (F2 upper) on the other side of the axis. Therefore, a pressure on the top side of the disk does not significantly increase the force necessary to toggle the valve. Likewise, when an air pressure is experienced on the lower side of the disk, the upward force (F1 lower) on one side of the rotating axis is generally equal to the upward force (F2 lower) on the other side of the axis. Therefore, a pressure on the lower side of the disk does not significantly increase the force necessary to toggle the valve to its next operating condition. This enables the utilization of a small solenoid to rotate the valve 1005A, 1005B as described above, and provides an advantage over other valve types (e.g., piston valves, etc.) which have larger pressures to overcome and require large forces to toggle between operating positions. That is, the conduit structure enables the use of a lower power solenoid since valve rotation does not require overcoming a significant eccentric force applied to the disc 1015A, 1015B by the air in or airflow through the conduit.

Figure 11A:
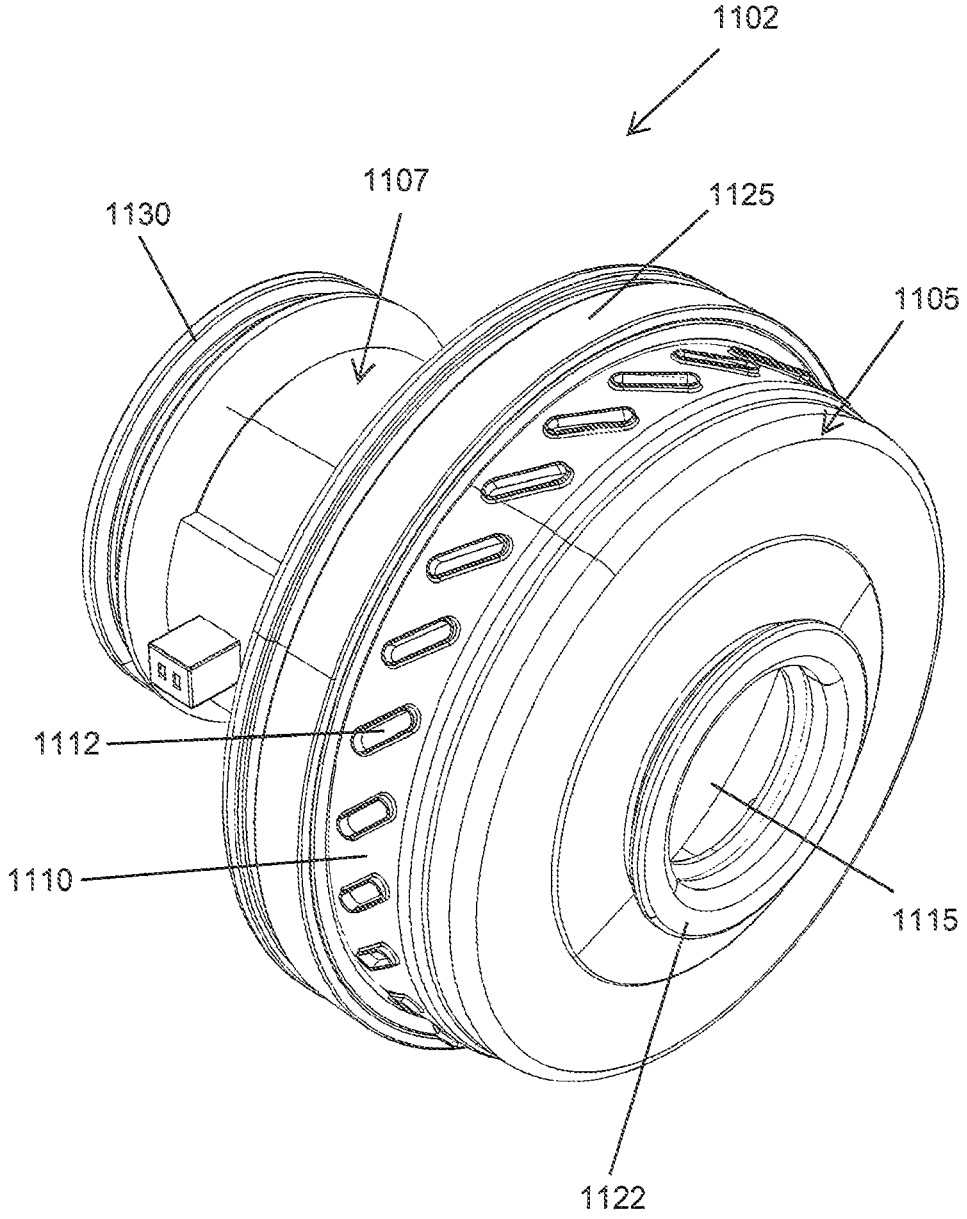
FIG. 11A illustrates an isolated view of an airflow assembly in accordance with an embodiment of the invention.
Figure 11B:
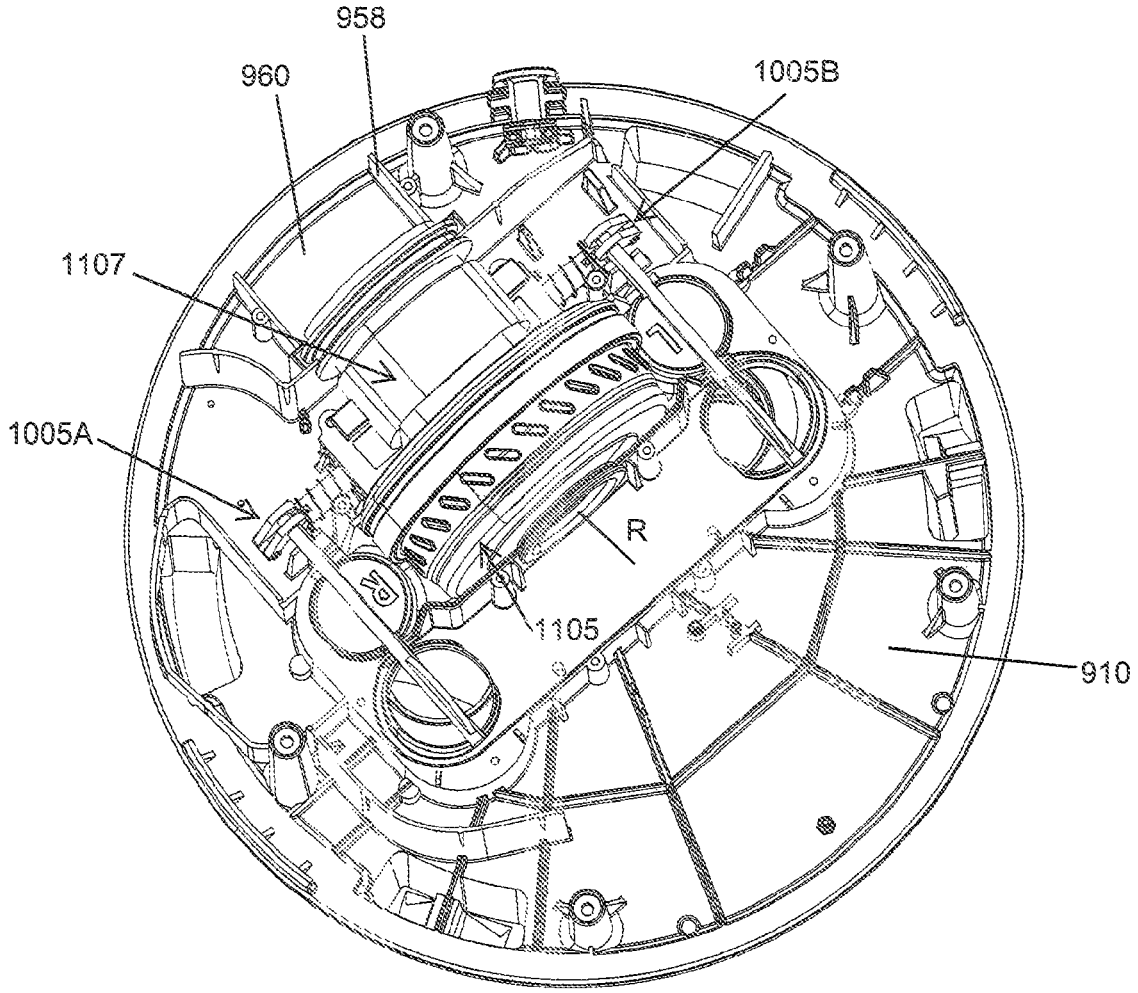
FIGS. 11B and 11C illustrate perspective views of the airflow assembly of FIG. 11A mounted on the separator plate shown in FIG. 9A.
Figure 11C:
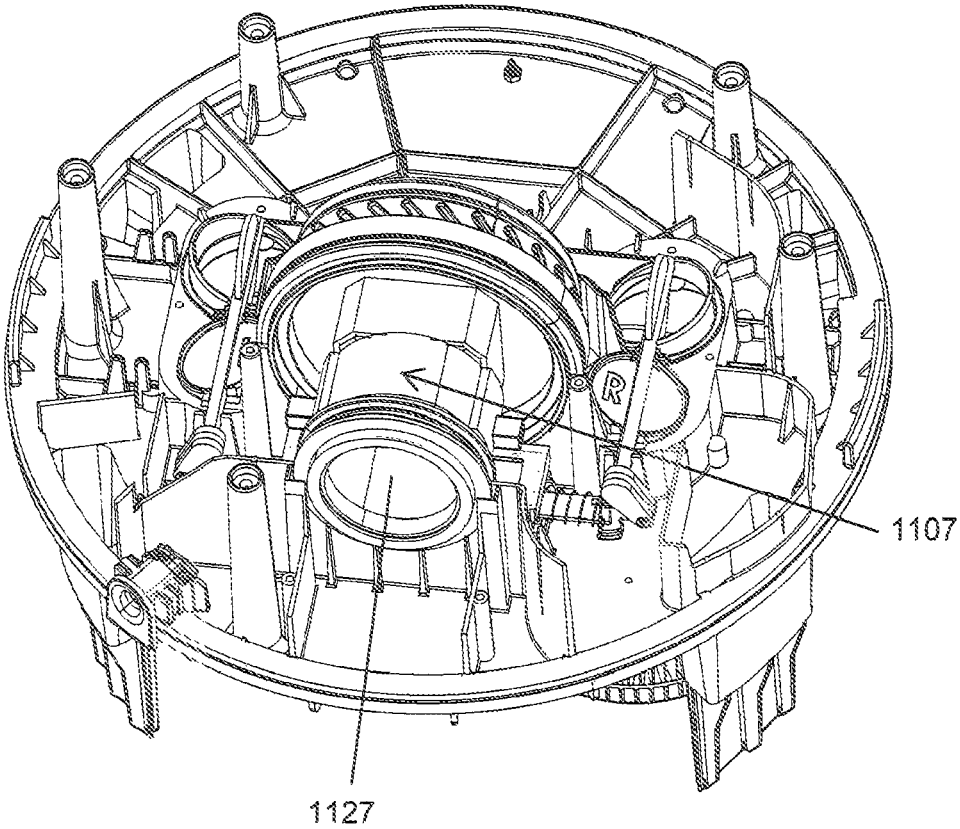

An airflow assembly, housed within the motor chamber defined by head 110 and supported on the upper platform surface 910, generates air pressure (positive and/or negative), within the vacuum device 10, as well directs the flow of air within the head 110. Referring to FIGS. 11A-11C, the airflow assembly includes an airflow generating device 1102 having a centrifugal fan 1105 driven by a motor 1107. The fan 1105 includes an annular housing or baffle 1110 and a plurality of slots 1112 disposed about the perimeter of the housing. The slots 1112 may be angled (e.g., offset and/or nonparallel to the rotational axis of the housing) to direct air in a predetermined direction. With this configuration, air is drawn into the central channel 1115 and is directed radially outward (from the fan rotational axis) through the slots 1112. The airflow generating device 1102 may further include a forward gasket 1122 coupled to the forward (inboard facing) side of the fan 1105, and a manifold spacer 1125 coupled to the rearward side of the fan. The motor 1107 may include any type of motor suitable for its described purpose. By way of example, the motor 1107 may include a universal series motor with a central channel 1127. The motor 1107 is configured to drive (e.g., rotate) the fan 1105 in a clockwise and/or counterclockwise direction, as well as to draw cooling air into the motor channel 1127. In an embodiment, the motor 1107 rotates the fan 1105 in a predetermined direction to generate a negative pressure within the vacuum device 10, which, in turn, generates a suction airstream (an intake airstream) that enters the tank portion 105 via the inlet port 255. As illustrated, the forward side of the motor 1107 may be coupled to the rearward (outboard facing) side of the fan 1105, and a rearward gasket 1130 may be coupled to the outboard side of the motor.

Referring to FIGS. 11B and 11C, the airflow generating device 1102 is oriented on the separator plate platform 905 such that it is located between the butterfly valves 1005A, 1005B, with the fan 1105 and manifold spacer 1125 being positioned within the fan cavity 950 of the platform 905, as well as aligned with the cut out section 947 formed into the first 945A and second 945B walls. The motor 1107, moreover, is position within motor cavity 955 such that the motor channel 1127 is aligned with the cut-out sections formed into the second 945B and third 945C platform walls. In a preferred embodiment, the fan 1105 is oriented such that its rotational axis R is oriented generally horizontally, i.e., such that the rotational axis is generally parallel to the platform 905 of the separator plate 900. Stated another way, the fan rotational axis R is oriented generally transverse (e.g. orthogonal) to the longitudinal axis of a filter 1505A, 1505B (FIG. 15). As such, the air intake direction of the fan 1105 may be oriented generally transverse (e.g., generally orthogonal) to the airflow passing through the conduit pairs 935, 940.

Figure 12A:
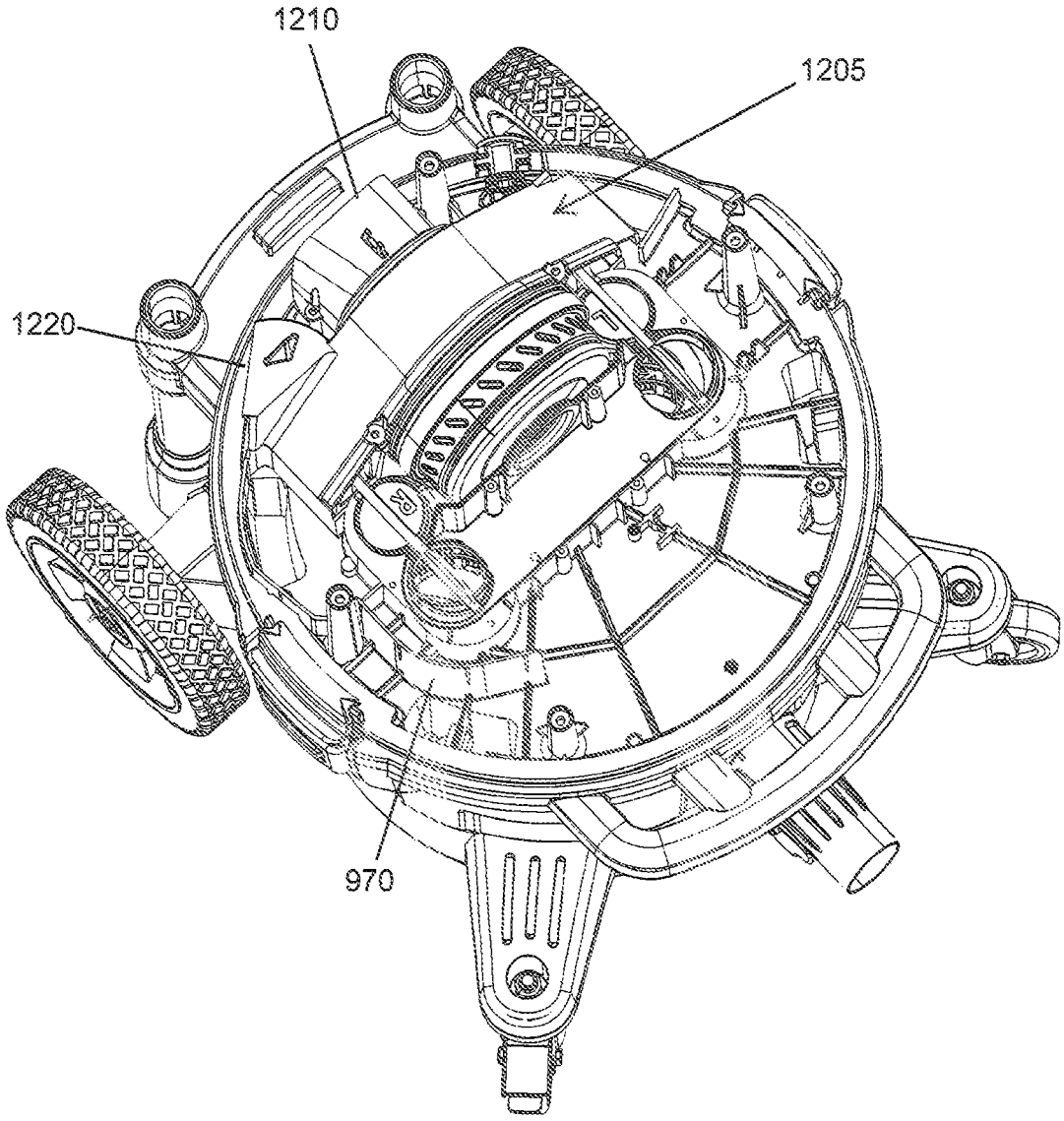
FIGS. 12A and 12B illustrate the vacuum system with the vacuum head and manifold removed, showing a motor shroud mounted on the separator plate of FIG. 9A.
Figure 12B:
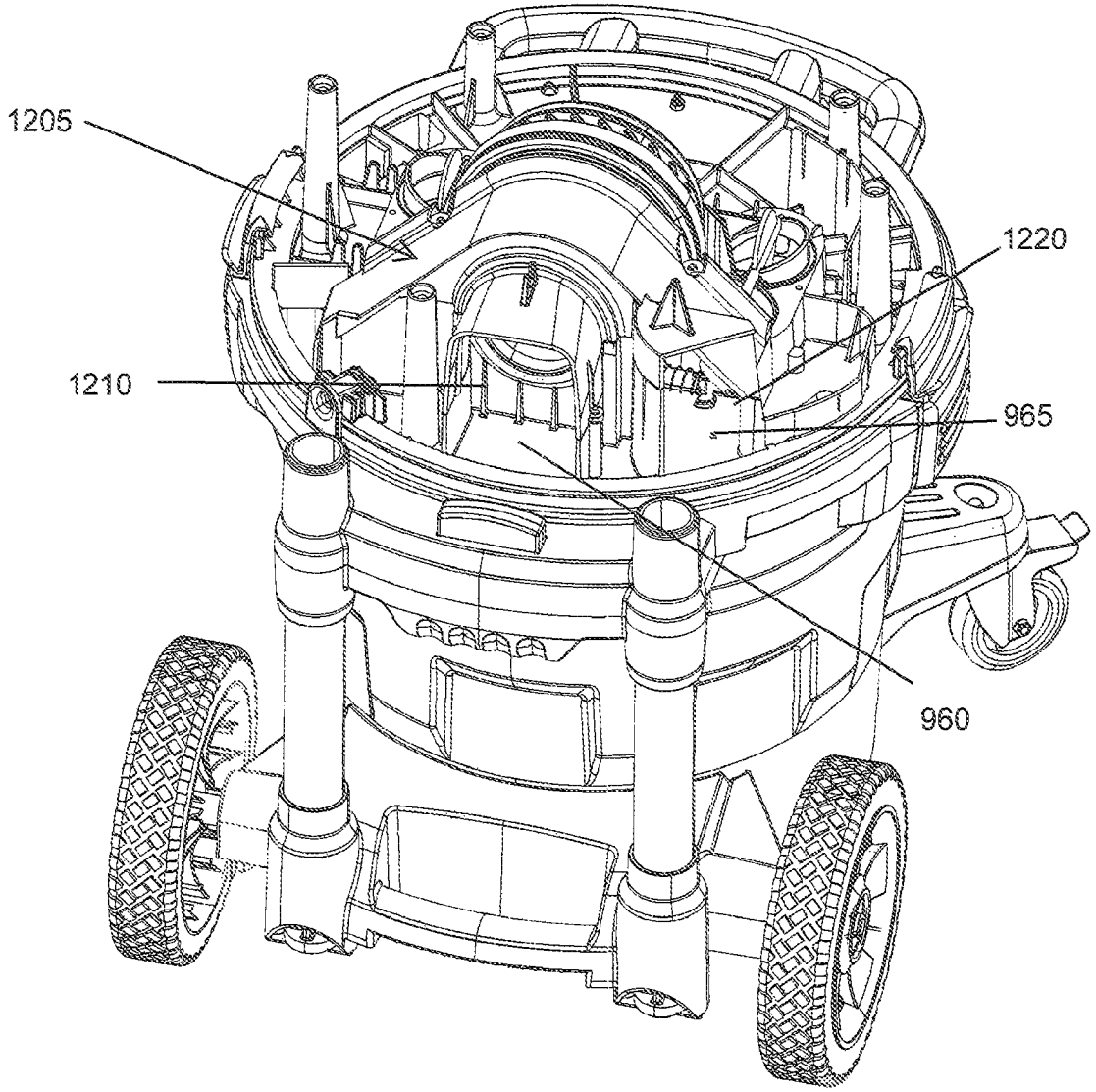

Referring to FIGS. 12A and 12B, the motor 1107 is housed in a motor shroud 1205 defining a motor air intake port 1210 and a motor air outlet or exhaust port 1220. The motor shroud 1205 separates the cooling airstream generated by the motor from the vacuum airstream. The intake port 1210 cooperates with walls 958 on the platform 905 to define the motor intake area 960 as described above. Similarly, the exhaust port 1220 cooperates with the walls 962 on the platform upper surface 910 to define the motor exhaust area 965 as described above. In operation, the ambient air is drawn into the motor air intake 1210, travels over the motor (cooling it), and is then exhausted via motor air exhaust 1220.

Figure 13A:
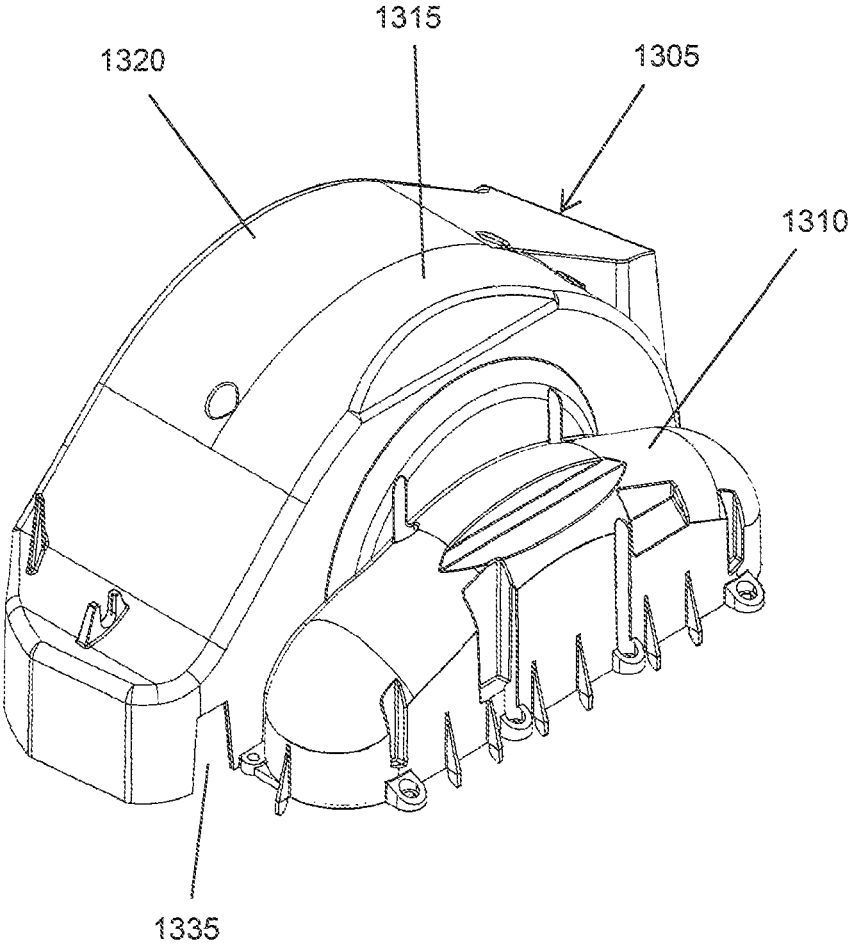
FIG. 13A illustrates a front perspective view of a manifold in accordance with an embodiment of the invention, shown in isolation.
Figure 13B:
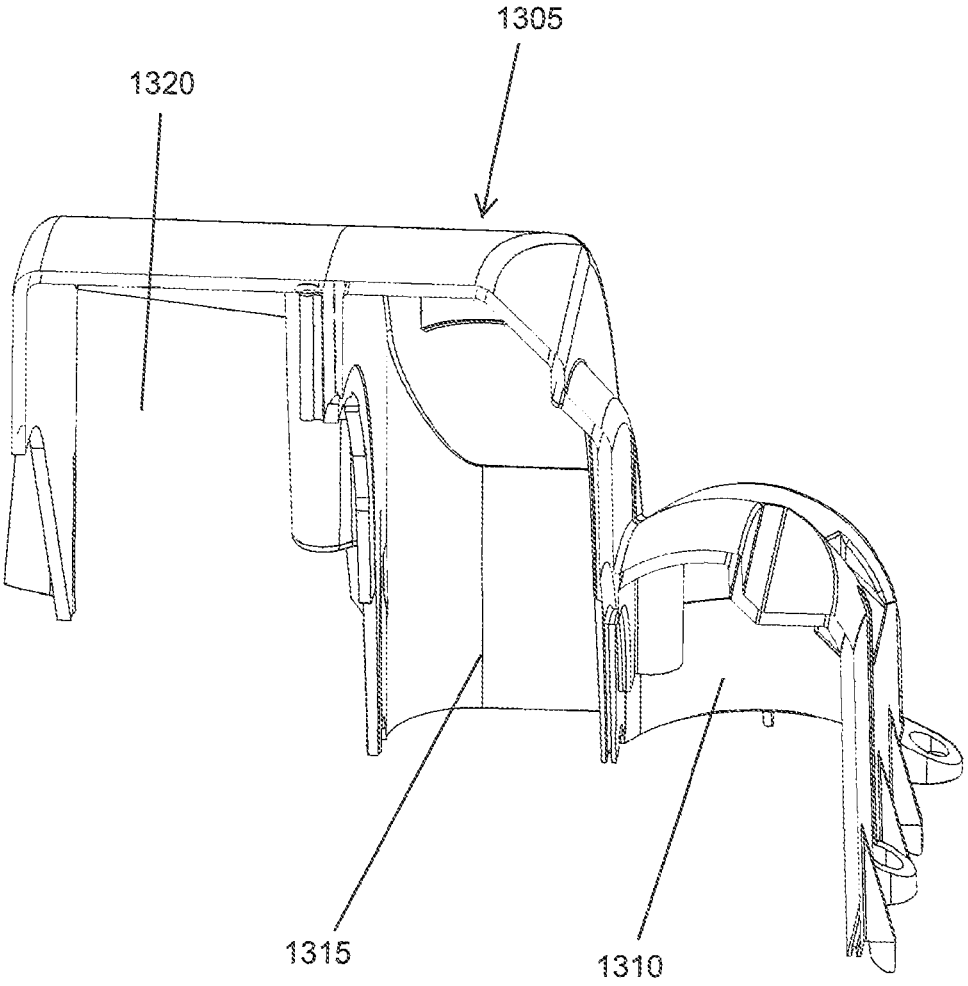
FIG. 13B illustrates a cross sectional view of the manifold shown in FIG. 13A.
Figure 13C:
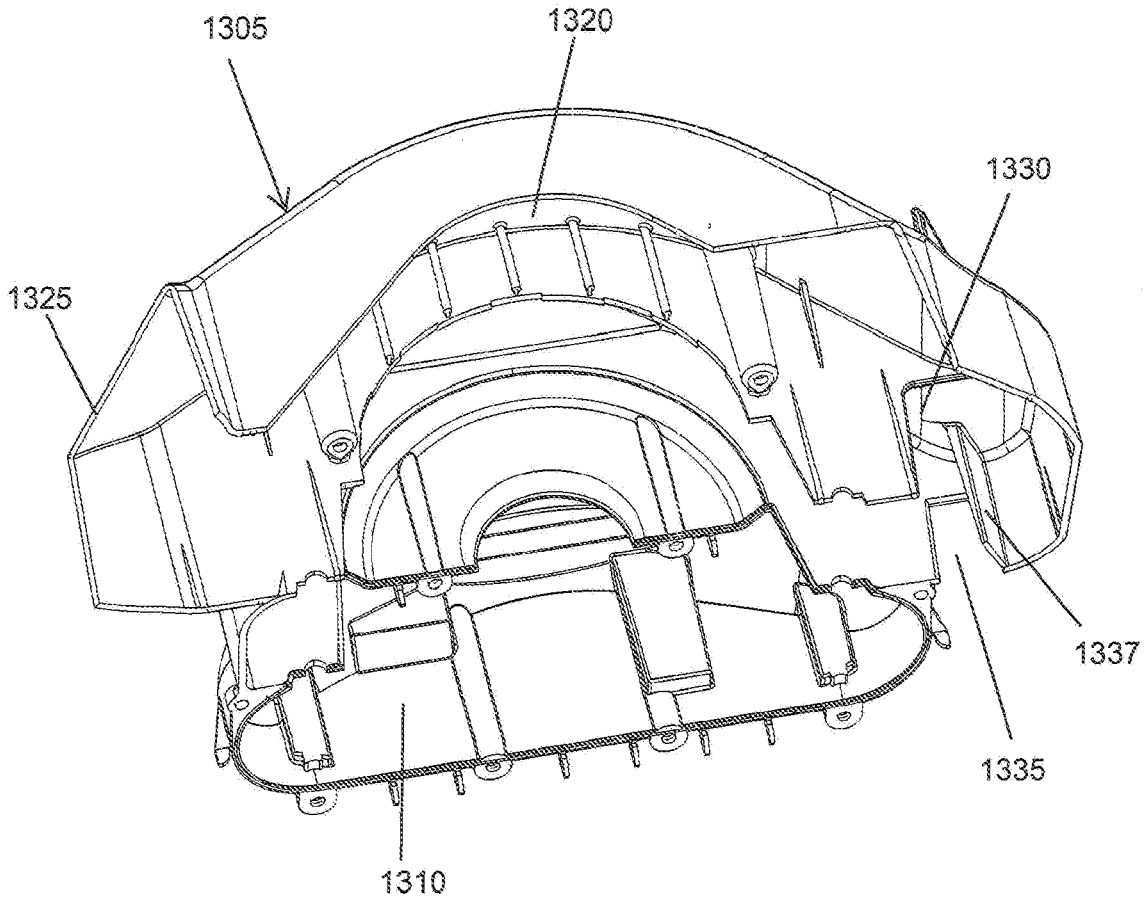
FIG. 13C illustrates a bottom perspective view of the manifold shown in FIG. 13A.

The airflow assembly further includes a manifold operable to direct the airflow in predetermined directions. The manifold includes a plurality of chambers that function as baffles, cooperating to direct airflow in predetermined directions. Referring to FIGS. 13A-13C, the manifold 1305 includes a forward inlet chamber 1310, an intermediate fan discharge chamber 1315, and a rearward exhaust chamber 1320. The exhaust chamber 1320 includes an exhaust port 1325 to permit exhaust of the filtered air from the manifold 1305. In addition, the fan discharge chamber 1315 includes a first window or opening 1330 configured to permit the flow of fluid between the fan discharge chamber 1315 and the exhaust chamber 1320. Additionally, the fan discharge chamber 1315 includes a second window or opening 1335 including an interior deflector 1337 extending angularly inward into the fan discharge chamber such that directs a portion of the air flowing downstream, through the manifold out of the manifold and into the cavity defined by the head 110.

Figure 14A:
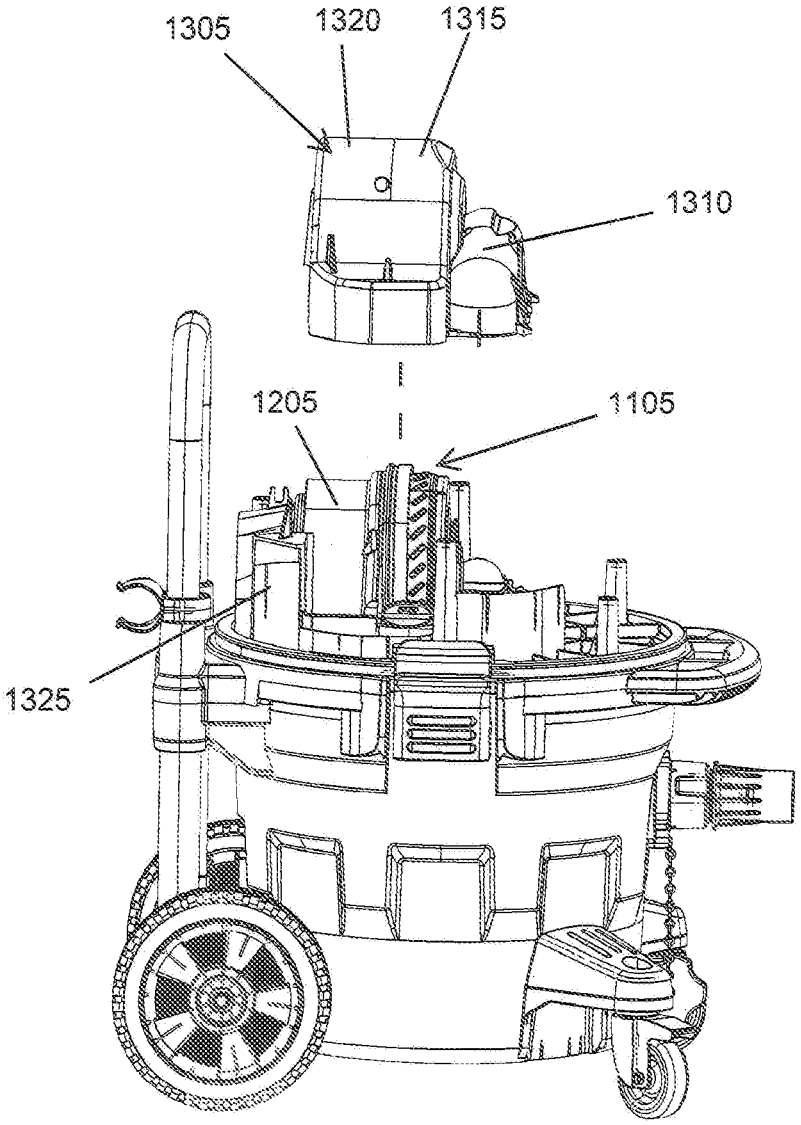
FIG. 14A illustrates an exploded view of the tank and the manifold of the vacuum system, showing the positional relationship between the manifold and the separator plate of FIG. 9A.
Figure 14B:
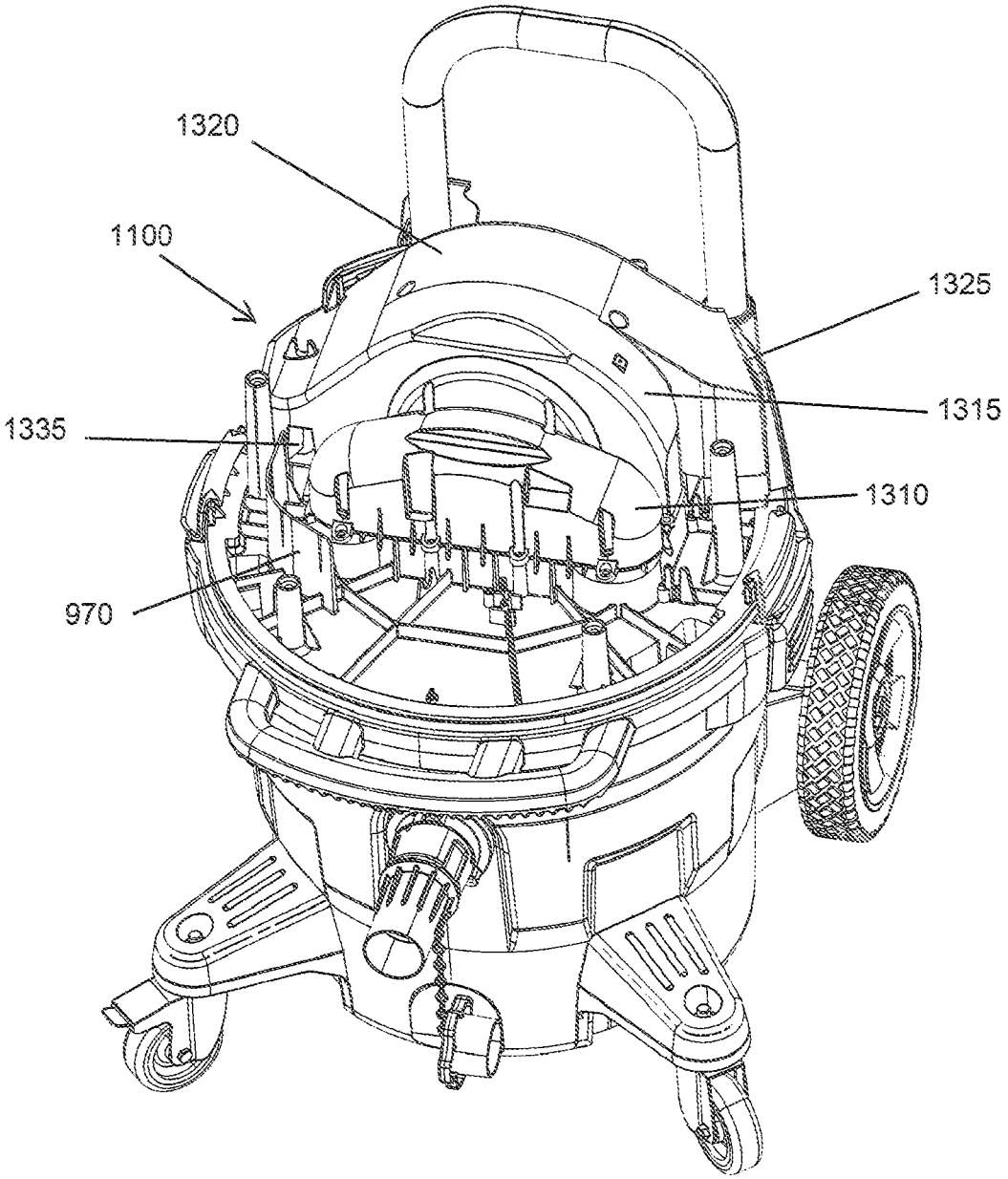
FIGS. 14B and 14C illustrate perspective views of vacuum system with the vacuum head removed for clarity, showing the manifold of FIG. 13A mounted on the separator plate of FIG. 9A.
Figure 14C:
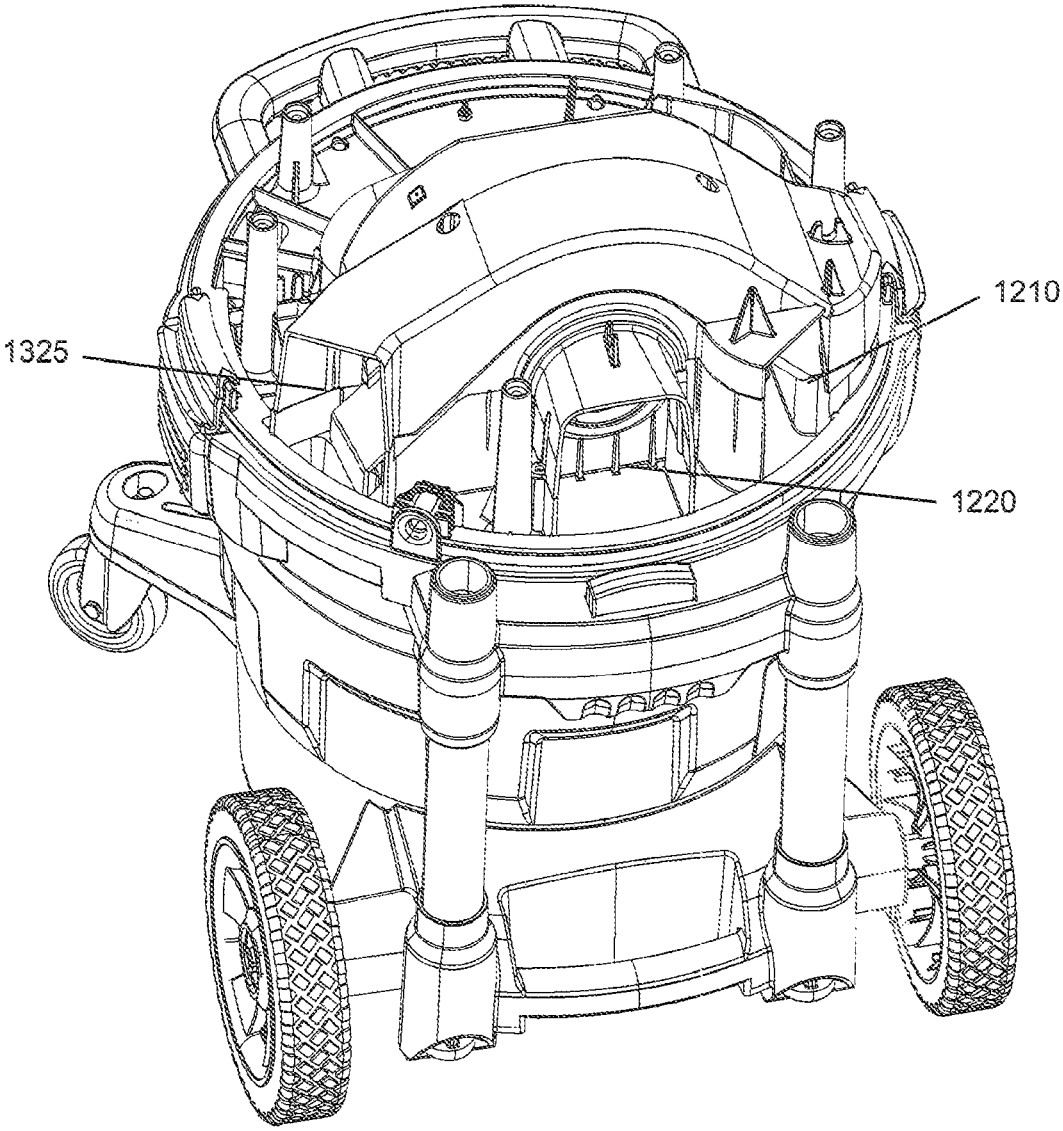

Referring to FIGS. 14A-14C, once coupled to the separation plate 900, the inlet chamber 1310 is positioned over the suction conduits 935A, 940A, the discharge chamber 1315 is positioned over the fan 1105 and the cleaning conduits 935B, 940B, and the exhaust chamber 1320 is positioned over the motor shroud 1205. The operation of the manifold 1305 is discussed in greater detail below.

Figure 15B:
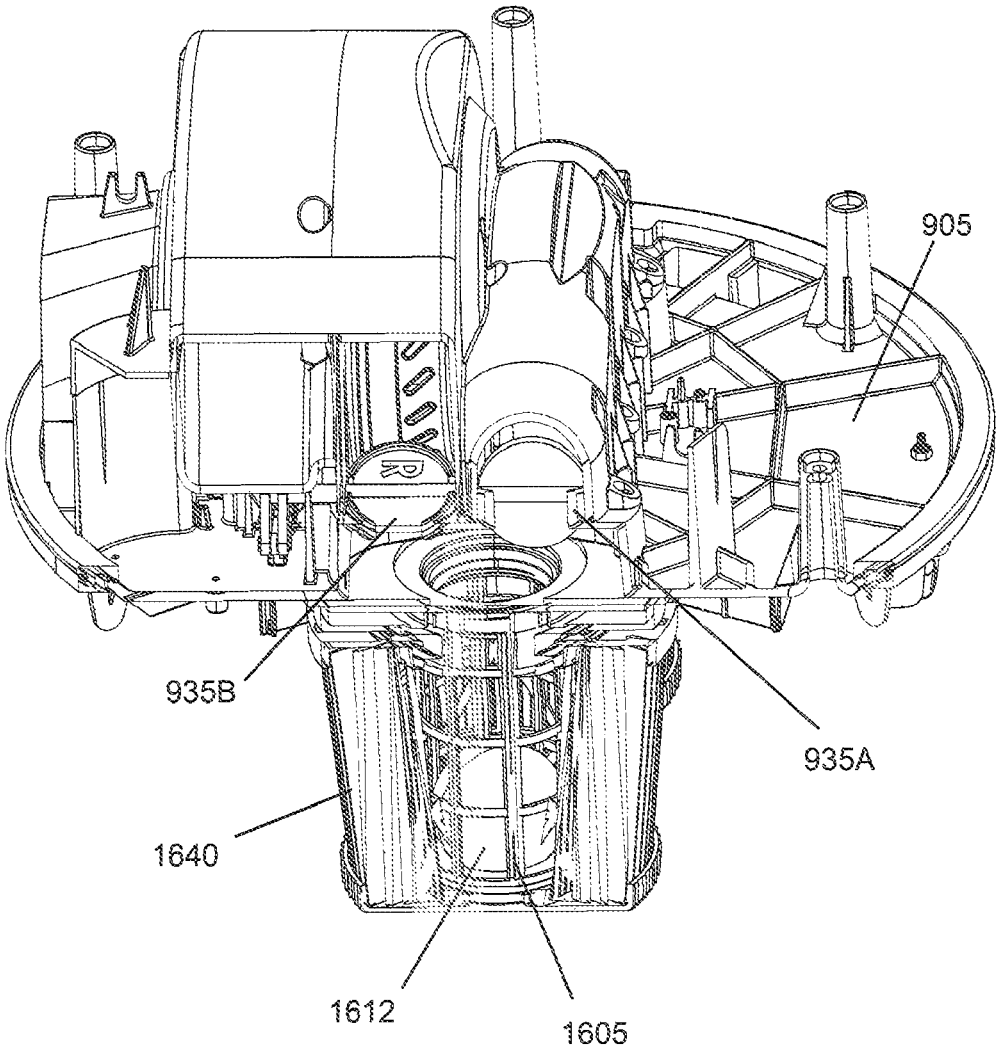
FIG. 15B illustrates a cross sectional view of the filter assembly shown in FIG. 15A.

The vacuum device 10 includes a filter assembly that captures particles within the contaminated airstream entering the tank 105, cleaning the airstream as the airstream flows through the body 100 of the vacuum device 10. In the embodiment illustrated in FIGS. 15A and 15B, the filter assembly 1500 includes a first filter 1505A and a second filter 1505B. The filters 1505A, 1505B may be coupled to the platform lower surface 912, being generally radially aligned along opposite sides of plate center point and suspended above the floor of the tank 105. Additionally, as best seen in FIG. 15B, each filter 1505A, 1505B is in communication with both conduits 935A, 935B, 940A, 940B forming a conduit pair 935, 940 (i.e., the first filter 1505A is in fluid communication with the first conduit pair 935, while second filter 1505B is in fluid communication with second conduit pair 940).

Figure 16A:
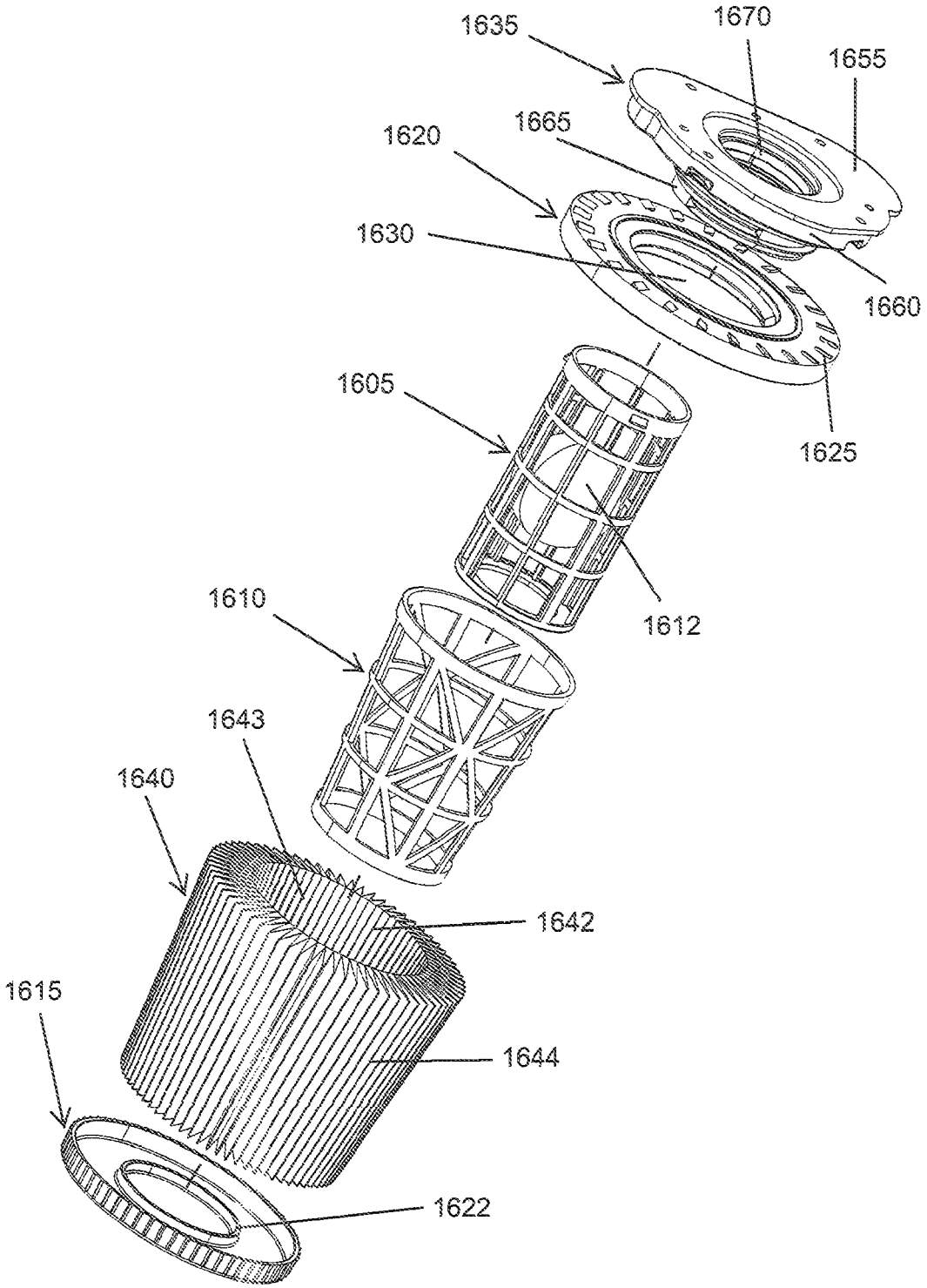
FIG. 16A illustrates an exploded view of a filter device in accordance with an embodiment of the invention.
Figure 16B:
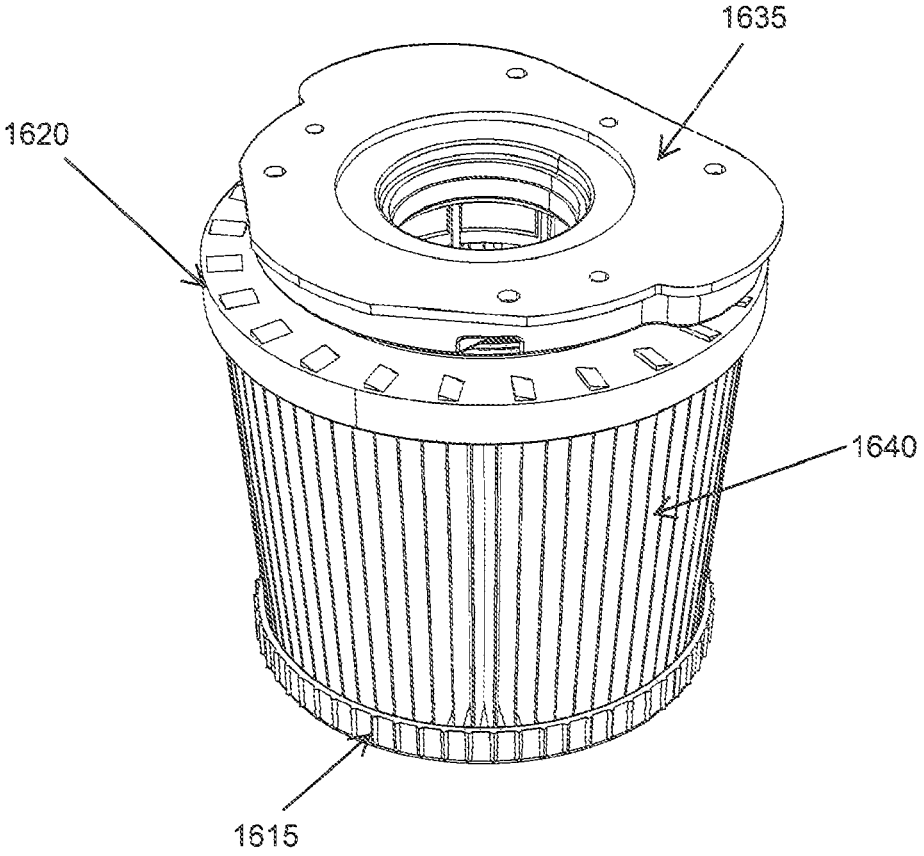
FIG. 16B illustrates a perspective view of the filter device shown in FIG. 16A.

Referring to embodiment illustrated in FIGS. 16A and 16B, each filter 1505A, 1505B may include a substantially rigid, inner cage 1605 generally concentrically disposed within a core member or outer cage 1610. The inner cage 1605, which houses a ball float 1612, may be generally cylindrical. The outer cage 1610, which formed of wire screen, may possess a generally frustoconical shape. The outer cage is generally rigid, providing stiffness from end to end such that it can be threadingly tightened along one of the ends to an end cap. Specifically, the lower (narrower) terminus of the outer cage 1610 couples to a lower end cap 1615, while the upper (wider) terminus of the outer cage couples to an upper end cap 1620. The lower end cap 1615 may be in form of a solid, circular plate with an exterior wall extending upward from the plate and extending about its periphery, as well as an inner wall or rib 1622 concentric with the outer wall and configured to engage the core member 1610 lower end. The upper end cap 1620 may be generally annular, including a plurality of ratchet teeth 1625 disposed along on its upper side (being angularly spaced about the perimeter of the cap). The inner channel 1630 of the upper end cap 1620, moreover, is threaded to mate with corresponding threads on a filter mount 1635 (discussed in greater detail below).

A filter medium 1640 operable to remove particulates from the airstream is mounted on the outer cage 1610. As shown, the filter medium 1640 may in the form of a sleeve including a hollow channel 1642 defined by the interior surface of a wall 1643 and a plurality of longitudinal fins 1644 angularly spaced about the exterior surface of the wall. The filter medium 1640 may possess a shape and dimensions that enable it to contour to the exterior surface of the outer cage 1610 (e.g., the filter may be generally frustoconical). By way of specific example, the filter medium 1640 may possess an upper (wide end) diameter of approximately 6.4 inches, a lower (narrow end diameter) of approximately 5.25 inches, and a length (height) of approximately 5.2 inches. It should be understood that the filter medium 1640 may possess any suitable shape and dimensions, and may be formed of any material an have any structure suitable for its described purpose.

The filter mount 1635, secured to the lower surface 912 of the separator plate 900 (e.g., via fasteners), couples to the upper end cap 1620. The filter mount 1635 includes a seat member 1655 (e.g., a ball seat), a base 1660, and a threaded plug 1665 that engages the threads of the inner channel 1630 of the upper end cap 1620. A channel 1670 is formed into the filter mount 1635 to permit airflow from the filter to its associated conduit pair 935, 940.

Figure 17A:
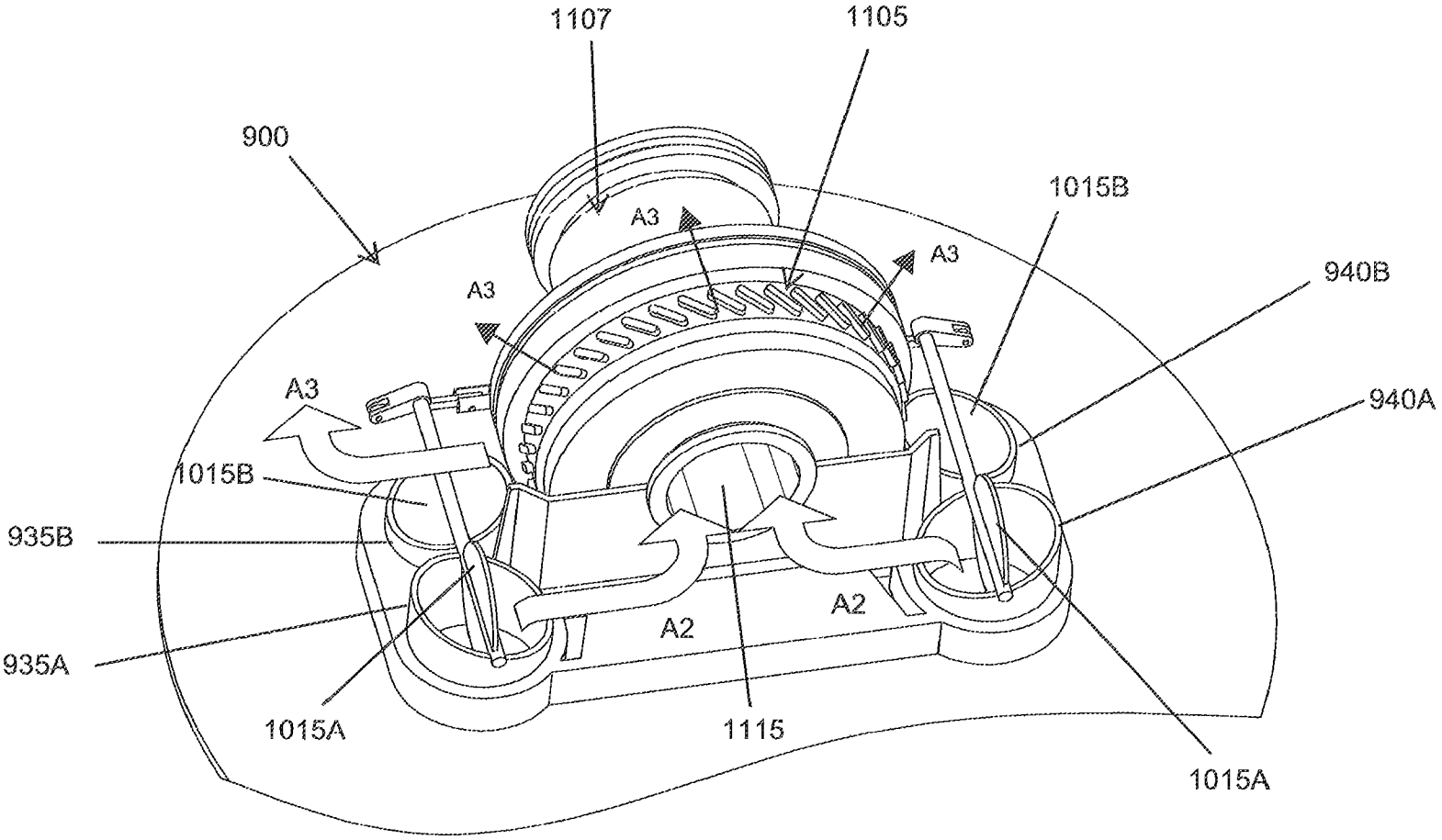
FIGS. 17A-17C illustrate schematic views showing the operation of the airflow assembly.
Figure 17B:
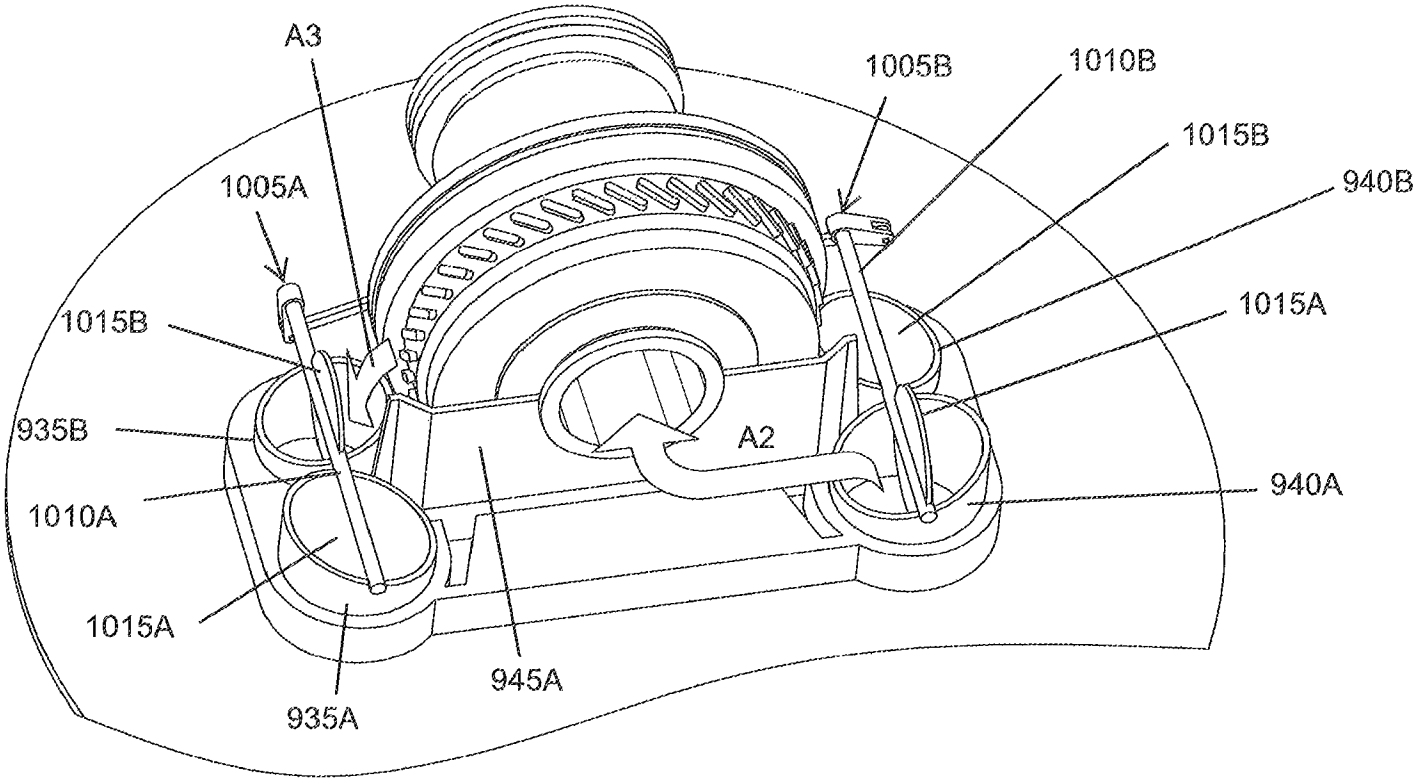
Figure 17C:
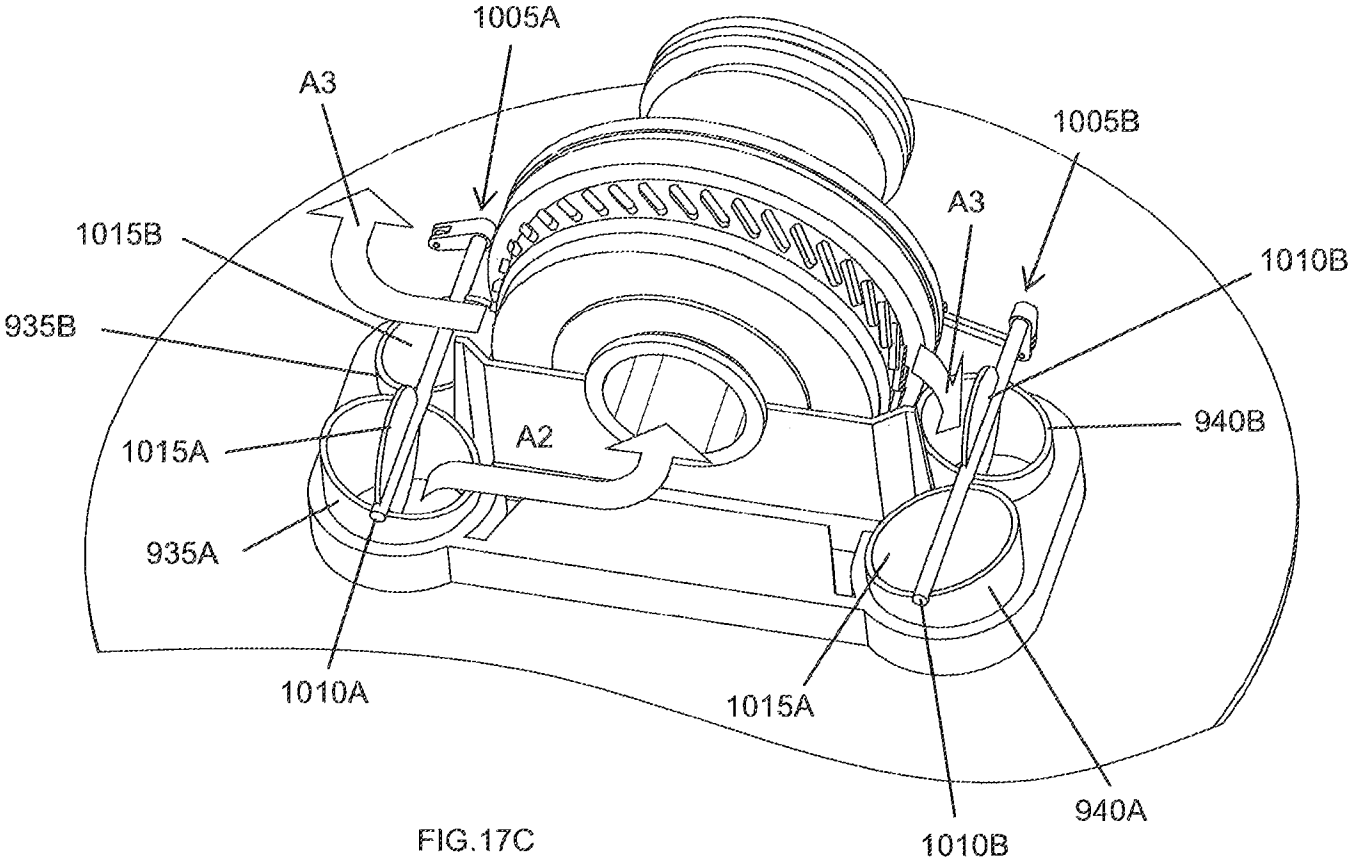
Figure 18A:
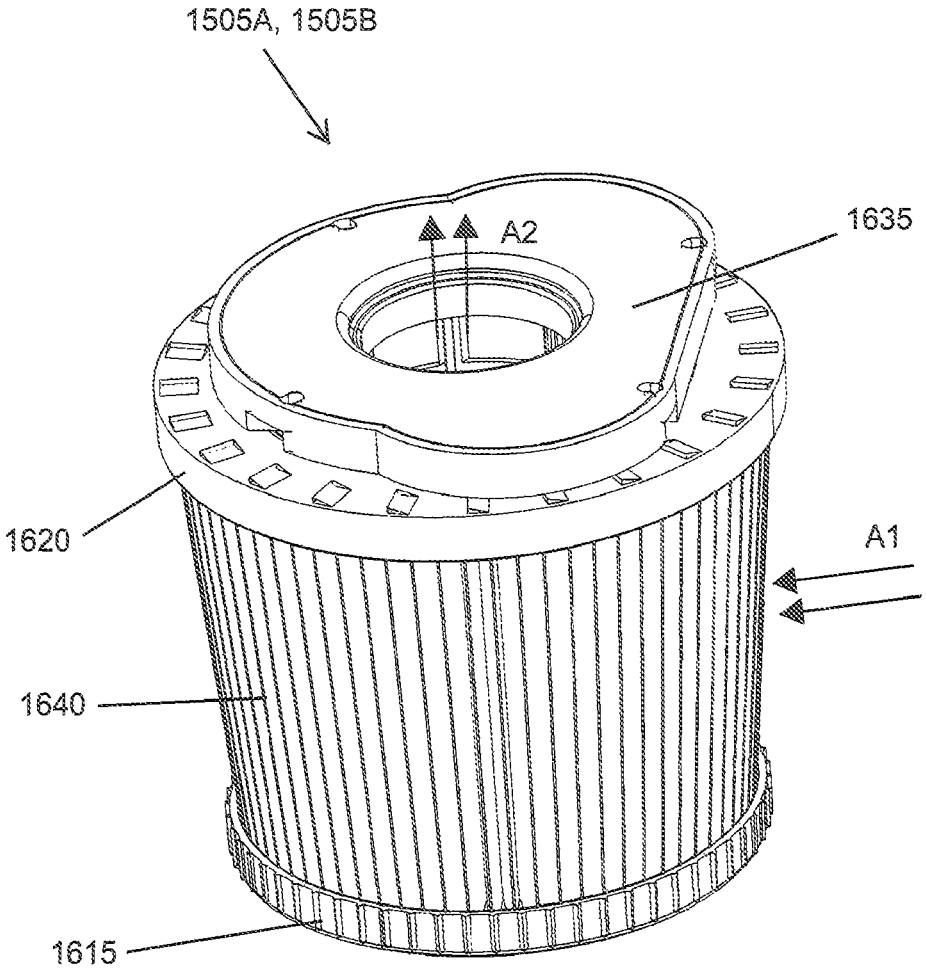
FIGS. 18A and 18B illustrate a schematic views showing airflow through the filter device.

The operation of the vacuum device 10 is explained with references to FIGS. 17A-17C and FIGS. 18A-18C. The motor 1107 is activated (e.g., via controls 725 on dashboard 720), rotating the fan 1105. The fan 1105 creates a vacuum (suction) airflow within the body 100 of the vacuum device 10. Referring to FIGS. 17A and 18A, in a first operational mode, the butterfly values 1005A, 1005B are positioned in their normal, full suction position. In this position, the vacuum device 10 generates suction airflow that is filtered through the filter medium 1640 of each filter 1505A, 1505B. Specifically, the butterfly valves 1005A, 1005B are set such that both the first suction conduit 935A and the second suction conduit 940A are opened, and both the first cleaning conduit 935B and the second cleaning conduit 940B are closed. As a result, the fan 1105 draws contaminated air A1 including debris (particulate material) into the tank 105 (e.g., via an inlet/hose). The contaminated air A1 travels through the collection chamber 214 and is drawn toward the filters 1505A, 1505B. Specifically, the air passes through the filter medium 1640 in a first filter direction, with the air entering the filter medium via the medium exterior surface. As the contaminated air A1 passes through the filter medium 1640 of the filters 1505A, 1505B, particles and other debris within the contaminated air are captured by the filter medium. Larger debris falls (via gravity) to the bottom of the tank 105, while smaller debris becomes attached and/or embedded within the filter medium 1640. This airstream, now filtered air A2, passes upward, through the central channel of the filter (as defined by inner cage 1605) and toward the suction conduit 935A, 940A.

The filtered air A2 passes through the suction conduit 935A, 940A, i.e., from the collection chamber defined by the tank 105 and into the motor chamber defined by the vacuum head 110. Specifically, the filtered air A2 enters the manifold 1305 of the air assembly disposed within the motor chamber, entering the inlet chamber 1310. The filtered air A2 is drawn into the fan central aperture 1115 and is directed radially outward therefrom as fan exhaust or discharge air A3 (indicated by arrows). The discharge air A3 is directed, via the slots 1112, into the manifold discharge chamber 1315. The cleaner conduits 935B, 940B are closed/sealed; consequently, a portion of the discharge air A3 is directed from the discharge chamber 1315, through the first window 1330, and into the exhaust chamber 1320. Additionally, a portion of the discharge air A3 is deflected by manifold deflector 1337 such that it passes through the second window 1335. As such, a portion of the discharge air A3 exits the manifold 1305 (and the vacuum system 10) as manifold exhaust air A4 via manifold exhaust outlet 1325. Additionally, a portion of the discharge air is recycled as electronics coolant A3', exiting the manifold 1305 and returning to the motor chamber defined by the head 110 to cool electronics housed in the head (discussed in greater detail below).

Figure 18B:
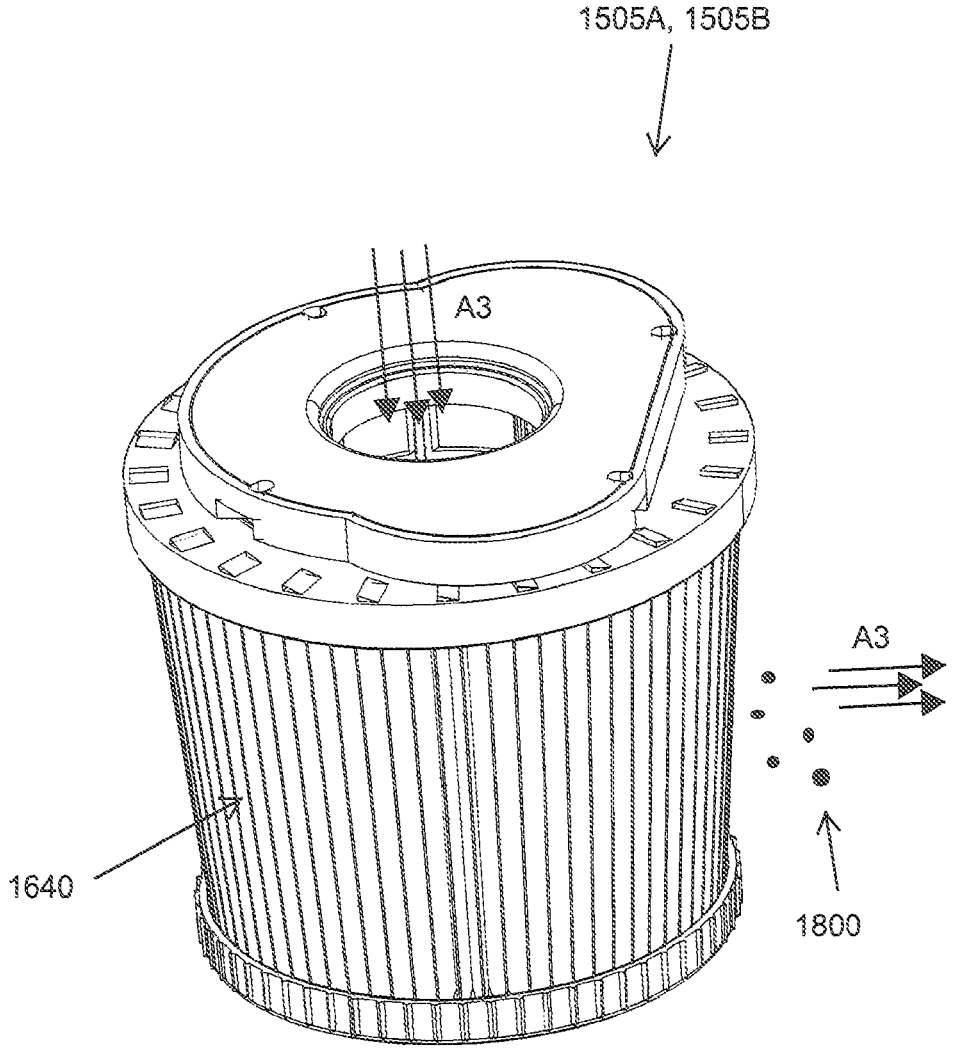

Referring to FIGS. 17B and 18B, in a second operational mode, the filter medium 1640 of the first filter 1505A is purged of debris. In this mode, the first butterfly valve 1005A is engaged to reorient the valve from its normal position to its purge position. Specifically, the first rod 1010A is rotated such that distal disc 1015A covers/seals the first suction conduit 935A and the proximal disc 1015B is positioned such that it is oriented generally transverse to the opening of the first cleaning conduit 935B. In this configuration, the first cleaning conduit 935B is opened, while the first suction conduit 935A is closed/sealed. The second butterfly valve 1005B remains in its normal position as described above, with the second suction conduit 940A being opened and the second cleaning conduit 940B being closed/sealed.

In this configuration, the suction airflow through the first filter 1505A ceases. That is, contaminated air A1 no longer passes through the filter medium 1640 of the first filter 1505A via the filter medium exterior surface. Suction airflow through the second filter 1505B, however, is maintained. The filtered air A2 from the second filter 1505B enters the manifold 1305, where it is drawn into the fan 1105 and expelled through fan slots 1112 as discharge air A3. With the cleaning conduit 935B in its opened position, at least a portion of the discharge air A3 is directed downward, into the first cleaning conduit 935B (indicated by arrow). The discharge air A3 enters the central channel of the first filter 1505A (as defined by the inner cage 1605) and is forced radially outward, passing through the filter medium 1640 in a second filter direction. As shown in FIG. 18B, this outward airflow functions as a purging airflow effective to dislodge at least a portion of the debris and/or particles 1800 previously attached to and/or embedded within the filter medium 1640. Any remaining discharge air A3 (i.e., and discharge air not directed into the cleaning conduit 935B) is directed as indicated above, being expelled from the tank as either manifold exhaust A4 or being recycled as electronics coolant A3'.

In a third operational mode, the filter medium 1640 of the second filter 1505B is purged. The same operation described above with regard to the first filter 1505A occurs with the second filter 1505B. Referring to FIGS. 17C and 18B, the first butterfly valve 1005A is returned to its normal position, in which the first suction conduit 935A is opened and first cleaning conduit 935B is sealed/closed. In addition, the second butterfly valve 1005B is engaged, moving the valve from its normal position to a purge position, in which the second suction conduit 940A is closed and the second cleaning conduit 940B is opened. Similar to that described above, discharge airflow A3 drawn into the manifold 1305 as filtered air is either directed into the second cleaning conduit 940B, out of the head 1010 via the manifold exhaust chamber 1320, or back into the head 1010 via second window 1035. The discharge air A3 that is directed through the cleaning conduit passes through the filter medium 1640 of the second filter 1505B in a second direction (opposite the first direction), thereby purging the filter medium of debris captured thereon.

The amount of time for the purge is not particularly limited. By way of example, the airflow system may operate in the suction mode for a first predetermined period of time and in the purging/cleaning mode for a second predetermined period of time, with the second period of time being less than the first period. In an embodiment, the valve system cycles, generating suction air for approximately 30 seconds, and then generating purge air for approximately 0.3 seconds, alternately purging the first filter 1505A and the second filter 705B. This process continues, with the filters 1505A, 1505B alternately being purged in approximately every 20 seconds.

Figure 19A:
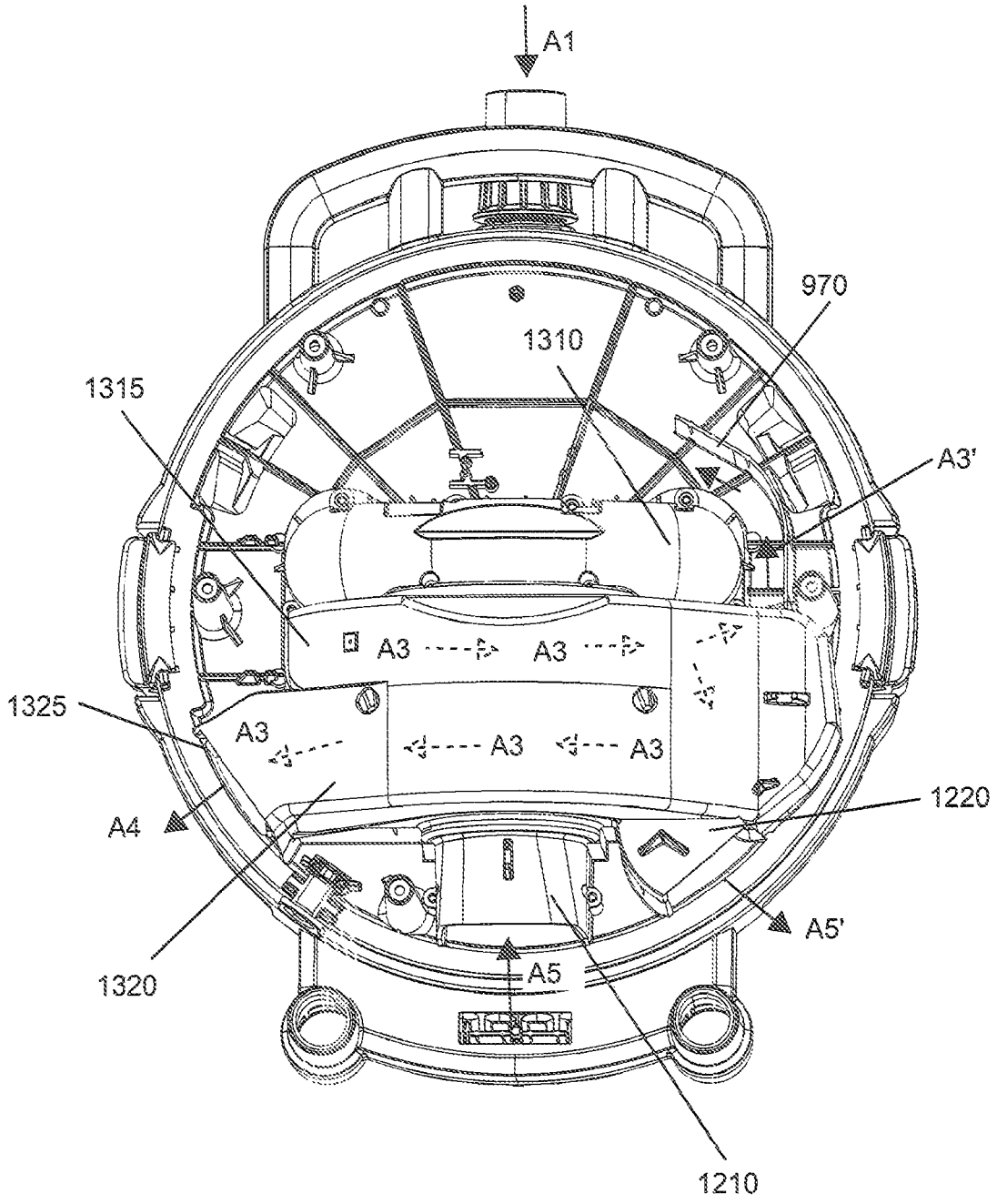
FIGS. 19A and 19B illustrate a schematic views showing airflow through the airflow assembly.
Figure 19B:
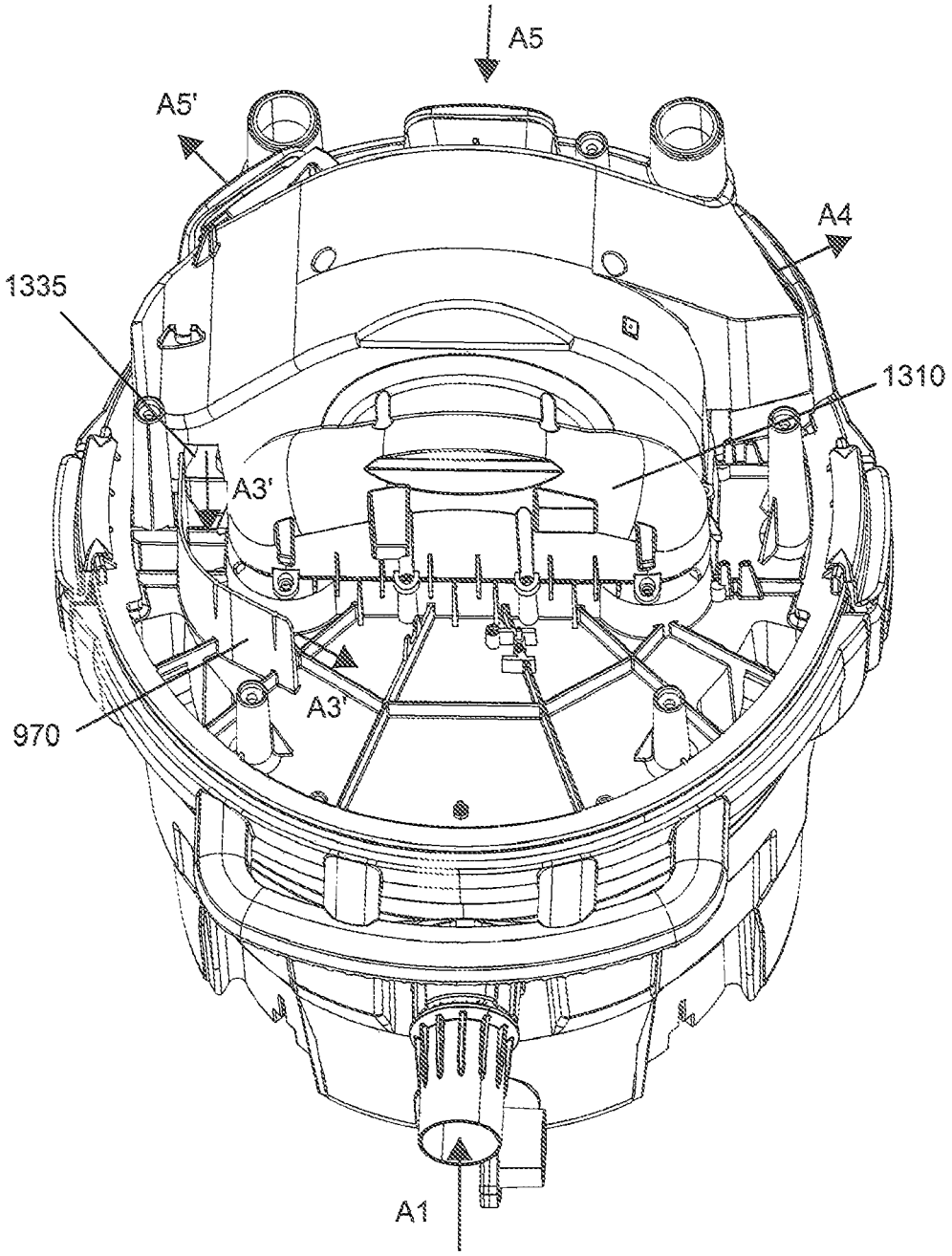

Referring to FIGS. 19A and 19B, during operation, cooling air A5 for the motor 1007 is drawn in through the motor intake port 1210 of the motor shroud 1205, where it is directed across the motor, cooling it, and then out through motor exhaust 1220 as motor exhaust air A5'. As mentioned above, the motor airflow A5, A5' remains separate from the vacuum airflow A1, A2, A3, A3', A4 vacuum filtered air, with the motor shroud preventing the motor air A5, A5' from entering the manifold 1305.

Figure 20:
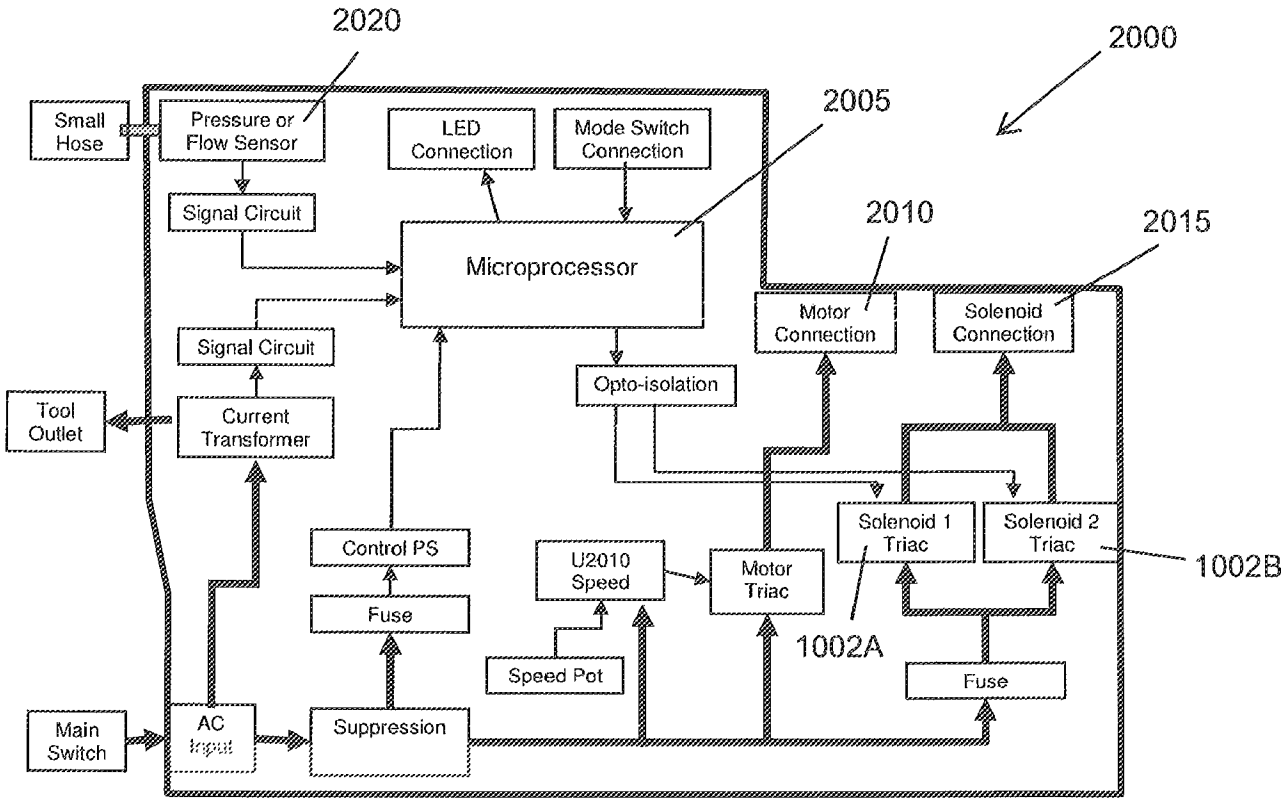
FIG. 20 illustrates an electrical diagram in accordance with an embodiment of the invention.

FIG. 20 illustrates an electrical schematic for the vacuum device 10 in accordance with an embodiment of the invention. As shown, the electrical system 2000 includes a microprocessor 2005 in communication with the motor via motor connect 2010, as well as the butterfly valves 1005, 1005B via a solenoid connect 2015, which, in turn, is in communication with solenoid switches 1002A, 1002B. The system 2000 may further include a pressure or flow sensor 2020 operable to indicate when the intake airflow A1 is reaches (e.g., is above or below) a predetermined threshold value. By way of example, it may indicate when the airflow pressure or flow velocity is below a specified value, thereby notifying the user that the filters must be removed for manual cleaning or replacement.

While the present invention has been described in detail and with reference to specific embodiments thereof, it will be apparent to one skilled in the art that various changes and modifications can be made therein without departing from the spirit and scope thereof. Thus, it is intended that the present invention covers the modifications and variations of this invention provided they come within the scope of the appended claims and their equivalents. It is to be understood that terms such as "top", "bottom", "front", "rear", "side", "height", "length", "width", "upper", "lower", "interior", "exterior", and the like as may be used herein, merely describe points of reference and do not limit the present invention to any particular orientation or configuration.

The invention claimed is:

1. A portable vacuum device comprising:

a debris collection chamber including an inlet and an inlet connector for attachment of a flexible hose;

a head portion detachable from the collection chamber and defining a space outside the collection chamber;

a first filter disposed within the collection chamber;

a second filter disposed within the collection chamber;

an airflow generating device disposed in the space, the airflow generating device normally drawing air in a forward direction from the collection chamber inlet, through at least one filter and then discharging the drawn air to a clean air reservoir outside the collection chamber; wherein each said filter is respectively associated with first and second conduits in selective fluid communication with their respective filters, a switching mechanism of the vacuum device permitting air to flow via the respective filters either along a first path between the collection chamber and the airflow generating device or along a second path between the collection chamber and the clean air reservoir, the collection chamber being at a lower pressure than the clean air reservoir such that when air flows through the filter along the second path it flows through the filter in a direction opposite the forward direction to clean the filters, and wherein the switching mechanism includes respective butterfly valves, each valve including a shaft and the shaft supporting a first distal disk and a second proximal disk longitudinally spaced along the shaft; and wherein the first distal and second proximal disks each include first and second disk portions, the disk portions extending away from the shaft in different directions, the first distal disk controlling flow in the first path and the second proximal disc controlling flow in the second path.

2. The vacuum device of claim 1, wherein:

the device operates in the first mode for a first period of time;

the device operates in the second mode for a second period of time; and the second period of time differs from the first period of time.

3. The vacuum device of claim 1, wherein the airflow generating device comprises a fan rotating about a fan rotational axis; and wherein the fan rotational axis is oriented in a generally horizontal plane with respect to the surface on which the vacuum device sits; and wherein the valve shaft extends in the same general direction as the rotational axis.

4. The vacuum device of claim 3, further comprising a shroud for segregating air entering the space via the collection chamber from air being discharged by the airflow generating device into the space.

5. The vacuum device of claim 1, wherein the airflow generating device comprises a centrifugal fan.

6. The vacuum device of claim 1, further comprising a manifold including a first manifold chamber operable to direct airflow along the first path; and a second manifold chamber operable to direct the exhaust airstream along the second path.

7. The vacuum device of claim 1, wherein the vacuum device further comprises a separator plate separating the collection chamber from the space;

the separator plate comprises a platform and a plurality of legs depending from the platform; and the legs and the filters extend from a lower portion of the separator plate; and wherein the legs extend into receptacles in the debris collection chamber to guide the head portion as the head portion is positioned on the debris collection chamber.

8. The vacuum device of claim 1, wherein the butterfly valves including a first disc configured to selectively open and close the first path to air flow and a second disc operable to selectively open and close the second path to air flow; and wherein the first distal disk and the second proximal disk are rotationally offset on the shaft; and wherein the offset is about 45°.

9. The vacuum device of claim 1, wherein the head portion includes an opening, wherein air discharged into the space is exhausted from the head portion via the opening, and wherein air for the reservoir is drawn from the space.

10. The vacuum device of claim 1, wherein the discharged pressure of the air flow generating device into the space is higher than the pressure of the collection chamber and higher than the pressure in the air surrounding the vacuum device.

11. The vacuum device of claim 10, wherein a portion of the airflow generating device discharge is diverted toward electronic components for cooling.

12. The vacuum device of claim 10 further comprising an electronic switch mechanism configured to selectively open and close each of the first and second paths.

13. The vacuum device of claim 12, wherein the butterfly valve includes a first disc disposed in the first path and a second disc disposed in the second path, wherein the first disc is rotationally offset from the second disc on a common rotational axis.

14. The vacuum device of claim 13, wherein the first and second discs are connected to a rod rotated from a first position, in which the first path is opened and the second path is closed, to a second position, in which the first path is closed and the second path is opened.

15. The vacuum device of claim 1, further comprising a shroud for directing air from the discharge of the airflow generating device into the second path.

16. A portable vacuum device comprising:

a debris collection chamber;

a head portion defining a space outside the collection chamber;

a first filter disposed within the collection chamber;

a second filter disposed within the collection chamber;

an airflow generating device disposed in the space, the airflow generating device normally drawing air in a forward direction from a collection chamber inlet, through at least one filter and then discharging the drawn air to a clean air reservoir outside the collection chamber;

wherein each said filter respectively associated with first and second conduits in selective fluid communication with their respective filters, the vacuum device permitting air to flow via the respective filters either along a first path between the collection chamber and the airflow generating device or along a second path between the collection chamber and the clean air reservoir, the collection chamber being at a lower pressure than the clean air reservoir such that when air flows through the filter along the second path it flows through the filter in a direction opposite the forward direction to clean the filters, and where each valve includes a shaft and the shaft supports at least one disk, the shaft separating the disk into first and second disk portions;

and wherein the selective fluid communication results from rotation of the disk by rotation of the shaft to open or close the first or second paths; and wherein the first disk portion extends from the shaft in a first direction, the air flow generating device causing a pressure in the first or second path, the pressure acting on the first disk portion to cause a first rotational force on the shaft in a first rotational direction, and wherein the second disk portion extends from the shaft in a second direction, the pressure caused by the airflow generating device also causing a second rotational force on the shaft in a second an opposite rotational direction, the first and second forces counteracting each other to minimize or eliminate a net rotational force necessary to open or close the valve.

17. A portable vacuum device comprising:

a debris collection chamber including an inlet and an inlet connector for attachment of a flexible hose;

a head portion detachable from the collection chamber and defining a space outside the collection chamber;

a handle attached to the head or the collection chamber for carrying the vacuum device;

a first filter disposed within the collection chamber;

a second filter disposed within the collection chamber;

an airflow generating device disposed in the space, the airflow generating device normally drawing air in a forward direction from the collection chamber inlet, through at least one filter and then discharging the drawn air to a clean air reservoir outside the collection chamber; wherein each said filter is respectively associated with first and second conduits in selective fluid communication with their respective filters, a switching mechanism of the vacuum device permitting air to flow via the respective filters either along a first path between the collection chamber and the airflow generating device or along a second path between the collection chamber and the clean air reservoir, the collection chamber being at a lower pressure than the clean air reservoir such that when air flows through the filter along the second path it flows through the filter in a direction opposite the forward direction to clean the filters, and wherein the switching mechanism includes respective butterfly valves; and wherein each valve includes a shaft and the shaft supports a first distal disk and a second proximal disk longitudinally offset along the shaft; and wherein the first distal disk and the second proximal disk are rotationally offset on the shaft.

* * * * *